US005918855A

United States Patent [19]

Hamanaka et al.

[11] Patent Number: 5,918,855

[45] Date of Patent: Jul. 6, 1999

[54] AUTOMATIC FAUCET

[75] Inventors: Tatsumi Hamanaka; Mitsuyoshi Seki; Takatoshi Kawabata; Toshiyuki Murahashi; Tadahiro Honda; Yoshiyuki Kaneko; Hiroyuki Iwashita, all of Kitakyushu, Japan

[73] Assignee: Toto Ltd., Fukuoka, Japan

[21] Appl. No.: 08/501,032

[22] PCT Filed: Dec. 20, 1994

[86] PCT No.: PCT/JP94/02156

§ 371 Date: Nov. 1, 1995

§ 102(e) Date: Nov. 1, 1995

[87] PCT Pub. No.: WO95/17556

PCT Pub. Date: Jun. 29, 1995

[30] Foreign Application Priority Data

| | | | |
|---|---|---|---|
| Dec. 20, 1993 | [JP] | Japan | 5-320280 |
| Dec. 28, 1993 | [JP] | Japan | 5-336916 |
| Mar. 28, 1994 | [JP] | Japan | 6-057861 |

[51] Int. Cl.[6] ..... F16K 31/02

[52] U.S. Cl. ..... 251/129.04; 4/623

[58] Field of Search ..... 251/129.04, 129.01; 4/623

[56] References Cited

U.S. PATENT DOCUMENTS

| | | | |
|---|---|---|---|
| 3,638,680 | 2/1972 | Kopp | 251/129.04 X |
| 4,767,922 | 8/1988 | Stauffer . | |
| 4,872,485 | 10/1989 | Laverty, Jr. | 4/623 X |
| 4,894,874 | 1/1990 | Wilson . | |
| 4,921,211 | 5/1990 | Novak et al. . | |
| 5,458,147 | 10/1995 | Mauerhofer | 251/129.04 X |

FOREIGN PATENT DOCUMENTS

| | | |
|---|---|---|
| 0617175 | 9/1994 | European Pat. Off. ..... 4/623 |
| 61-500232 | 2/1986 | Japan . |
| 63-69889 | 5/1988 | Japan . |
| 63-133673 | 9/1988 | Japan . |
| 63-199080 | 12/1988 | Japan . |
| 1-304231 | 12/1989 | Japan . |
| 2-42970 | 3/1990 | Japan . |
| 2-53590 | 4/1990 | Japan . |
| 2-90480 | 7/1990 | Japan . |
| 2-42974 | 9/1990 | Japan . |
| 3-32659 | 3/1991 | Japan . |
| 3-108988 | 11/1991 | Japan . |
| 3-122165 | 12/1991 | Japan . |
| 4-44729 | 2/1992 | Japan . |
| 4-26270 | 3/1992 | Japan . |
| 5-15798 | 3/1993 | Japan . |
| 5-25082 | 4/1993 | Japan . |
| 5-30264 | 4/1993 | Japan . |
| 5-295773 | 11/1993 | Japan . |
| 5-87063 | 11/1993 | Japan . |
| 6-10381 | 1/1994 | Japan . |

*Primary Examiner*—Kevin Lee

*Attorney, Agent, or Firm*—Armstrong, Westerman, Hattori, McLeland, & Naughton

[57] ABSTRACT

In an automatic faucet having a hand sensor S to start and stop discharging water automatically, only hands can be detected accurately without detecting a washbowl (chinaware) and water stream erroneously. The sensor S comprises a light emitter and a light receiver. The directional axis d of a detection region (in which the light emitting region of the light emitter and the light receiving region of the light receiver are overlapped with each other) intersects the discharged water stream, and further the intersection angle between both is adjusted less than 70 degrees, irrespective of the flow rate of the discharged water. The reflected light levels detected by the light receiver are sampled periodically to calculate an average value and a variance value on the basis of at least eight most updated sampled data. Water discharge is started and stopped on the basis of the calculated average value and the variance value.

15 Claims, 41 Drawing Sheets

AUTOMATIC FAUCET

BACKGROUND OF THE INVENTION

1. Field of the Invention

The present invention relates to an automatic faucet which can start and stop discharging water automatically by sensing the behavior of hands.

2. Description of the Prior Art

Conventionally, as a sort of the faucets mounted on a chinaware such as a lavatory (washbowl), there exists such a type that a hand sensor (e.g. light sensor) for sensing hand behavior is mounted within a faucet body.

In the faucet as described above, in usual a water discharge opening is provided at the end portion of the faucet body. In addition, the water discharge opening is directed roughly downward so that water is discharged in the downward direction.

Further, the hand sensor is usually mounted in the vicinity of the water discharge opening, and further the axial line of the sensor sensing direction is offset away from the discharged water roughly in parallel. In this arrangement of the hand sensor, there exists a possibility that the chinaware is detected as hands erroneously.

To prevent this erroneous detection of the chinaware, there exists such a type that the hand sensor is mounted in the vicinity of the mounting base portion of the faucet body. In this case, the sensor sensing direction is slightly offset rightward or leftward away from the water discharged from the water discharge opening so that the discharged water will not be sensed. In this sensor arrangement, however, there exists some cases that even if the hands are stretched into the water stream, the automatic faucet will not be actuated.

On the other hand, in the case where the sensor is so disposed that the axial line of the sensor sensing direction is directed to the discharged water, since the discharged water is erroneously sensed as the hand, there exists such a trouble that the water is not stopped from being discharged Further, in the prior art automatic faucet, since the discharge direction of water from the discharge opening is directed downward, the hand washing space is inevitably located on the rear side (on the side of the faucet mounting base portion).

Therefore, when the user washes his hands, since the space near the finger ends is narrow and further the user cannot feel that water is being discharged onto his palms sufficiently, the quantity of discharged water increases unconsciously, thus causing a problem in that water tends to be consumed uselessly.

SUMMARY OF THE INVENTION

Accordingly, it is the object of the present invention to provide an automatic faucet which can sense only the hands accurately without detecting a water stream or a chinaware erroneously Further, the other object of the present invention is to provide an automatic faucet which can provide a sufficiently broad hand washing space within the washbowl provided with an automatic faucet.

To achieve the above-mentioned object, the first aspect of the present invention provides an automatic faucet having a hand sensor for detecting presence or absence of hands within a hand washing space to start and stop discharging water from a water discharge opening automatically, wherein the hand sensor comprises: a transmitter for transmitting a signal wave to a transmission region directed toward the hand washing space; a receiver for receiving a signal wave reflected from a reception region directed also toward the hand washing space; a detection region being formed by a partial overlapped portion of both the transmission region and reception region, and at least one of the light emitting region and the light receiving region being so adjusted as to intersect a stream of water discharged from the water discharge opening.

In the automatic faucet according to the present invention, whenever hands are stretched toward the front of the water discharge opening, it is possible to detect the hands securely to start discharging water.

Further, it is preferable that an angle e between a directional axis of the transmission or reception region and an axis of the water stream is less than 70 degrees. At this angle, since the reflected signal level from the discharged water can be more reduced, as compared with the reflected signal level from the hands more securely, it is possible to reduce a possibility that the discharged water is detected as hands erroneously.

Or else, in order to eliminate the erroneous detection, it is also preferable to set a distance between said transmitter or said receiver and the water discharge sufficiently long so that the signal wave reflected from the discharged water can be directed away from said receiver. When this distance is sufficiently long, there exists no problem even if the angle between the direction axis thereof and the discharged water is 80 degrees (which is close to a right angle).

Further, in order to prevent the erroneous detection, it is also preferable that a water flow straightening element is provided in a pipe passage for introducing water toward the water discharge opening, to form a smooth rod-shaped water flow, irrespective of flow rate of water discharged from the water discharge opening. Or else, it is also preferable that a water sprinkling element for sprinkling water discharged from the water discharge opening is provided in a pipe path for introducing water to the water discharge opening When water is discharged into a rod-shape, the signal wave can pass through the discharged water smoothly. When water is sprinkled, the signal waver is scattered. In both the cases, the reflected signal level can be reduced markedly, as compared when reflected from the hands.

The second aspect of the present invention provides an automatic faucet for starting and stopping discharging water automatically by detecting presence or absence of hands with a non-contact reflection type active sensor, which comprises:

statistical arithmetic means for sampling data indicative of reflected signal levels of the active sensor periodically and calculating at least one statistical value on the basis of a plurality of continuous data including the updated data obtained by sampling; and discriminating means for discriminating presence or absence of hands on the basis of the statistical value to start and stop water discharging.

In this automatic faucet, since the presence or absence of the hands can be discriminated on the basis of the statistical value obtained by sampling the reflected signal levels, it is possible to obtain data reliably indicative of the various conditions different between the presence and absence of the hands or the discharged water, by reducing the influences of the external disturbance or noise included in the reflected signal components. As a result, it is possible to detect the presence or absence of hands more precisely by removing the reflected signal levels from the discharged water and the washbowl.

As the statistical value, at least one of an average value, a variance value, and a standard deviation value is adopted.

In a preferred embodiment, the average value is determined as a reference level indicative of absence of both hands and discharged water, on condition that the variance value obtained at water stop is smaller than a constant value. Further, the presence or absence of hands is discriminated on the basis of a comparison result between the average value and the reference value and a comparison result between the variance value and a predetermined threshold value.

Further, it is also possible to discriminate the presence or absence of the hands by deciding the average value as a reference level, on condition that a difference between the most updated data and the average value at water stop lies within a constant range and further on the basis of a comparison result between the most updated data and the reference level.

Further, in order to increase the response characteristics of the water discharge start when hands are stretched, it is preferable to detect significant fluctuations of the reflected signal levels on the basis of the statistical value at water stop and to increase the sampling frequency.

Further, in order to prevent the erroneous detection due to fluctuations of the discharged water stream at water stop, it is preferable to determine the water discharge start condition required after the water stop more severer than the ordinary water discharge start.

Further, in order to prevent the endless repeated water discharge and stop caused by the erroneous detection in a specific situation, it is preferable to count the number of water discharges continuously repeated at time intervals shorter than a predetermined time and to inhibit the continuously repeated water discharges when a value counted by said water discharge counter exceeds a predetermined value.

Further, the third aspect of the present invention provides an automatic faucet for starting and stopping discharging water automatically by detecting presence or absence of hands, wherein the water discharge opening is directed so that water can be discharged slightly downward from a horizontal direction.

In this automatic faucet, since the water is discharged roughly in the horizontal direction and describes a parabolic curve, the water stream can be received by the hands at roughly the middle portion of the washbowl, so that it is possible to obtain a sufficiently broad hand washing space within the washbowl. In addition, since the user can see the discharged water, the user can easily stretch his hands toward the water discharge opening.

Further, it is preferable to provide a flow rate control device for holding a water discharge rate at a constant level, irrespective of water pressure of a water supply source.

Further, the fourth aspect of the present invention provides a faucet having a faucet body and a spout connected to the faucet body, wherein the spout comprises a nozzle pipe having a base end portion screwed with the faucet body and an end portion formed with a water discharge opening; and a nozzle cover fitted to said nozzle pipe externally, said nozzle pipe being further formed with a projection at an inner surface of said nozzle cover so as to be engaged from an end side direction, said nozzle cover being sandwiched between the faucet body and the projection.

In this faucet, it is possible to manufacture an attractive faucet such that the spout and the faucet body are formed integral with each other easily at a low cost, without using any molding die.

Further, in order to easily attach the nozzle pipe to the faucet body, it is preferable that the faucet body comprises an outer member and an inner member fitted into the outer member.

Further, in order to attach the nozzle pipe more easily and securely, it is preferable that a nozzle mounting member is housed within said outer member of the faucet body, and the base end portion of said nozzle pipe is screwed with said nozzle mounting member.

Further, it is possible to reduce the manufacturing cost by forming said outer member of metal and said inner member of resin.

Further, it is preferable to provide a revolution stopping mechanism for preventing relative revolution between said outer member and said inner member, because both the members are not rotated relative to each other during the assembly. In particular, in the automatic faucet having the hand sensor within the inner member, this is advantageous because the sensor can be aligned with the sensor window formed in the outer member.

Further, in order to improve the tightness between the inner member and the outer member, it is preferable to form a skirt portion expanding outward from a bottom portion thereof, respectively.

Further, in order to obtain a broad hand washing space, it is preferable that the faucet body is disposed on a surface of a mounting wall vertically in such a way as to be inclined toward the water discharge opening.

Further, the fifth aspect of the present invention provides a faucet fixed to an upper surface of a wall, which comprises: a bolt extending downward from a lower end portion of the faucet, passing through an opening formed in the wall, and projecting downward from a lower surface of the wall; a washer plate formed with a through hole through which the projecting portion of said bolt is inserted; and a nut screwed with a downward projecting portion of said bolt passing through the through hole, to bring said washer plate into pressure contact with a lower surface of the wall, so that the faucet can be fixed to an upper surface of the wall, the through hole being formed at a position dislocated away from a gravity center of said washer plate.

When this faucet is installed on the upper surface of a wall, a washer plate is passed through a bolt and then bolt is fastened with a nut. In this fastening work, even where the washer plate is passed through the bolt, the washer plate will not drop because the washer plate is inclined by its weight and thereby caught by the bolt. Therefore, since it is unnecessary to support the washer plate by the worker's hand during the fastening work, thus simplifying the work.

Further, in the preferred embodiment, a bolt and a guide member for a drainage operation lever both extend downward from a lower end portion of the faucet. Further, the washer plate is formed with a first through hole through which the bolt is passed and a second through hole through which the guide member is passed. Further, both the first and second through holes are formed at a position dislocated away from a gravity center of said washer plate, respectively.

Further, the sixth aspect of the present invention provides a structure for connecting two pipes at each end thereof, which comprises: a flange formed at an outer circumference of an end portion of each of the two pipes; a connecting member engaged with the two flanges portions of the two pipes, to bring the two flange portions into pressure contact with each other, under condition that the two flange portions of the two pipes are in contact with each other; and a revolution stopping mechanism for preventing at least one of the flanges from being rotated relative to said connecting member.

According to this structure, when two pipes are connected to each other, since the relative revolution of the pipes can be prevented, the work can be facilitated.

Further, in order to facilitate the connection between two directive parts such as valves correctly, it is preferable to form a projection in one of the flanges in an end surface thereof and a recess engaged with the projection in the other of the flanges in an end surface thereof.

Further, the seventh aspect of the present invention provides a structure for connecting a flexible tube to a water inlet and outlet openings of a water treatment installation, which comprises: a connection guide attached to the water inlet and outlet openings and formed with a male threaded surface in an outer circumference of an base end portion thereof and with a tapered surface in an outer circumference of an end portion thereof, a connection end portion of the tube being fitted externally to the formed tapered surface; and a cap nut fitted to the connection end portion of the tube externally, and formed with a large-diameter female threaded surface engaged with the male threaded surface of said connection guide and a small-diameter sliding surface brought into slidable contact with an outer circumferential surface of the tube and further brought into pressure contact with the tapered surface of the tube both in an inner circumference thereof.

According to the structure, the connection end portion of the tube is fitted to the tapered surface formed at the end portion of the connection guide and further the cap nut is screwed with the male threaded surface of the base end portion of the cap nut, so that it is possible to fixedly sandwich the tube between the sliding surface inside the cap nut and the tapered surface.

Further, in order to facilitate the fastening work of the cap nut, it is preferable to knurl the outer circumferential surface of the cap nut. Further, in order to prevent the cap nut from being fastened excessively, it is preferable to provide a stopper for restricting engage rate of the cap nut at a constant limit.

DETAILED DESCRIPTION OF THE PREFERRED EMBODIMENTS

Figure 1:
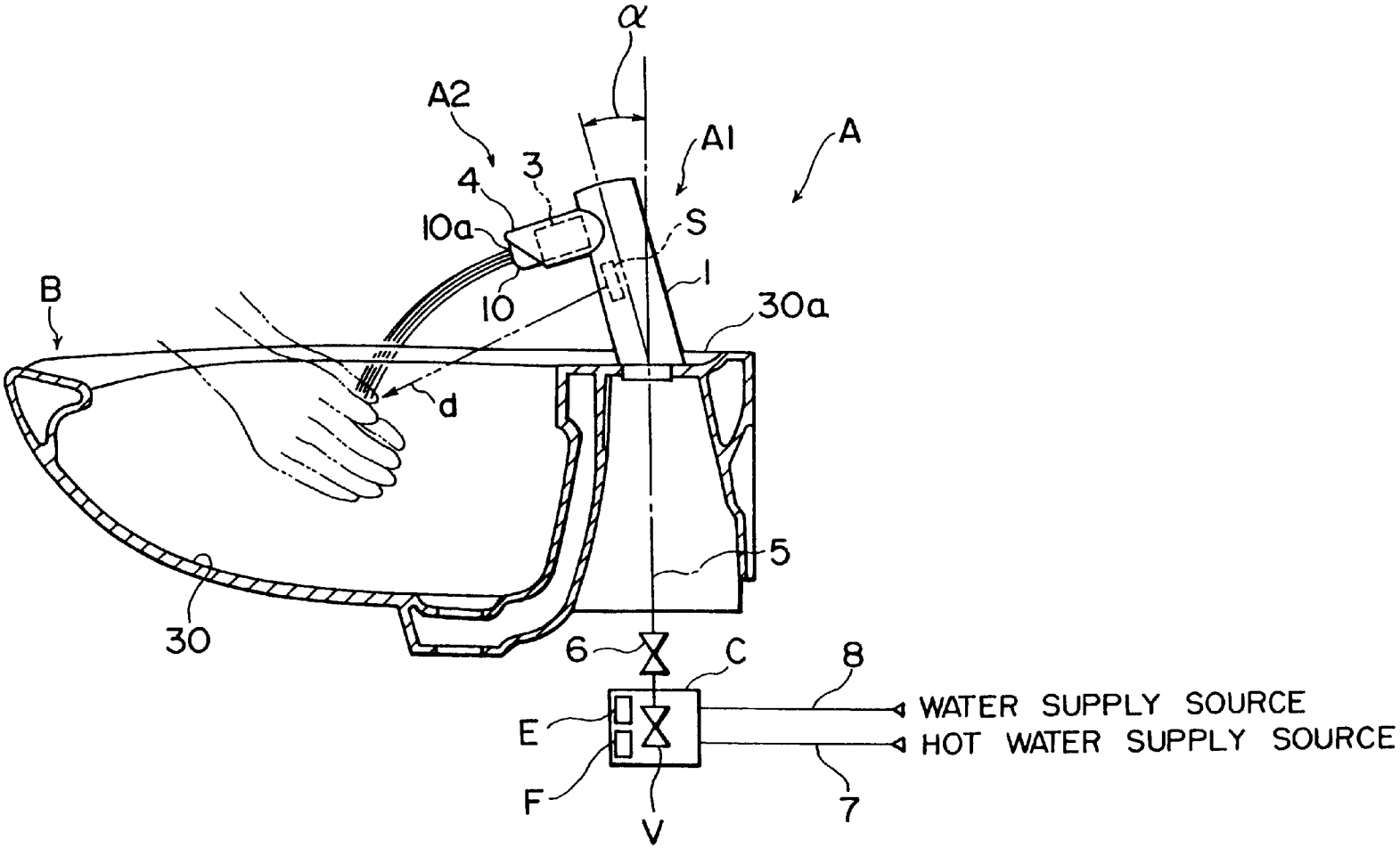
FIG. 1 is an illustration for assistance in explaining the structure of an embodiment of the automatic faucet according to the present invention in the state of being used.
Figure 2:
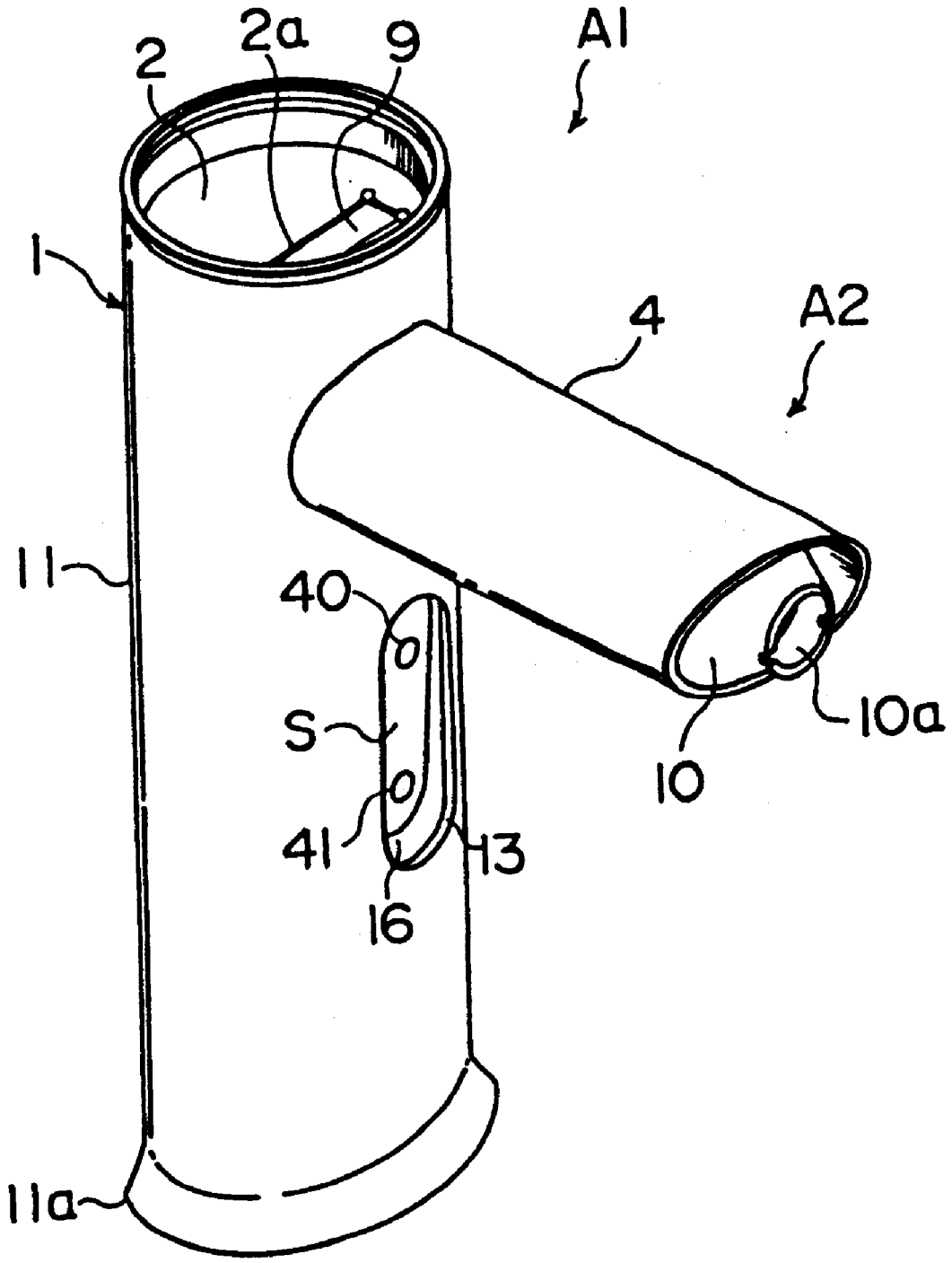
FIG. 2 is a perspective view showing the faucet section of the automatic faucet of FIG. 1.
Figure 3:
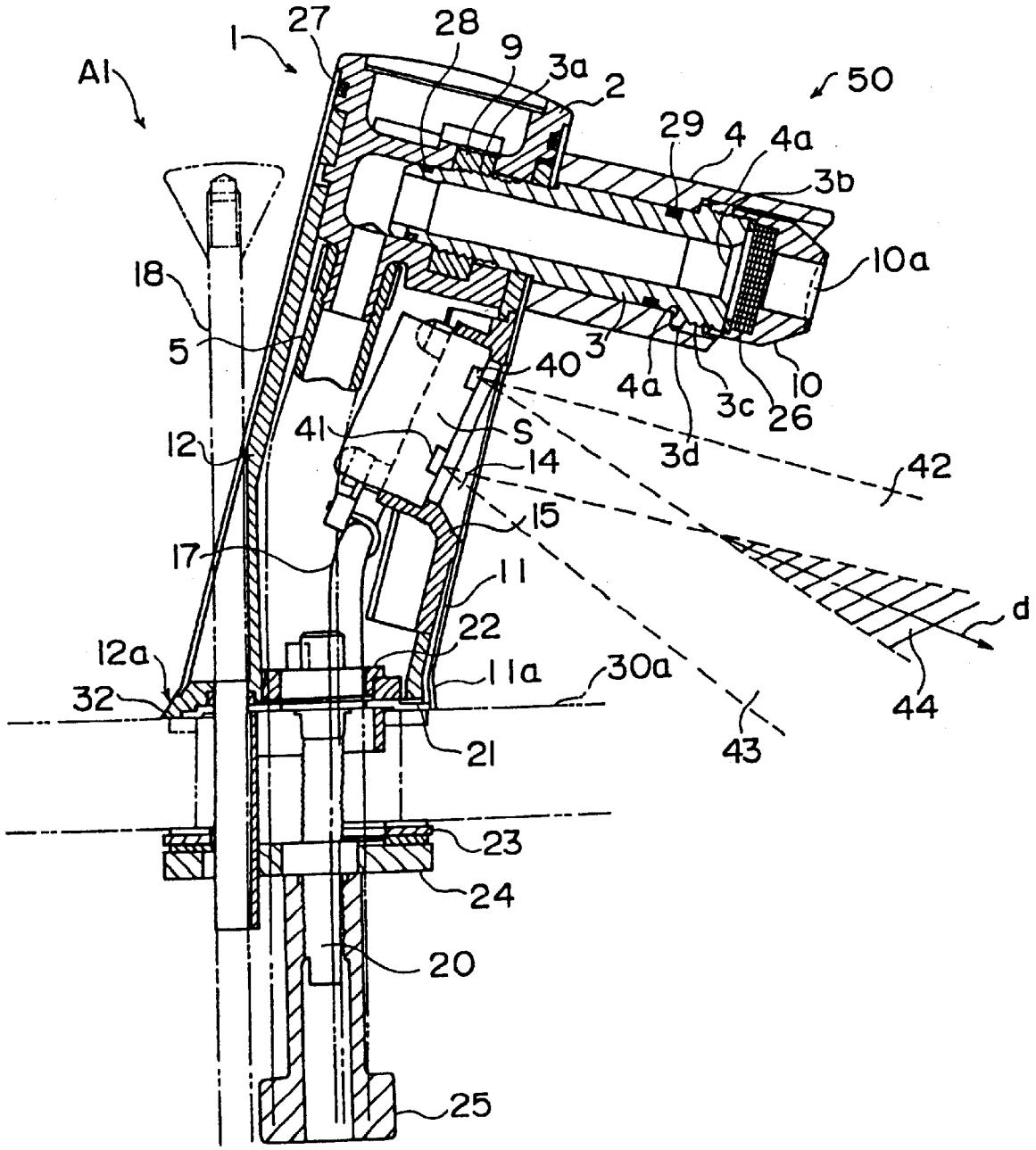
FIG. 3 is a side cross-sectional view showing the same faucet section of FIG. 1.
Figure 4:
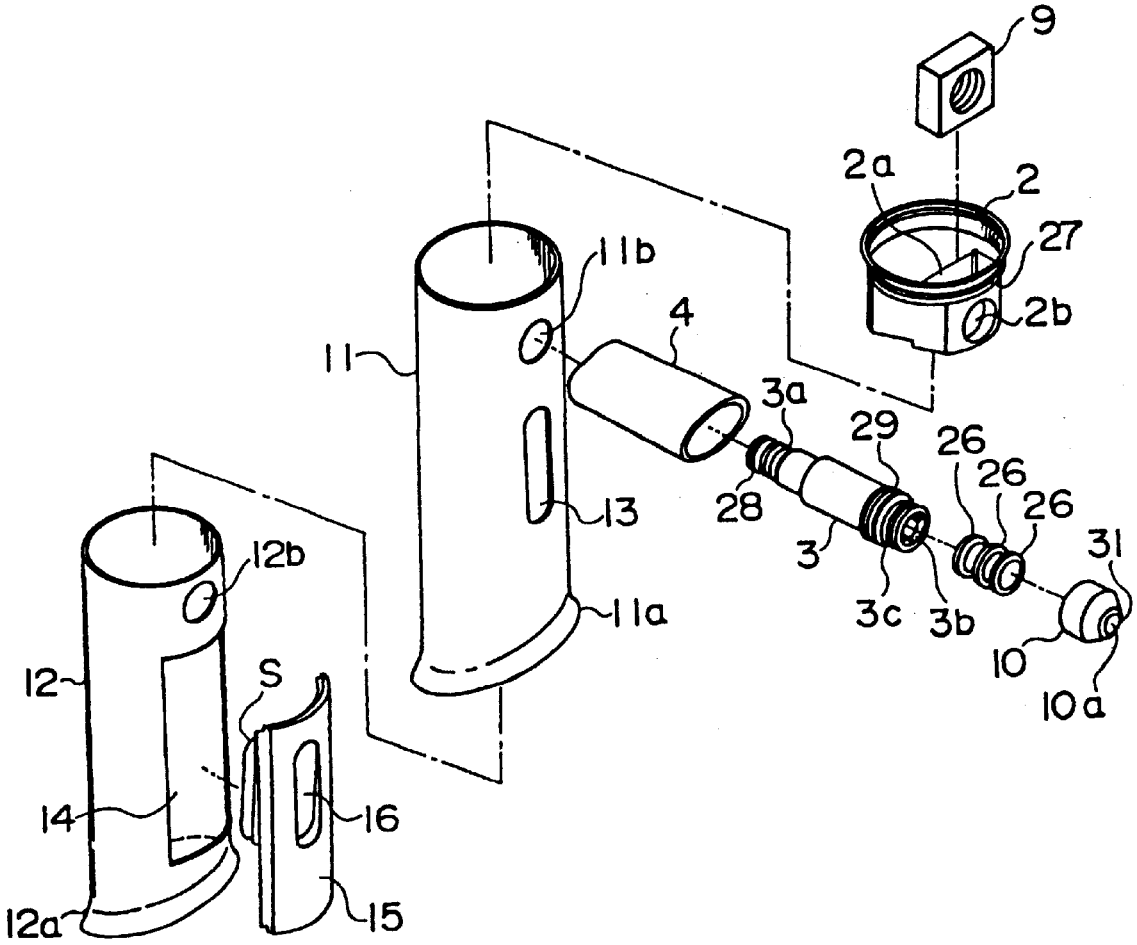
FIG. 4 is an exploded view showing the same faucet section of FIG. 3.
Figure 5:
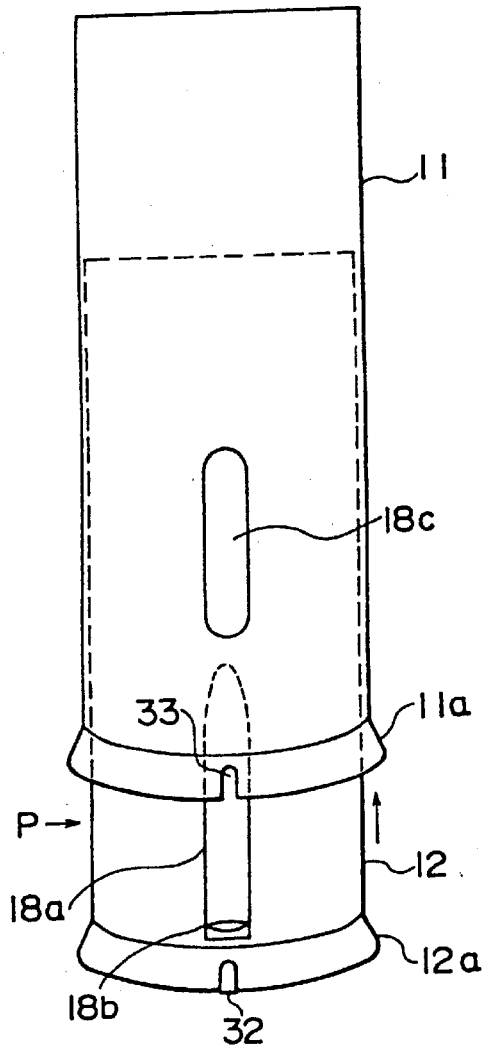
FIG. 5 is a rear side view showing the same faucet section of FIG. 3.
Figure 6:
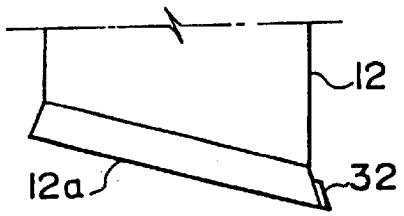
FIG. 6 is a view obtained when seen from the arrow P in FIG. 5.

The embodiments of the present invention will be described in detail hereinbelow on the basis of the attached drawings FIG. 1 is an illustration for assistance in explaining the automatic faucet related to the embodiment under the used conditions; FIG. 2 is a perspective view showing a faucet section of the same automatic faucet; FIG. 3 is a side crosssectional view showing the same faucet section; FIG. 4 is an exploded view showing the same faucet section; FIG. 5 is a rear view showing the same faucet section; and FIG. 6 is a view obtained when seen from an arrow P shown in FIG. 5.

Entire construction

The entire construction of the automatic faucet A will be described hereinbelow.

As shown in FIG. 1, the automatic faucet A of the present embodiment comprises a faucet section A1 having a faucet body 1 and a spout A2 attached to the faucet body 1 to discharge mixed hot and cold water, and an automatic faucet control box C connected to the faucet body 1 via a hot water supply tube 5.

Further, the faucet section A1 is mounted on a faucet mounting surface 30*a* formed at a rear horizontal surface of a washbowl 30 of a lavatory B, and the automatic faucet control box C is disposed under the lavatory B.

Further, in the automatic faucet control box C, there are arranged a mixing valve V, a control unit F for the automatic faucet A, a power supply unit E, etc.

As shown in FIGS. 2 to 4, the faucet body 1 is composed of a cylindrical outer pipe 11 and a cylindrical inner pipe 12 fitted into the outer pipe 11, Both the pipes 11 and 12 are formed roughly circular in cross section.

Further, the faucet body 1 is mounted being stood, by fixing the base end of the inner pipe 12 to the faucet mounting surface 30*a*.

Further, a nozzle mounting head 2 is fixedly housed in a head portion of the faucet body 1 Further, the nozzle pipe 3 formed with a water discharge opening 10*a* at the end thereof is attached to a circumferential wall of the nozzle mounting head 2 by passing through the inner and outer pipes 12 and 11, respectively so as to project in a direction perpendicular to the axial line of the faucet body 1.

Further, a hand sensor S is housed under the nozzle pipe 3, that is, under the water discharge opening 10*a* within the faucet body 1.

Further, a constant flow rate valve 6 is interposed between the mixing valve V and a hot water supply tube 5, so that water is not discharged from the automatic faucet A beyond a predetermined flow rate owing to the presence of the constant flow rate valve 6, irrespective of fluctuations of water pressure.

Further, the hot water supply tube 5 is formed flexible, so that it is possible to facilitate the arrangement work of the hot water supply tube 5 within the faucet body 1 and further to reduce the manufacturing cost thereof.

In the embodiment as described above, the hot water supply pipe 5 is formed of vinyl chloride. This hot water supply pipe 5 is passed through the inner pipe 12, and connected to the nozzle mounting head 2 for connection with the nozzle pipe 3.

Further, the mixing valve V is connected to one end of a hot water supply pipe 7 connected to a hot water supply source at the other end thereof and further to one end of a water supply pipe 8 connected to a water supply source at the other end thereof, respectively, so that it is possible to discharge mixed hot and cold water of an appropriate temperature from the automatic faucet A into the lavatory B.

The respective composing elements of the automatic faucet A as described above will be described separately in further detail hereinbelow.

Faucet body 1

As shown in FIGS. 2 to 4, the faucet body 1 is composed of the cylindrical outer pipe 11 and the cylindrical inner pipe 12 fitted into the outer pipe 12. The outer pipe 11 is formed of a metal, and the inner pipe 12 is formed of a synthetic resin, so that it is possible to reduce the manufacturing cost thereof without degrading the external appearance thereof.

The faucet body 1 is installed being stood on the faucet mounting surface 30*a* by fixing the base end of the inner pipe 12 onto the faucet mounting surface 30*a* in such a way as to be inclined frontward at a constant inclination angle $\alpha$ (e.g., 15 degrees), as shown in FIG. 7.

Further, the faucet body 1 is characterized in that the inner pipe 12 and the outer pipe 11 are both formed with a skirt portion 12*a* or 11*a* by expanding the lower portion thereof, respectively. These skirt portions 12*a* and 11*a* serve to improve the tightness between both the inner and outer pipes 12 and 11 and further to prevent both the pipes from being distorted when the nozzle pipe 3 is assembled to or disassembled from the faucet body 1.

Further, as shown in FIGS. 5 and 6, the inner pipe 12 is formed with a projection 32 at the rear side of the skirt portion 12*a* thereof, and the outer pipe 11 is formed with a cutout groove 33 at the shirt portion 11a thereof so as to be engaged with the projection 32.

Therefore, when the inner pipe 12 is fitted to the outer pipe 11, the projection 32 is engaged with the cutout groove 33 to prevent the outer pipe 11 from being rotated relative to the inner pipe 12.

Here, in the above description, although the projection 32 and the cutout groove 33 are formed in the inner pipe 12 and the outer pipe 11, respectively, it is also possible to form the projection and the cutout groove in the outer and inner pipes, respectively in opposite way.

Further, in FIG. 3, the reference numeral 18 denotes an operation rod of a pop-up drain cock (not shown). In FIG. 5, the reference numeral 18*a* denotes a groove portion for the operation rod; 18*b* denotes an insertion hole of the operation rod; and 18*c* denotes an outer hole of the operation rod, respectively.

Spout A2

Further, the nozzle mounting head 2 is fixedly housed in the head portion of the faucet body 1 Further, the nozzle pipe 3 for discharging mixed hot and cold water is attached to the circumferential wall of the nozzle mounting head 2 by passing through the inner and outer pipes 12 and 11, respectively so as to project in a direction perpendicular to the axial line of the faucet body 1.

That is, as shown in FIGS. 3 and 4, under the conditions that the inner pipe 12 is fitted to the outer pipe 11, the nozzle mounting head 2 is fitted to the upper side of the inner pipe 120 Further, a square-shaped nozzle fixing nut 9 is disposed at a nut accommodating portion 2*a* of the nozzle mounting head 2.

Further, the nozzle pipe 3 is fixed to the nozzle mounting head 2 perpendicularly by inserting the base portion 3*a* of the nozzle pipe 3 to the front side wall of the nozzle mounting head 2 through the front side wall of the faucet body 1 (e.g., inner pipe 12 and outer pipe 11) and further by engaging a base portion 3*a* of the nozzle pipe 3 with the nozzle fixing nut 9. The reference numeral 3*b* denotes a water discharge opening of the nozzle pipe 3; 3*c* denotes a male threaded portion engaged with a water discharge cap (described later); 27 denotes an O-ring interposed between the nozzle mounting head 2 and the inner pipe 12; and 28 denotes an O-ring interposed between the nozzle pipe 3 and the nozzle mounting head 2.

Further, a nozzle cover 4 for covering the outer circumference of the nozzle pipe 3 is supported being pinched between a flange portion 3*d* formed at the end circumferential surface of the nozzle pipe 3 and the outer pipe 11. Further, the reference numeral 4*a* denotes a stepped shoulder portion formed in the inner circumferential surface of the nozzle cover 4 so as to be engaged with the flange 3*d* of the nozzle pipe 3; and 29 denotes an O-ring interposed between the nozzle pipe 3 and the nozzle cover 4.

Further, a water discharge cap 10 formed with a water discharge opening 10*a* at an end thereof is threaded on the end portion of the nozzle pipe 3.

The water discharge opening 10*a* of the water discharge cap 10 is opened in the axial line direction of the nozzle pipe 3, so that the user can see the water discharge opening 10*a* clearly and thereby the usability of the automatic faucet A can be improved.

As shown in FIGS. 2, 3, and 4, the cover 4 is formed into a cylindrical shape, and the base end thereof is cut off into a circular arc shaped in such a way as to be fit to the curvature of the outer circumference of the outer pipe 12. In addition, at the end portion, the upper portion is so formed as to extends beyond the lower portion so as to cover the water discharge cap 10 from above for improvement of the external appearance.

In the construction as described above, mixed hot and cold water can be discharged in the axial line direction of the nozzle pipe 3 and along a parabolic locus.

Therefore, a relatively broad hand washing space can be obtained within the hand washing bowl. In addition, the user can receive sufficient water on his palms in a natural posture, with the result that it is possible to wash his hands comfortably by the minimum possible quantity of water without increasing the quantity of water to be consumed uselessly, thus producing a better water economizing effect.

In addition, in the present embodiment, the angle of the water discharge direction is determined downward from the horizontal plane by an angle $\alpha$ corresponding to the frontward inclination angle $\alpha$ (15 degrees) of the faucet body 1.

This angle value has been decided as the results of experiments for obtaining an optimum hand washing position in a sufficiently broad hand washing space within the washbowl 30. When the water discharge direction is determined as described above, the user can wash his hands comfortably by stretching his hands to a parabolic locus of the water discharged from the automatic faucet A.

Further, in FIGS. 3 and 4, the reference numeral 26 denotes a plurality of stacked flow straightener plates disposed in the water discharge cap 10; and 31 denotes a groove portion engaged with a fastening tool used when the water discharge cap 10 is screwed with the male threaded portion 3*c* of the nozzle pipe 3.

Further, in this embodiment, the water discharge cap 10 is formed into a conical shape, and the diameter D of the water discharge opening 10*a* provided at the end of the water discharge cap 10 is determined to be 1.2 times longer than that of the water path length of the cap 10. Therefore, water can be discharged in a rod shape, irrespective of the flow rate of the discharged water. Further, the above-mentioned diameter D of the water discharge opening 10*a* has been decided on the basis of the relationship with respect to the hand sensor S, which is described in further detail later.

In FIG. 4, the reference numeral 2*b* denotes a nozzle insertion hole formed in the nozzle mounting head 2; and 11*b* and 12*b* denote nozzle insertion holes formed in the outer pipe 11 and the inner pipe 12, respectively Here, the inner pipe 12 is fitted to the outer pipe 11 in such a way that the centers of the respective nozzle insertion holes 11*b* and 12*b* match the axial line of the water discharge nozzle 3, and after that the nozzle mounting head 2 is attached to the upper side of the inner pipe 12.

Hand sensor S

As shown in FIG. 2, the hand sensor S is housed and mounted under the nozzle pipe 3 and at roughly the middle of and within the faucet body 1. The hand sensor S is composed of a photoelectric sensor 41 and a light (infrared) emitter 40 arranged in the vertical direction a predetermined distance (e.g., 15 mm) away from each other. As shown in FIG. 3, the light emitter 40 and the photoelectric sensor 41 are provided with a light emission region 42 and a light reception region 43 determined roughly in parallel to each other, so that it is possible to detect an object existing in a region 44 in which the light emission region 42 and the light reception region 43 are overlapped with each other. This overlapped region 44 is referred to as a detection region hereinafter. This detection region 44 is so adjusted as to intersect the discharged water stream, irrespective of the flow rate of water discharged.

On the other hand, as shown in FIGS. 3 and 4, the outer pipe 11 of the faucet body 1 is formed with a sensor window 13 at the front side portion thereof, and the inner pipe 12 is formed a sensor mounting hole 14 at such a position as to correspond to the sensor window 13 of the outer pipe 11. Further, the a sensor mounting lid 15 is attached to the sensor mounting hole 14.

Further, the hand sensor S is disposed inside the lid 15 in such a way that the hand sensor S can be assembled and disassembled easily to improve the assembly productivity.

Further, in FIG. 3, the reference numeral 17 denotes a conductive wire cable for connecting the hand sensor S to the control unit F housed in the automatic faucet control box C. Further, in FIG. 4, the reference numeral 16 denotes a sensing hole formed in the sensor mounting lid 15 which is located at such a position as to correspond to the sensor window 13.

Figure 7B:
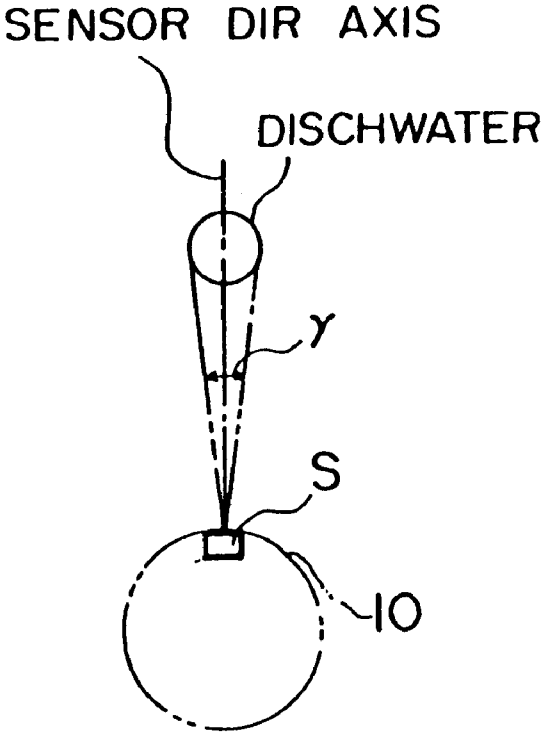
FIGS. 7A and 7B are illustrations for assistance in explaining the mounting status of the hand sensor.
Figure 7A:
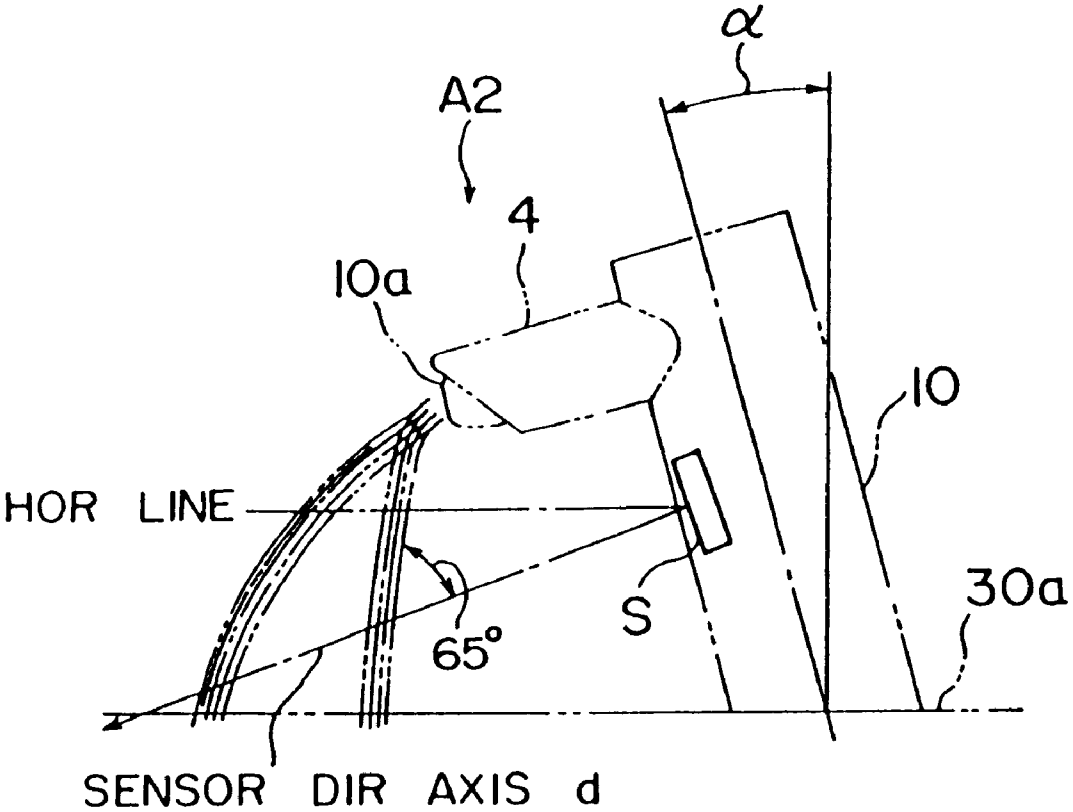

Further, as shown in FIGS. 7A and 7B the hand sensor S is directed slightly downward from the horizontal direction in such a way that an angle θ between the axis d of the detection region 44 and the axis of discharged water can be always kept less than 65 degrees, irrespective of the flow rate of the discharged water. In other words, even if the amount of water flow decreases before water is stopped and therefore the water discharge angle approaches the vertical direction, the above-mentioned angle θ will not exceeds 65 degrees.

This angle range is determined to prevent the hand sensor S from receiving a strong reflection light from the discharged water excessively For this purpose, the fact that the angle θ must be $0<\theta\leqq 70$ degrees has been already obtained empirically. In addition, the detection region 44 is located at such a position that the human can move his hands most easily and further can easily keep his hands stretched under the discharge water, under due to consideration of the sizes of the general washbowl B and the mounting positions of the automatic faucet A.

As described above, since the angle between the direction axis d of the detection region 44 and the axis of the discharged water is determined less than 70 degrees, it is possible to prevent the sensor from receiving excessive light reflected from the discharged water. In addition, it is possible to easily match the detection region 44 with the hand position and thereby to easily discriminate the movement of the hands in the hand washing space, while preventing an erroneous operation of the hand sensor S such that the discharged water is detected erroneously.

Here, the relationship between the above-mentioned hand sensor S and the diameter D of the water discharge opening 10*a* of the water discharge cap 10, the water path length of the water discharge cap 10 will be described hereinbelow.

Therefore, in order that the hand sensor S can discriminate the hand and the discharged water sharply, it is necessary to keep the state of the discharged water as stable as possible; that is, it is preferable to discharge the water stably in such a way as to form a stable rod shape at all times.

From the standpoint as described above, the water discharge state has been checked empirically by gradually changing the diameter D of the water discharge opening 10*a*, and the water path length of the water discharge cap 10 The experiments indicate that water can be discharged in the most stable rod shape when the ratio r of the diameter D to the water path length is determined less than 1.2.

With reference to empirical data shown in FIGS. 8 to 10, the relationship among the hand sensor S, the washbowl B, and the ratio r of the diameter D to the water path length will be described in detail hereinbelow.

Figure 8:
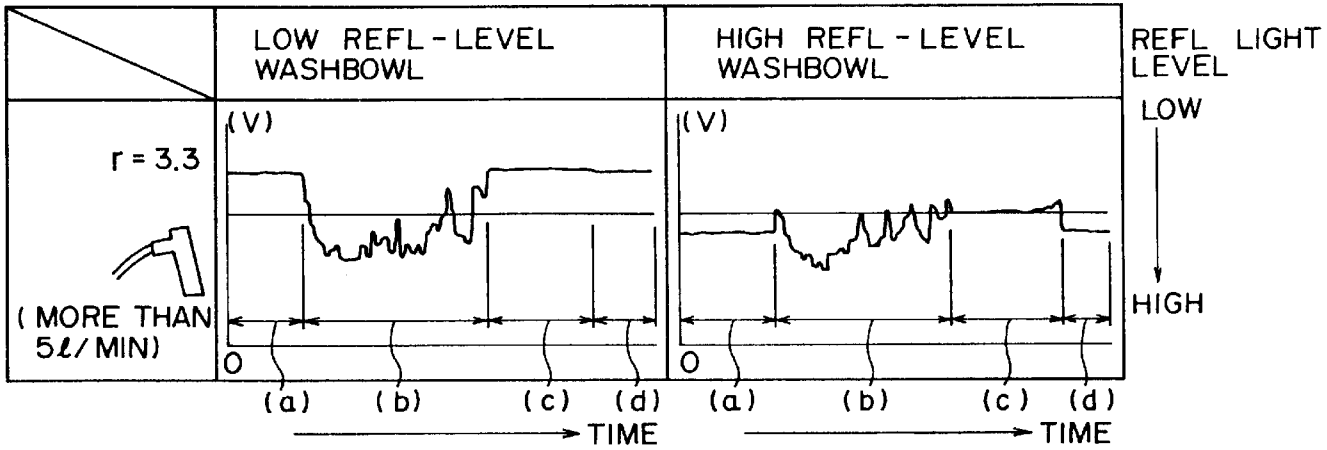
FIG. 8 is an illustration for assistance in explaining the relationship between the hand sensor and the diameter of the water discharge opening.
Figure 9:
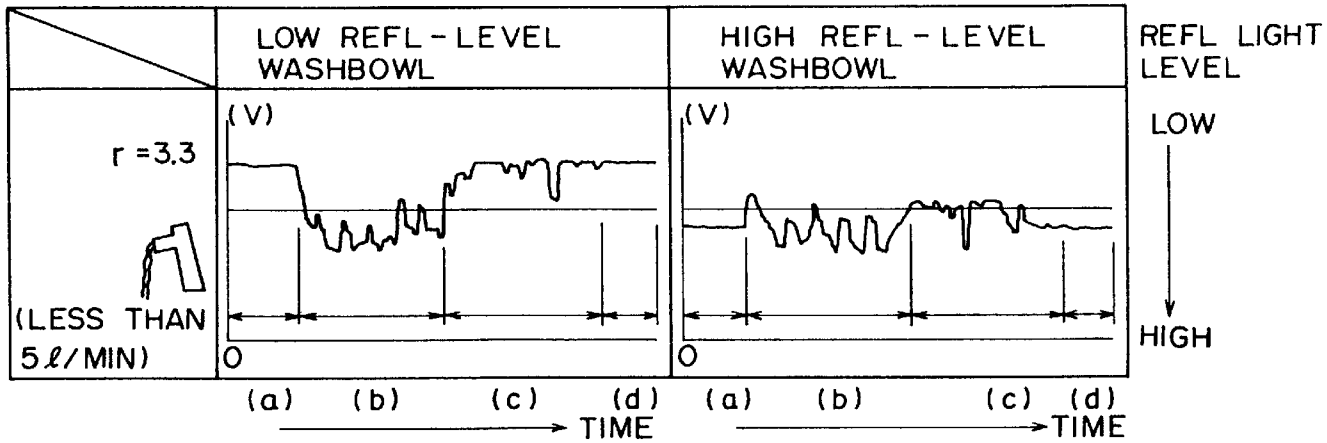
FIG. 9 is an illustration for assistance in explaining the relationship between the hand sensor and the diameter of the water discharge opening.

FIG. 8 and show the reflection levels of two different chinaware (washbowls B) at the ordinary water discharge flow rate (more than 5 liter/min), and FIG. 9 shows the reflection levels of the same two different chinaware (washbowls B) at a reduced water discharge flow rate (less than 5 liter/min). In both FIGS. 8 and 9, the above-mentioned ratio r is 3.3 and the changes in the respective reflected light (from discharged water, hands, and washbowls) received by the hand sensor S were transduced into electric signals, respectively. Further, in FIGS. 8 to 10, the change of the reflected light is represented by the waveform of the output voltage (V) of the photoelectric sensor 41. Further, in these drawings, the reflected light level increases with decreasing output voltage (V).

Further, in these drawings, the range (a) corresponds to the state where only the chinaware (washbowl B) is being detected; (b) corresponds to the state where hands are stretched and thereby the stretched hands are being washed by discharged water; (c) corresponds to the state where the hands are moved away from the chinaware and only the discharged water is being detected; and (d) corresponds to the state where the discharged water is stopped and only the chinaware is being detected.

As shown in FIG. 8, in the case of the ordinary water discharge more than 5 liter/min, the shape of the discharged water was of rod shape. Further, in the case of the low reflection level chinaware (on the left side), the reflection level fluctuates violently in the range (b) where the hands are being washed, which can be well distinguished clearly from the other ranges (a and c) where only the chinaware or only the chinaware and discharged water are being detected, so that it is possible to consider that the hand sensor S can be operated under good conditions.

Further, in the case of the high reflection level chinaware (on the right side), the reflection level fluctuates violently in the range (b) where the hands are being washed, which can be distinguished from the other ranges (a and c). However, the reflection level fluctuates between the range (c) where only the water is discharged and the range (d) where the water is stopped and only the chinaware is being detected. This indicates that even after the hands are moved away from the chinaware, there exists a possibility that the hand sensor S detects the discharged water as the hands erroneously.

On the other hand, as shown in FIG. 9, when the flow rate of the discharged water was reduced less than 5 liter/min, the shape of the discharged water was deformed from a rod shape to a twisted rod shapes Further, in the case of low reflection level chinaware (on the left side), the reflection level fluctuates to some extent even in the range (c) where the hands are moved away and only the chinaware or only the chinaware and discharged water are being detected.

Further, in the case of the high reflection level chinaware (on the right side), the reflection level also fluctuates violently in the range (c), so that there exists such a possibility that the sensor S detects the discharged water as hands erroneously.

Figure 10:
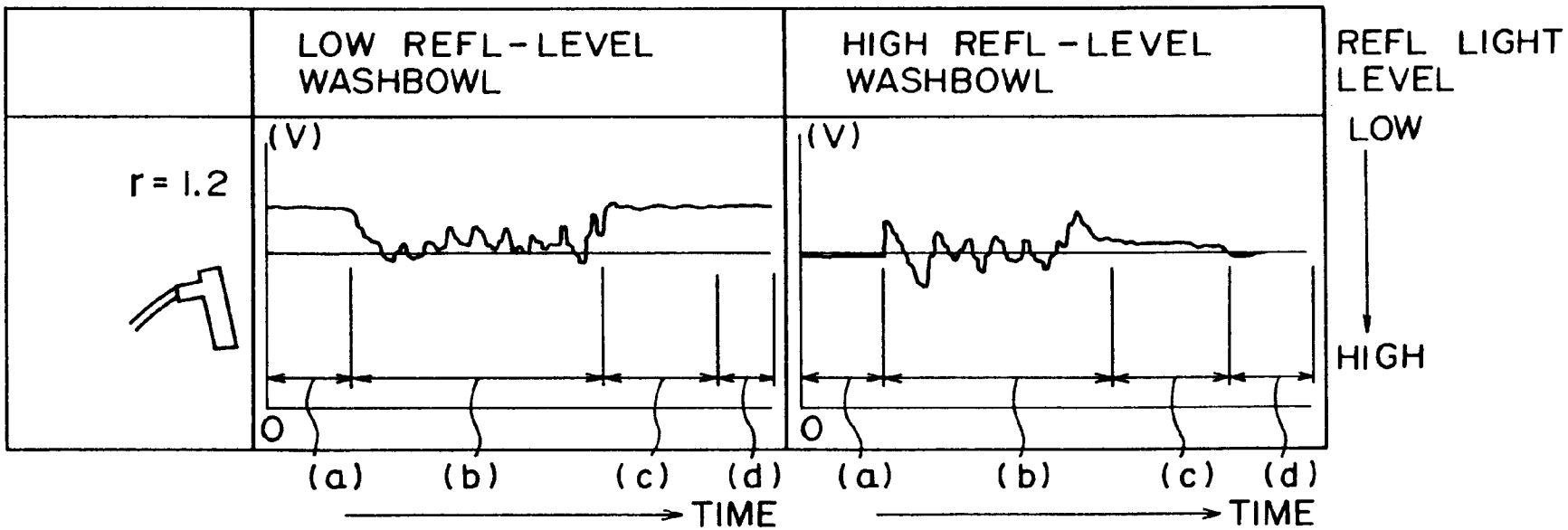
FIG. 10 is an illustration for assistance in explaining the relationship between the hand sensor and the diameter of the water discharge opening.

In contrast with this, as shown in FIG. 10, when the above-mentioned ratio r is determined to be 1.2, the shape of the discharged water can be kept in a rod shape all over the flow rates of the discharged water. Therefore, irrespective of whether the reflection level of the chinaware is low or high, the reflection level fluctuates violently only when hands are being washed in the range (b). Further, the reflection level does not only fluctuate but also can be kept almost at the same level when only the chinaware is being detected in the range (a), when only discharged water is being detected in the range (c), and when water discharge is stopped and only the chinaware is being detected in the range (d).

Therefore, in the case where the ratio r is determined 1.2, the hand sensor S can discriminate the hand securely, with the result that it is possible to prevent the automatic faucet A form being operated erroneously.

As described above, even when water is being discharged sufficiently or almost stopped from discharging, since the discharged water can be kept in a stable rod shape, it is possible to reduce the change of quantity of light reflected from discharged water and received by the hand sensor S as small as possible.

Therefore, it is possible to prevent mixed hot and cold water from being kept discharged even after hands are moved away from the automatic faucet A or from being not discharged when hands are stretched toward the automatic faucet A.

Here, the mounting structure of the faucet body 1 on the faucet mounting surface 30*a* will be described hereinbelow.

As shown in FIG. 3, when the faucet body 1 is mounted on the faucet mounting surface 30*a*, the faucet mounting washer 21 is fitted and fixed to the base end of the inner pipe 12; an inner pipe engage body 22 is disposed on the upper side of the mounting washer 21; and a mounting bolt 20 screwed with the engage body 22 and the faucet mounting washer 21 is inserted extending beyond the reverse side of the faucet mounting surface 30*a*.

Further, the a fastening washer plate 24 is brought into contact with the reverse side of the faucet mounting surface 30*a* via a washer 23; the mounting bolt 20 is passed through the washer plate 24; and further a fastening nut 25 is screwed with the mounting bolt 20.

Under these construction, when the fastening nut 25 is fastened, it is possible to fix the inner pipe 12 onto the faucet mounting surface 30*a* strongly between the inner pipe engage body 22 and the fastening washer plate 24.

In the above-mentioned embodiment, therefore, it is possible to obtain the following advantages:

(1) Under the water discharge opening, there is mounted the hand sensor for discriminating the hands, the discharged water and the chinaware from each other on the basis of change in quantity of received light in such a way that the sensing direction of the hand sensor lies more than a constant bias angle both upward and downward from the horizontal plane when seen from the side and additionally less than a constant included angle of the discharged water in the right and left direction of the central axis of the discharged water when seen from above. Therefore, it is possible to securely detect the hands stretched into the washbowl for hand washing.

Further, when water is being discharged, since the hand sensor does not receive an excessive light reflected from the discharged water, the sensor operation is allowed to be secure.

Further, since the hand sensor is positioned under the water discharge opening, it is unnecessary to stretch hands deep into the lavatory or washbowl for hand washing; that is, it is possible to wash hands comfortably in a broad hand washing space in the washbowl. In other words, since hands can be washed comfortably, without discharging water uselessly, there exists an effect of economizing water.

(2) Since the diameter of the water discharge opening is determined to be 1.2 times larger than the water path length, irrespective of the flow rate of the discharged water, it is possible to maintain a rod-shaped discharged water and further to reduce the change of light reflected from the discharged water and received by the hand sensor as small as possible Accordingly, it is possible to maintain a rod-shaped discharged water, irrespective of whether the water is being discharged sufficiently or being just stopped, without changing the shape of discharged water, with the result that it is possible to prevent erroneous operation of the hand sensor.

Therefore, it is possible to prevent such trouble that mixed hot and cold water is kept discharged even after hands are moved away from the automatic faucet or not discharged even when hands are stretched toward the automatic faucet.

Here, the method of processing the signals of the hand sensor S to correctly discriminate the hands from the discharged water or the chinaware will be described hereinbelow.

As one of the prior art technique, for instance, Japanese Published Examined Patent Application No. 62-45503 discloses the method of eliminating the disturbance due to water stream by setting a phase difference (which corresponds to the time necessary when an ultrasonic wave goes and returns between the sensor and an object) between the transmitted ultrasonic clock and the received ultrasonic clock, to limit the object detectable distance range, that is, to exclude the water stream and the bowl bottom surface from the detectable distance range.

Further, in Japanese Published Unexamined Patent Application No. 61-500232, the above-mentioned disturbance is eliminated by measuring the distance between the sensor and an object to be detected (on the basis of the time required for the ultrasonic wave to go and return between the sensor and the object) to limit the detectable distance range.

Further, in Japanese Published Unexamined Utility Model Application No. 63-199080, the above-mentioned disturbance is eliminated by detecting the movement of an object within the limited detectable distance range on the basis of time required for the ultrasonic wave to go and return between the sensor and an object to be detected.

In the above-mentioned three methods of limiting the detection distance range, since sufficient countermeasures must be taken against disturbance, there exist such drawbacks that the circuit construction for detecting the distance is complicated in the object detecting unit and thereby the manufacturing cost thereof increases.

Further, in Japanese Published Unexamined Utility Model Application No. 63-133673, the above-mentioned disturbance is eliminated by detecting the movement of an object to be detected on the basis of the differential value of the reflection level from the object.

In this method, however, when an object moves slowly, it is rather difficult to sense the presence of an object. In addition, there exists another problem in that this object detecting unit tends to be activated erroneously due to spike noise, for instance.

Further, in Japanese Published Unexamined Utility Model Application No. 4-26270, the movement of an object is detected by delaying a part of the received reflection signal and by comparing the delayed reflection signal with another non-delayed reflection signal. In this case, however, since no countermeasures are taken against erroneous operation due to disturbance, there exists a problem in that the operation of object detection is unstable.

Further, in the above-mentioned prior art, the presence or absence of an object (a human body) is detected by detecting a local feature of time-series pattern of the reflection level. However, when accidental level fluctuations are superposed upon the local feature of the time-series pattern of the reflection level, there exists a possibility that the faucet is operated in spite of the absence of an object (hands).

In order to solve the problems involved in the prior art technique, the present embodiment comprises a storage section for storing signal values of the hand sensor S by a predetermined times; and an arithmetic section for statistically calculating the signal values stored in the storage section, to discriminate the presence or absence of an object on the basis of the calculated statistic value.

Further, the above-mentioned statistic value is a variance value, an average value, a standard deviation value or a combination with the variance value and an average value.

Figure 11:
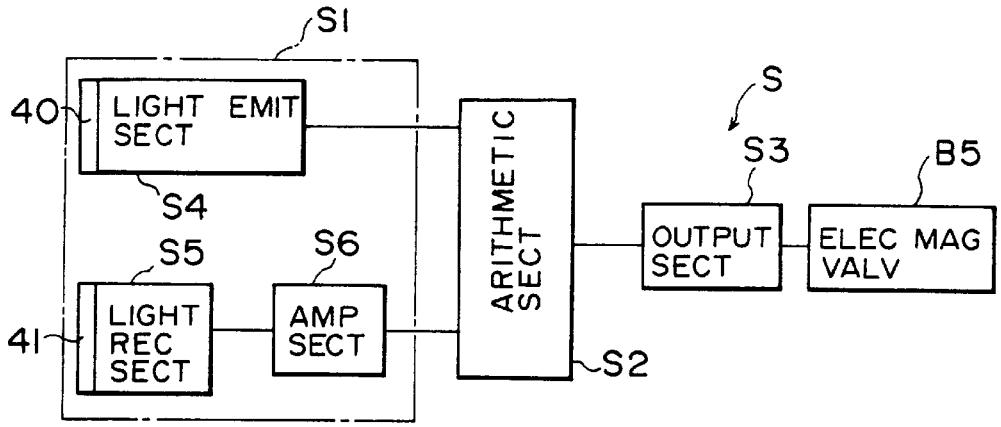
FIG. 11 is a schematic block diagram showing the hand sensor.

As shown in FIG. 11, the object detecting unit S is composed of an optical sensor of reflection non-contact active sensor type, an arithmetic section S2 and an output section The optical sensor S1 is made up of a light emitting section S4, a light receiving section S5, and an amplifier section S6. The light emitting section S4 activates the light emitter 40 to emit light at a predetermined period. The light receiving section S5 outputs the voltage signals transmitted from the photoelectric sensor 41 to the amplifier section S6.

The arithmetic section S2 is a microcomputer provided with an A/D converting function and a storing section. The sampling frequency of the A/D conversion can be controlled by a program. The arithmetic section S2 converts the analog signals inputted by the amplifier section S6 at the sampling frequency into digital data in synchronism with the light emitted by the light emitting section S4, and then stores the digital data in the storage section thereof in time series fashion. Further, the arithmetic section S2 calculates the stored data statistically, and outputs a valve open-close signal to the output section S3 on the basis of the calculated statistical results.

The output section S3 converts the signals transmitted by the arithmetic section S2 into a valve drive power signal and then outputs the converted valve drive power signal to the electromagnetic valve B5.

Prior to the description of the statistical calculations. the principle patterns of the reflected light levels under various conditions will be explained hereinbelow with reference to FIG. 12. Here, it should be noted that the coordinate (ordinate) axis of the reflected light level shown in FIG. 12 is opposite to that of the reflected light level shown in FIGS. 8 to 10 (in FIG. 12, the reflected light level increases in the upward direction).

Figure 12:
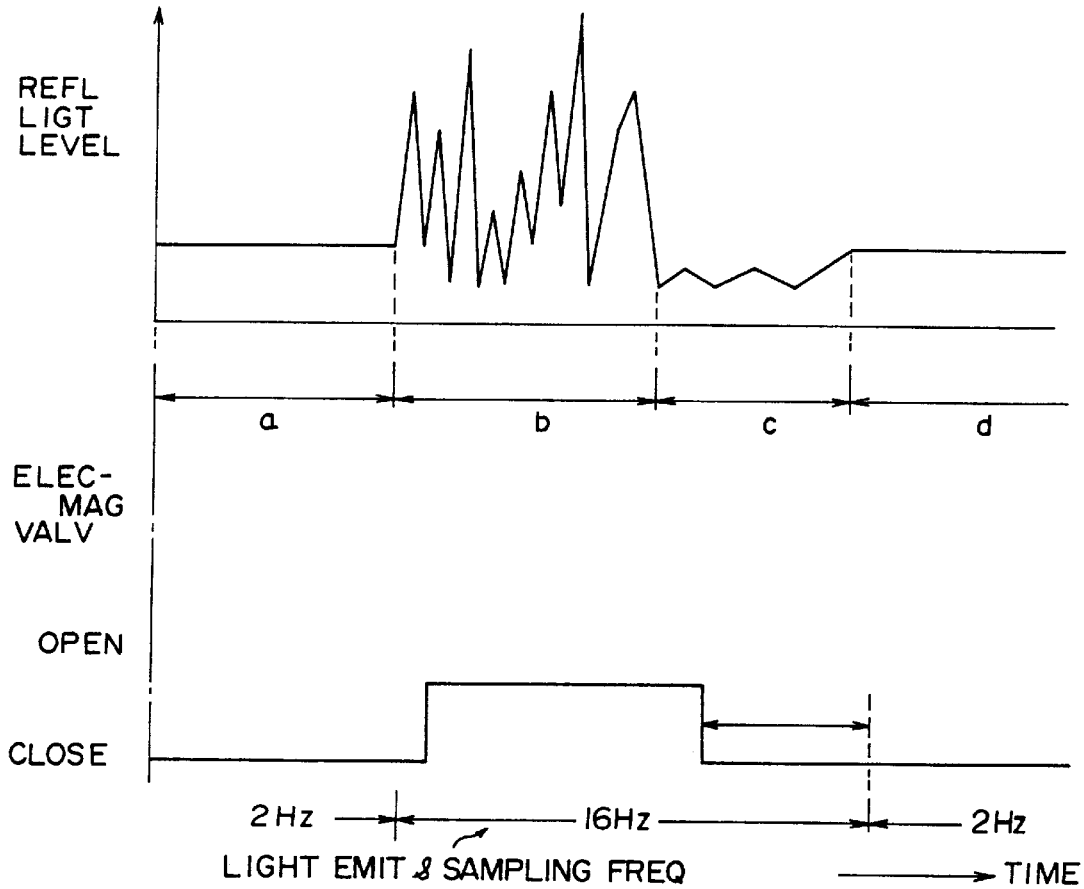
FIG. 12 is a graphical representation showing the relationship between the patterns of reflected light incident upon the light receiving section and the open and close operation of the electromagnetic valve, the light emission, the sampling frequency.

In standby status, that is, in the case where water is not discharged from the spout A2 and further there exists no object under the spout A2, as shown by a range (a) in FIG. 12, since light reflected from the surface of the bowl is allowed to be incident upon the light receiving section S5, the fluctuations of the reflected light level are extremely small.

In the case where hands are being washed by the water discharged from the spout A2, as shown by a range (b) in FIG. 12, the reflected light level fluctuates violently due to the movement of the hands and the scattered water.

In the case where there exists no hand under the spout A2 and only the water is being discharged, since the light reflected from the inner bottom surface of the bowl B1 is absorbed by the discharged water, as shown by a range (c) in FIG. 12 although the reflected light level decreases, the reflected light level fluctuates considerably, due to the motion of the discharged water B4, which is an intermediate value between when the hands are being washed and when not being washed.

On the basis of the patterns of the reflected light levels, it is possible to discriminate whether there exists hands under the spout A2 or not.

However, the above-mentioned patterns are shown only on general principles In practice, however, since the reflected light level fluctuates accidentally due to disturbance or noise, even if the local feature of the pattern is simply detected and discriminated (as when the reflected light level is simply compared with the set value or when the differential values of the reflected light level fluctuations are compared with the set value), it is difficult to accurately detect the respective patterns, so that the fact is that the erroneous operation rate of the object detecting unit is high.

Therefore, in the present embodiment, the presence or absence of an object (hands) within the detection region by statistically processing the reflected light levels inputted in time series and by comparing the moving average value of the reflected light level with the set value or the variance value with the set value. That is, it is possible to eliminate the influence of accidental level fluctuations by executing the overall pattern recognition of the reflected light levels. In addition, it is possible to correct the change with the passage of time of the reflection factor of the inner bottom surface of the bowl and the deterioration of the sensor sensitivity, by updating the set value used for comparison with the averaged value on the basis of the average value obtained in the standby status, with the result that an object under the spout can be detected reliably.

In more detail, in the standby status, light is emitted by the light emitting section S4 of the optical sensor S1 at 2 Hz. The output voltages of the light receiving section S5 are sampled in synchronism with 2 Hz, A/D converted, and further stored in the storage section in time series fashion. Further, an averaged value and a variance value are both calculated on the basis of 8 data obtained by returning back from the latest data.

Further, in the case where the variance value is less than 1, at the time when a counter counts 30 sec (a time elapsed), the average value is stored in the storage section as a reference level (the level of light reflected from the bowl surface). After that, whenever the variance value is less than 1, the reference level stored in the storage section is updated. In the above-mentioned counting operation (for updating the reference level) is maintained only for 30 sec, and the time is not counted after 30 sec. Further during counting, if the variance value reaches 2 or more, the counter is reset.

As described above, in the standby status, since the data related to the reflection level of the light reflected from the bowl surface can be updated for each light emission, it is possible to correct the change in reflection factor at the surface of the bowl B1 or the deterioration of the optical sensor S1.

Further, in the standby status, when the difference between the average value and the reference value exceeds 4, the sampling frequency (the same as the light emission frequency) is changed to 16 Hz for preparation of enhancement of response characteristics to the object (hand) detection. However, when the light is emitted at 16 Hz by 16 times repeatedly without satisfying the first condition (described later), the frequency is returned to 2 Hz. Further, when the difference between the average value and the reference value exceeds 4 before the light is emitted 16 times, the counter starts to count the light emission 16 times again beginning from this time point.

The first condition implies that any one of the following conditions (1) and (2) is satisfied.

(1) Average value≧Reference level+8

(2) Variance value≧6 is repeated more than 4 times.

In the standby status at 16 Hz as described above, when the above-mentioned first condition is satisfied, the arithmetic section S2 discriminates that the hands are present under the spout A2, and the valve V is opened to discharge water from the spout A2.

As described above, after water has been discharged from the spout A2, when the following second condition is satisfied, the valve V is closed to stop discharging water. After the discharged water stop, when light is emitted at 16 Hz by 48 times repeatedly (after 3 sec has elapsed), the light emission and the sampling frequency (the light emission frequency) is returned to the original 2 Hz.

The second condition implies that both of the following conditions (1) and (2) are satisfied.

(1) Average value≦Reference level+4

(2) Variance value≦3 is repeated more than 4 times

Further, after water has been stropped from being discharged, before the light emission at 16 Hz and the sampling reach 48 times, if any one of the following third conditions is satisfied, water is discharged again.

The third condition implies that any one of the following conditions (1) and (2) is satisfied.

(1) Average value≧Reference level+8

(2) Variance value≧6 is repeated more than 10 times

As described above, since the third condition under which water is discharged again immediately after water has been stopped from being discharged is determined under more sever condition than the first condition, it is possible to prevent an erroneous operation due to disturbance immediately after water discharge has been stopped.

Further, in the above-mentioned embodiment, the sampling frequency or the light emission frequency in the standby status is determined to be as such a low frequency as 2 Hz for economization of power consumption However, when power saving is not required, it is also possible to increase the frequency in the standby status up to 16 Hz (the same as the frequency in the standby status) to improve the response characteristics. In this case, the program can be more simplified.

In contrast with this, where further power economization is required, it is also possible to set the sampling frequency to 2 Hz during not only the standby status but also during the water discharge. In this case of 2 Hz, however, only when the conditions of water discharge start, stop and restart are established, respectively, it is preferable to increase the sampling frequency (e.g., at about 7 msec period) temporarily in order to reconfirm the establishment of the condition quickly and to improve the response speed of the water discharge start, stop and restart.

Further, in this embodiment, although the average value and the variance value are both used in combination to discriminate the presence or absence of hands, it is possible to use a standard deviation value. Further, without using the variance value and the deviation value, it is also possible to discriminate hands on the basis of only the most updated reflection light level and the reference level (an average value in the standby status). Further, the variance value and the standard deviation value are both a statistical value well representative of the continuity of a status, respectively. Therefore, when these values are not used, it is preferable to execute an additional operation for confirming a continuity of the status. For instance, when the hand stretch is detected in the standby status or when the hand removal is detected during water discharge, the additional data are further sampled a few times (e.g., twice) to check whether the detected status is kept continued or not. Only when the continuity has been confirmed, the water discharge must be started or stopped. Further, in this case, it is preferable to execute the additional sampling at a sufficiently short period (e.g, 7 msec) in order to increase the response characteristics of the water discharge start or stop. Further, in the case where the variance value and the standard deviation value are not used, in the determination of the reference level, it is necessary to check whether the difference between the most updated data and the average value lies within a small range in order to confirm that the standby status is kept stable.

Or else, it is also possible to eliminate the occurrence of the erroneous operation by starting and stopping water discharge on the basis of both the comparison result between the most updated level and a reference level (a means value not including the most updated value) and the comparison result between the absolute value of the most updated level and a predetermined threshold value. In this case, as will be explained with reference to FIG. 17, in order to interrupt the repeated water discharge and water stop caused due to the fact that an erroneous value has been stored as the reference level, it is preferable to increase the above-mentioned threshold, after the water discharge counter has counted a predetermined value, as compared with that used before the water discharge counter counts up the predetermined value.

Figure 13:
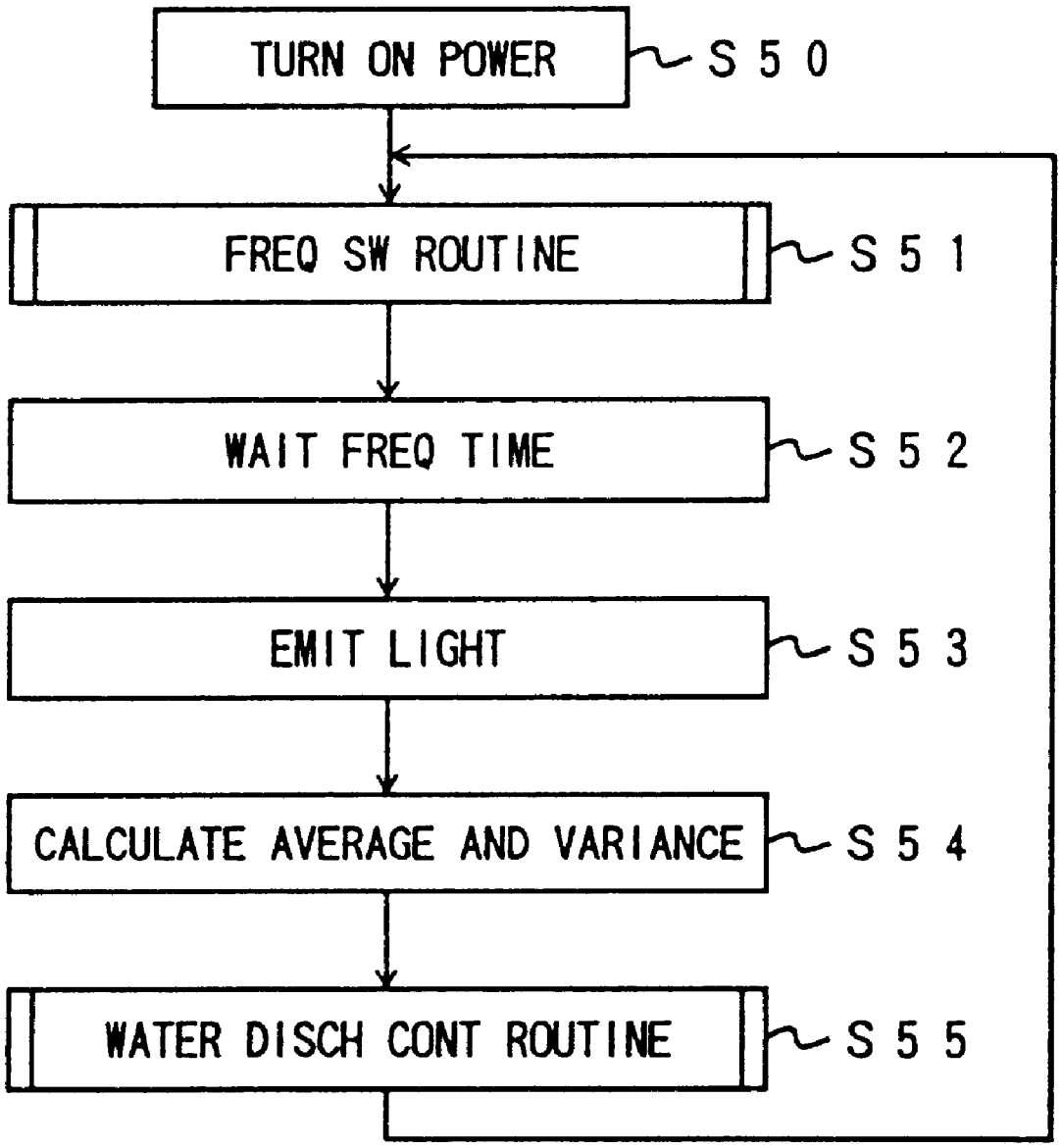
FIG. 13 is a flowchart showing the main routine for processing the signal of the hand sensor.

FIG. 13 shows a flowchart of a main routine for executing the above-mentioned procedure. In step (S50), when the power is turned on, control of the arithmetic section S2 starts to execute the main routine composed of steps from (S51) to (S55). When control circulates through this main routine, it is possible to actuate the automatic faucet, that is, to discharge-water from the spout.

In step (S51), the frequency for circulating through the main routine (described later with reference to FIG. 14 later) is decided. In step (S52), the time is adjusted (by waiting) so that control (by the arithmetic section S2) can circulate through the main routine at the frequency (16 or 2 Hz) determined in step (S51). Here, since the period is 62.5 msec at 16 Hz and 500 msec at 2 Hz and further the processing time required in steps (S51) and (S53) to (S55) is about several msec, respectively, almost all the time required to circulate through the main routine is used in this step (S52).

In step (S53), the sensor emits light, and the data are stored Further, in step (S54), the data are processed statistically (described later in further detail).

In step (S55), subroutines for controlling water discharge and water discharge stop are executed on the basis of the statistical date obtained in step (S53).

Figure 14:
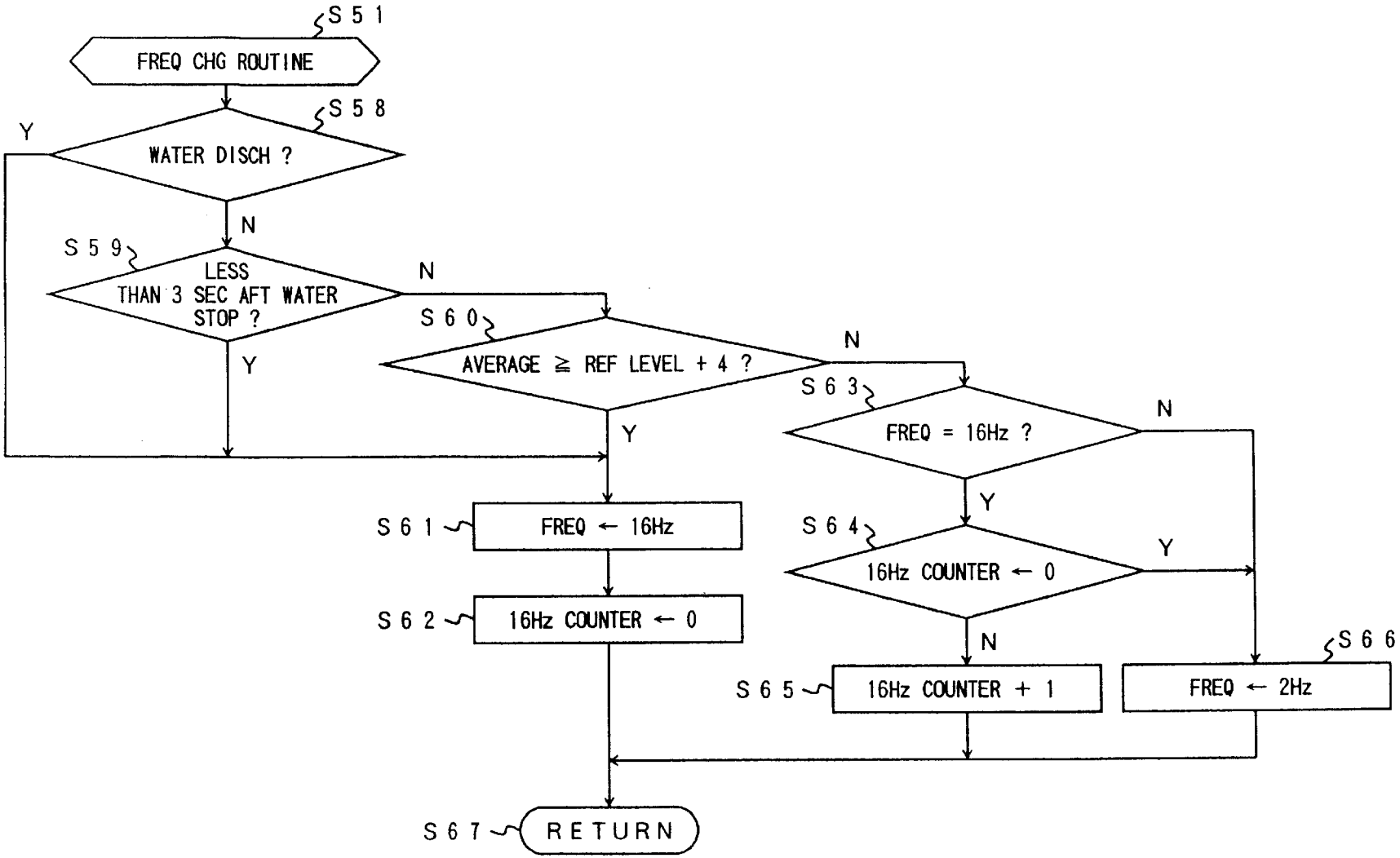
FIG. 14 is a flowchart showing a frequency switching subroutine.

FIG. 14 shows a subroutine (the detailed procedure of the step (S50) for switching the frequency. Control first checks whether water is now being discharged in step (S58) and then checks whether 3 sec is not elapsed after water has been stopped in step (S59). In either case, control proceeds to step (S61) to set the frequency to 16 Hz.

When the conditions as defined in steps (S58) and (S59) are not both satisfied, control proceeds to step (S60).

In step (S60), if the average value is equal to or more than an addition of the level of light reflected from the bowl surface) and 4, control proceeds to step (S61). If not, control proceeds to step (S63). In step (S61), the frequency circulating through the main routine is set to 16 Hz. In step (S62), the 16-Hz counter for counting the number of circulations at 16 Hz. is reset, and control ends in step (S67).

In step (S63), since the average value is approximate to the reference level, control checks whether the frequency is 16 Hz or not. If not 16 Hz; that is, if 2 Hz in step (S63), control confirms 2 Hz in step (S66) and ends the subroutine in step (S67).

If 16 Hz in step (S63), control checks whether the 16-Hz counter counts 16 or more in step (S64). If less than 16, control increments the 16-Hz counter in step (S65), and proceeds to step (S67).

In summary, control counts the number of times of light emission at 16 Hz in spite of the fact that the average signal value is less than (the reference level+4) whenever control circulates through the main routine.

In step (S64), when the 16-Hz counter counts 16, control proceeds to step (S66) to set the frequency to 2 Hz, and end the subroutine in step (S67).

Figure 15:
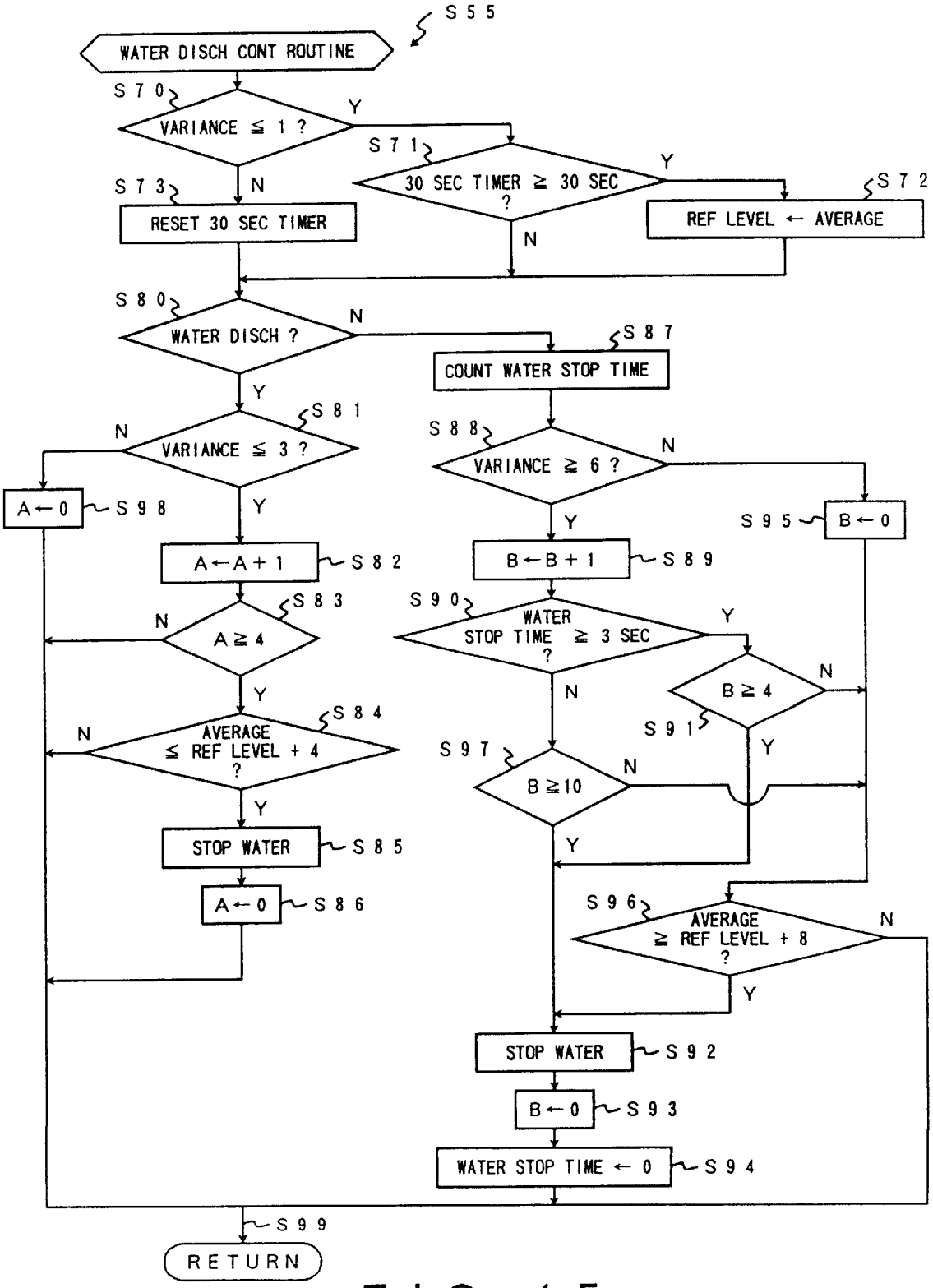
FIG. 15 is a flowchart showing a water discharge control subroutine.

FIG. 15 shows a water discharge control subroutine (S55). This subroutine is provided with a function for updating the reference level. That is, when the variance value is equal to or less than 1 in step (S70Y), a timer is activated. After 30 sec has been elapsed in step (S71Y), the reference level is updated in step (S72) and proceeds to step (S80) (described later). Further, if the timer is less than 30 sec in step (S71N), control proceeds to step (S80). Further, if the variance value is more than 1 in step (S70N), control sets the timer in step (S73) and proceeds to step (S80).

In step (S80), control discriminate the water discharge status from the spout A2. If water is being discharged in step (S80Y) and further the variance value is equal to or less than 3 in step (S81Y), control increments the first counter in step (S82). Further, when the first counter reaches 4 in step (S83Y) and further the average value is equal to or less than an addition of the reference level and 4 in step (S84Y), control outputs a valve close signal to the electromagnetic valve B5 in step (S85), resets the first counter in step (S86), and proceeds to the frequency switching subroutine (S99). Further, if the variance value is more than 3 in step (S81N), in step (S98) control resets the first counter. Or else, if the first counter value is less than 4 in step (S83N) or the average value is more than an addition of the reference level and 4 in step (S84n), control proceeds to step (S99).

Further, when the water is being stop in step (S80N), control starts measuring the water stop time period in step (S87). If the variance value is equal to or more than 6 in step (S88Y), control increments a second counter in step (S89). If the water stop time interval is more than 3 sec in step (S90Y) and further the second counter reaches 4 in step (S91Y), control outputs the valve open signal to the electromagnetic valve B5 in step (S92), resets the second counter in step (S93), and stops measuring the water discharge stop period in step (S94). Further, if the second counter value is less than 4 in step (S91N), control proceeds to step (S96). Further, if the variance value is less than 6 in step (S88N), control resets the second counter in step (S95). If the average value is equal to or more than the addition of the reference level and 8 in step (S96Y), control proceeds to step (S92). Further if the average value is less than the addition of the reference level and 8 in step (S96N), control returns to the main routine. Further, if the water discharge stop period is less than 3 sec in step (S90N) and further the second counter value is equal to or more than 10 in step (97Y), control proceeds to step (S92). If the second counter value is less than 10 in step (S97N), control proceeds to step (S96).

Further, the count value (A) of the step (S82) and the count value (B) of the step (S89) both for counting the variance value exceeding a predetermined value are determined as values for checking whether the variance value is kept for a predetermined time period or not. Therefore, it is possible to adjust the severeness of the conditions by changing these count values (the reference values).

Figure 16:
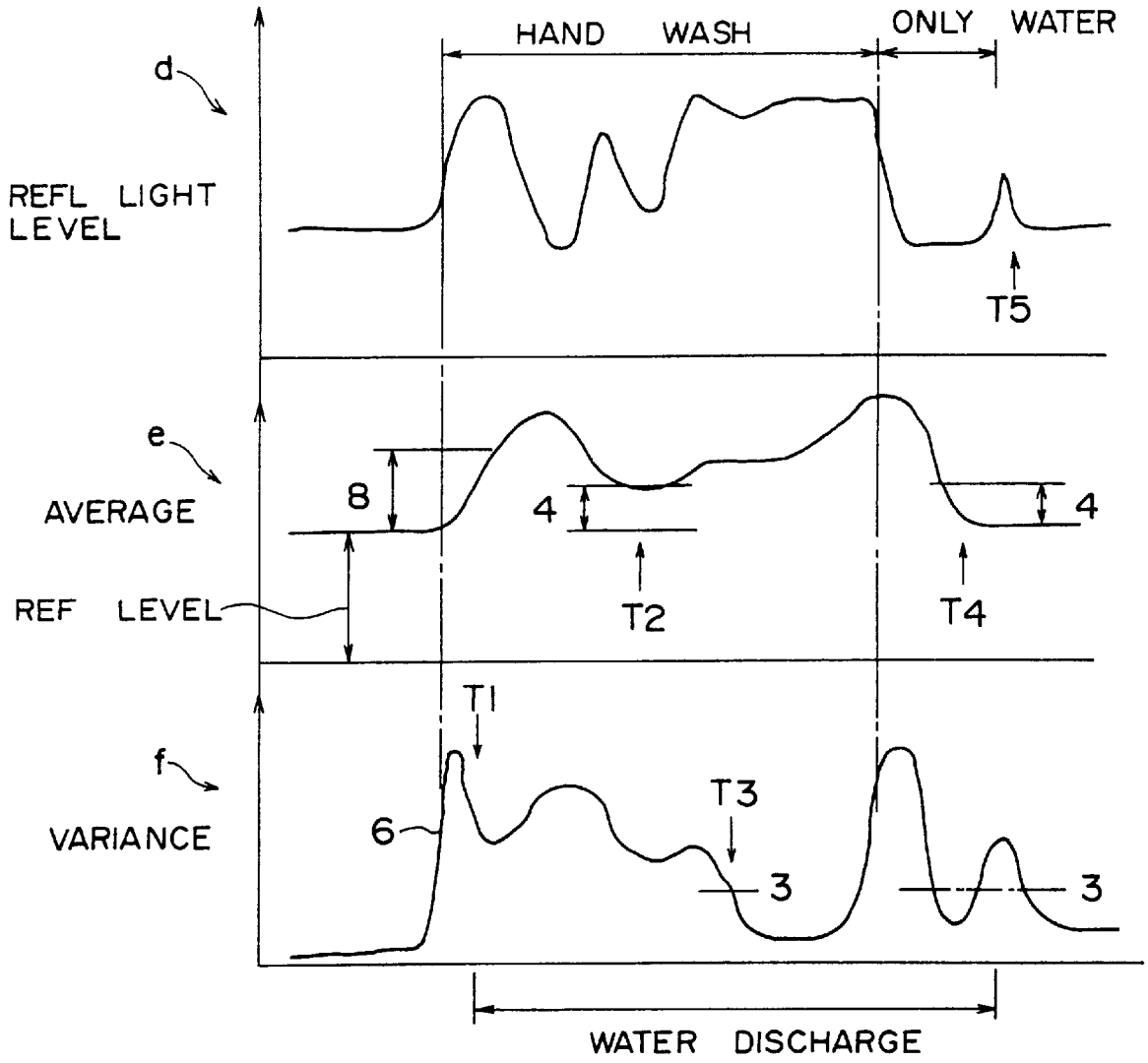
FIG. 16 is another graphical representation showing the examples of the reflected light levels, the averaged value and the variance value.

FIG. 16 shows the examples of the reflected light level d, the average value e thereof, and the variance value f thereof.

With reference to FIG. 16, when the above-mentioned first conditions have been satisfied with respect to the average value and the variance value at time T1, for instance, water is started to be discharged. In this case, although the average value e drops below the threshold level (reference+4) of the step (S84) shown in FIG. 15 at time T2, since the variance value is large, the water is not stopped from being discharged.

In contrast with this, even if the variance value becomes small at time T3, the water stop conditions cannot be established because the average value is large.

However, when the reflection signal level drops at time T4, since the change in reflection signal level is reduced and further the average and variance values are both reduced, the water discharge stop conditions can be established.

Further, after the electromagnetic valve B5 has been closed to stop water discharge, there exists a time delay to when the water discharge from the spout A2 can be completely stopped, due to the response characteristics of the electromagnetic valve B5. In addition, when water is stopped, since the stream of the discharged water is disturbed, there exists a possibility that a large reflection light signal is generated by the irregular reflection from the water, as shown at time T5 in FIG. 16.

However, since the reflected light as described above is generated momentarily, even if increasing temporarily, the variance value decreases immediately in general. As long as 3 sec has not elapsed after the water discharge stop in step (S90) of FIG. 15, as far as the number of times (at which the variance value is equal to or higher than 6) is continued more than 10 times in step (S97) of FIG. 15, since the water is not discharged again, it is possible to securely prevent water from being discharged again erroneously due to disturbance According to the above-mentioned control, the following effects can be obtained:

When the average value of the reflection light level is used, for instance, it is possible to eliminate the influence of a signal noise.

Further, when the variance value of the reflected light level is used in combination with the average value, it is possible to prevent the erroneous hand wash operation more securely. That is, the differential value is strongly responsive to a spike-like noise, and the differential value is not responsive to a slow motion such as hand washing. In contrast with this, since the variance value or standard deviation value is related to dispersion, there exists such an advantage as not to be susceptible to the difference in the movement speed. Therefore, the utilization of the variance or standard deviation value is effective in particular when the movement speed differs always according to the person, as when hands are washed.

In addition, since the variance or standard deviation values can be obtained stably as far as the movement continues, it is suitable to detect the movement of the hand washing on the basis of these values, because hand washing continues for a time.

Further, the processing of storing a great number of data many times and further classifying the changes of stored data into a plurality of patterns is very complicated operation. However, since the average and variance values can be obtained through a relatively simple calculations, it is possible to reduce the cost of development, inspection, and manufacture of the products.

Further, when an object is discriminated on the basis of change in patterns, a number of conditional branches are required for classification and combinations of data in the control subroutines. However, since the variance value represents changes in data quantitatively, the presence or absence of an object can be discriminated by only comparison between numerical values, with the result that it is possible to easily establish and adjust the discriminating conditions for the object detection.

Further, since the reference value (the reflection level of the bowl) is updated on the basis of the average and variance values, it is possible to eliminate the influence of change of the reflection factor of the bowl and the deterioration of the sensor both caused with the passage of time.

As described above, in the present invention, since the complicated signal patterns or the disturbance can be evaluated quantitatively through the statistical processing of the reflected light level, it is possible to accurately detect the presence or absence of an object, thus securely preventing an erroneous operation of the object detecting unit of the washing apparatus.

The above-mentioned control operation is executed under the ordinary conditions. That is, as shown in FIG. 15, the influence of the water discharge upon the sensor operation can be removed by changing the water discharge condition between that obtained immediately after the water discharge and that obtained other than this.

In the above-mentioned control, however, since the water discharge and stop are controlled on the basis of the reference level of the light reflected from the bowl surface during water discharge, in case a wrong reference value is stored, the erroneous operation may occur.

For instance, when the light receiving surface of the sensor portion is stained and thereby the sensor signal level is low, or when something (e.g., towel or duster) of low reflection factor is placed on the surface of the washbowl, a reference level smaller than the original bowl reflection level is to be stored as the reference level. Under these conditions, when the sensor surface is cleaned or when the duster is removed, the average value of the reflected light level increases. Therefore, when the average value increases, so that the water discharge condition is satisfied as explained in step (S96) in FIG. 5. Therefore, water is to be discharged in spite of the fact that no hands are stretched.

In the ordinary automatic faucet, a safety processing is usually executed to prevent water from being discharged permanently For instance, water is stopped after one minute at maximum has been elapsed, irrespective of the sensor signal. In this case, even if a wrong reference level is stored and thereby water is discharged erroneously, water can be stopped after a predetermined limit time has been elapsed. After that, when a correct reference level is stored again, it is possible to obtain the normal status.

However, these exists such a special case where the water discharge cannot be prevented by only the limitation of the water discharge time. For instance, when a duster is removed from the bowl as described above, since the reflection light level increases, water is discharged erroneously. After that, when the light reflected from the bowl is absorbed by the discharged water, the reflected light level decreases, so that the average value is reduced again below the average value. When the average value is reduced down to a value which satisfies the water discharge stop condition, water is then stopped. However, after that, since the reflected light level increases up to the bowl reflection level again, water is discharged again. The above-mentioned water discharge and water stop are repeated permanently.

Figure 17:
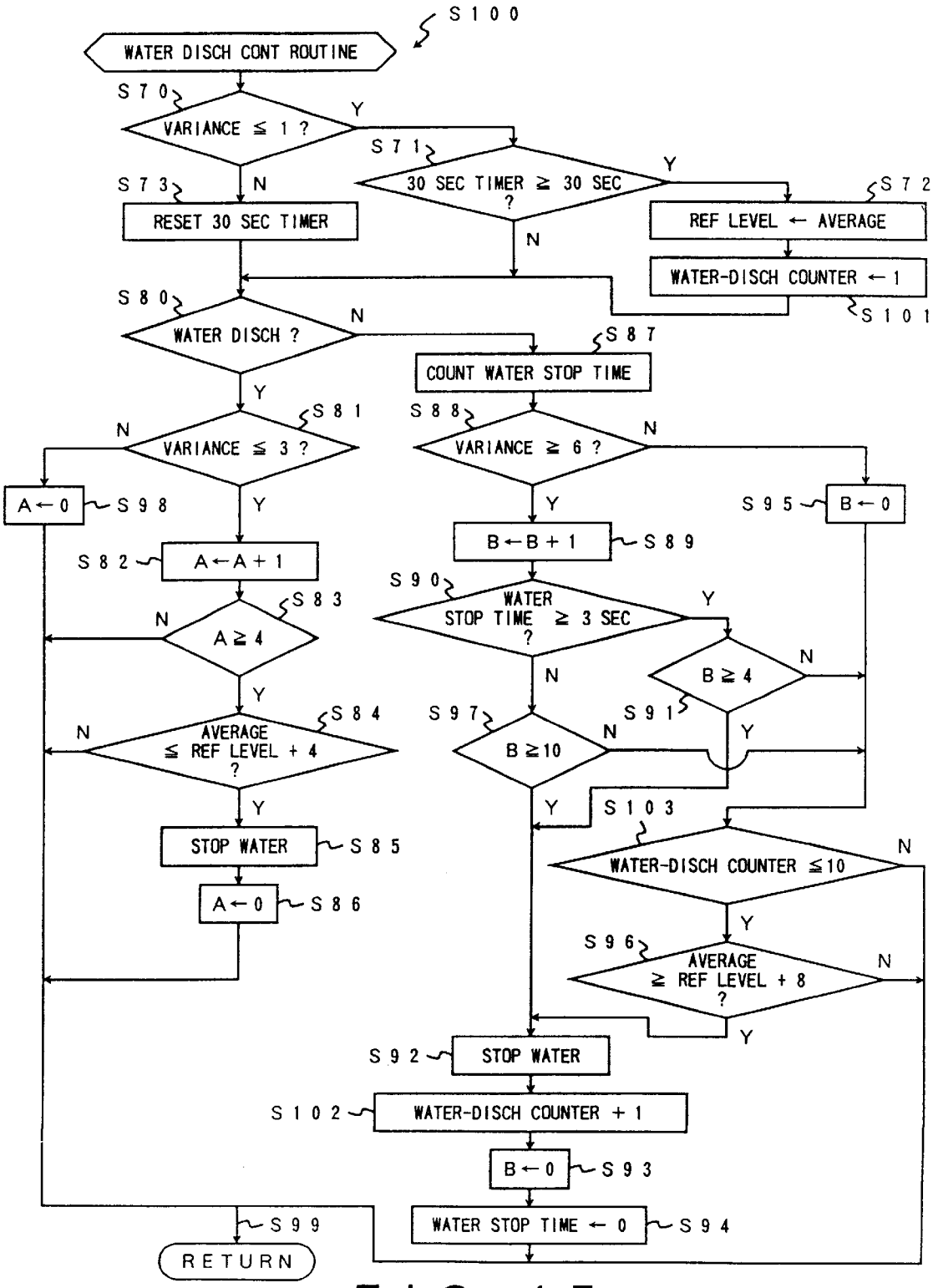
FIG. 17 is flowchart showing a discharged water control subroutine, which is added as a countermeasure against water discharge/stop repetition.

FIG. 17 shows a water discharge subroutine which can prevent the above-mentioned repeated water discharge operation. This subroutine is obtained by adding some additional procedure to the routine shown in FIG. 15. In FIG. 17, the same reference numerals have been retained for the similar steps as with the case of those shown in FIG. 15.

In FIG. 17, "discharge counter" operation for counting the number of times of water discharges is added to the procedure shown in FIG. 15. In step (S72), the "water discharge counter" is reset That is, when the status (S70Y) where the variance value is less than 1 is kept continued for 30 sec or longer (S71Y), the average value is stored as the reference level in step (S72). Here, since the step (S70Y) indicates that the water discharge/stop is not repeated, the water discharge counter is set to an initial value [1].

After that, when the water discharge condition is established, water is discharged in step (S92), and the counter is incremented by one in step (S101). The steps after the step (593) are the same as the routine shown in FIG. 15.

First, in the case where water is not being discharged in step (S80Y), the establishment of the water discharge is checked. When the water discharge condition related to the variance is not established in steps (S88N), (S91N) and (S97N), before the water discharge condition related to the average value is established or not in step (S96), the water discharge counter is checked whether the counted value is less than 10 or not (S103). When less than 10 in step (103Y), the water discharge condition related to the average value is checked in step (S96) in the same way as with the case of FIG. 15. When more than 10 in step (S103N), the water discharge check related to average value is not executed.

Consequently, even if the erroneous operation such that the water discharge/stop is repeated due to an error caused by the average value, whenever the number of times of the repetitions of the water discharge/stop reaches 10 times, since the water discharge based upon the average value condition is inhibited, it is possible to prevent the erroneous operation due to average value error.

Figure 18:
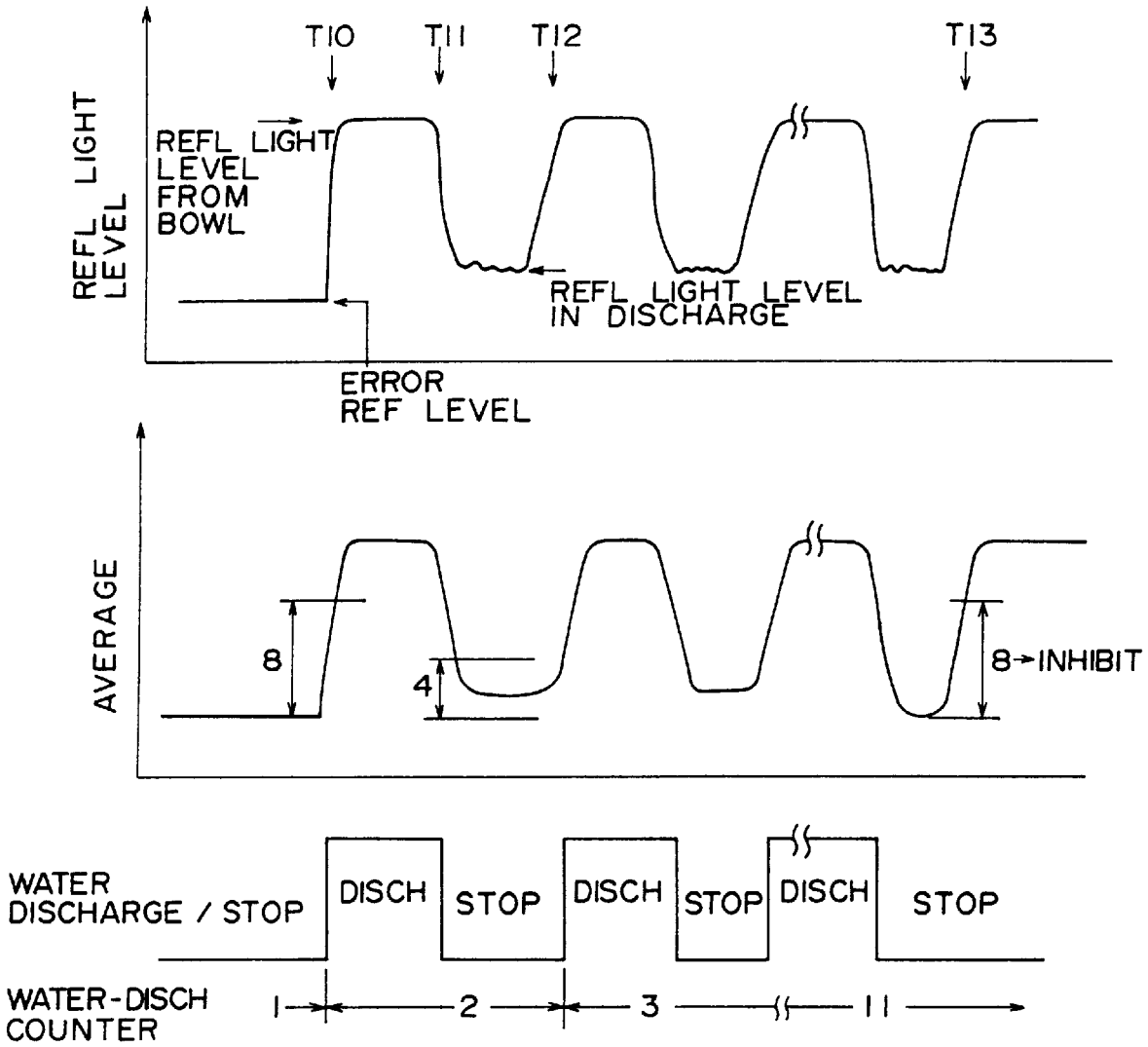
FIG. 18 is a graphical representation showing the reflection level and the average value obtained when water is discharged or stopped repeatedly.

FIG. 18 shows examples of signals obtained when the water discharge/stop is repeated. In FIG. 18, the bowl is covered with an obstruction as a duster to time T10, so that a reference level lower than an actual value is stored. At time T10, when the obstruction is removed, although the reflection signal level is returned to the reflection level of the bowl, since the reference level so far stored until T10 is larger than 8, the electromagnetic value is opened in step (S96Y) in FIG. 16. In practice, however, there exists a time delay from when the electromagnetic valve is opened to when water is discharged from the spout A2. When the reflected light level is absorbed by discharged water at time T11, since the reflection level decreases, the water discharge condition cannot be established in step (S84N), so that the electromagnetic valve is closed. Further, there exists a time delay from when the electromagnetic valve is closed to when water is not discharged from the spout. At time T12, when the signal level is returned to the reflection level from the bowl, since the average value increases, water can be discharged again.

As described above, the water discharge/stop is kept repeated. However, at time T13 since the tenth water discharge ends, the reflection level returns to the reflected light level from the bowl. Here, although the average value increases high, since the water discharge based upon the condition related to the average value is inhibited in step (S103N), water is not discharged, with the result that it is possible to stop the erroneous water discharge/stop operation.

After the water discharge ends, the variance value becomes small in step (S70Y). After that, after 30 sec has been elapsed in step (S71Y), an average value of a correct reflection level is stored as the reference level. At the same time, in step (S101), the water discharge counter is reset to 1. At this time, since the correct reference level has been already stored, an erroneous operation will not recur.

When water is actually discharged or stopped by the user continuously (not the erroneous operation), after the eleventh discharge, since water can be discharged only on the basis of the variance condition, although the response speed is slow in comparison with the case where water is discharged on the basis of both the average value and the variance value, since the water can be discharged securely, there exists no problem with respect to the usage. Further, in the above-mentioned number of times of repetitions of the water discharge/stop, 10 times is only an example, so that any appropriate numerical value can be set according to products.

Further, in this embodiment, until the water discharge counter counts a predetermined number of times, water is discharged only when any one of the conditions based upon the average value and upon the variance value is satisfied. Further, after the water discharge counter has counted the predetermined number of times, water is discharged only when the condition based upon the variance value is satisfied. However, after the water discharge counter has counted the predetermined number of times, it is possible to obtain the similar effect by setting the water discharge start conditions more severely. For instance, it is possible to consider that the water discharge condition is changed in such a way that water is discharged when both the conditions based upon the average value and the variance value are satisfied or that the value to be compared with the average or variance value is changed to such a value that water is not easily discharged.

Further, the erroneous water discharge operation due to variance value can be prevented by the step (S97N) in FIG. 170

As described above, since various discrimination conditions can be formed by combining various conditions such as variance value, an average value, etc. of the reflection light level or by inhibiting any one of the conditions, there exists such an advantage that the countermeasures against the erroneous operation can be executed freely.

Figure 19:
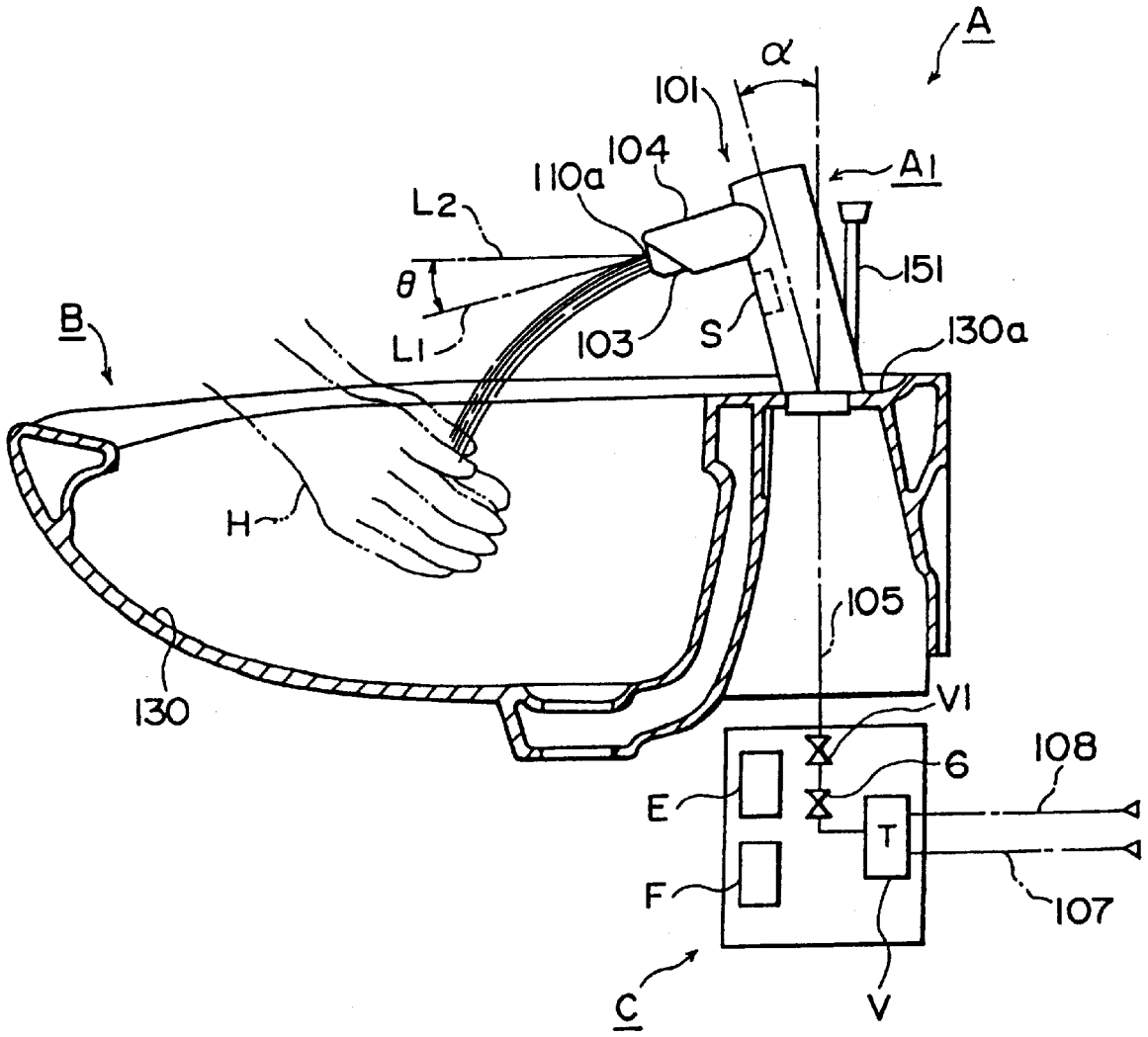
FIG. 19 is an illustration for assistance in explaining the structure of the second embodiment of the automatic faucet according to the present invention in the state of being used.
Figure 20:
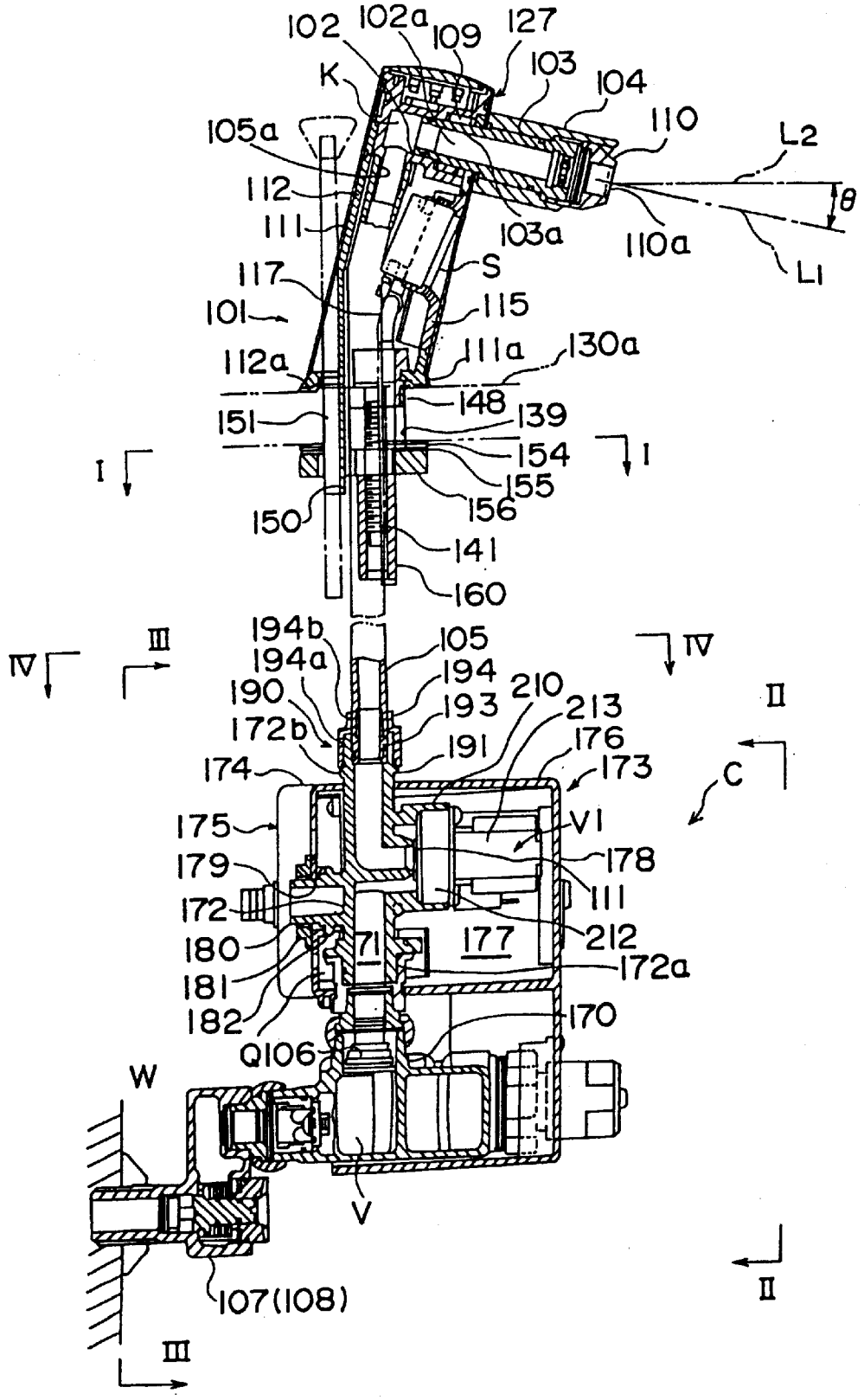
FIG. 20 is a side cross-sectional view showing the whole construction of the automatic faucet.

A second embodiment of the present invention will be described in detail hereinbelow with reference to FIGS. 19 to 36. As shown in FIGS. 19 and 20, in this embodiment, the automatic faucet A is provided with a hand sensor S for automatically discharging water and stopping the discharged water by sensing hands. However, the structure of this second embodiment can be applied to a manual faucet except the hand sensor S.

As shown in FIGS. 19 and 20, the automatic faucet A of the present embodiment is composed of a faucet section A1 mounted on a faucet mounting surface 130*a* formed at the rear portion of a washbowl 130 of a lavatory B, and an automatic faucet control box C disposed under the lavatory B to supply mixed hot and cold water to the faucet section A1 via a mixed hot and cold water supply pipe 105 formed of flexible resin (e.g., vinyl chloride).

Further, the faucet section A1 is composed of a faucet body 101 disposed on the faucet mounting surface 130*a* under a frontward inclined condition, a water discharge pipe 103 whose base end projects from the upper front portion of the faucet body 101, and a hand sensor S disposed at the front and lower portion of the water discharge pipe 103.

On the other hand, the automatic control box C accommodates a thermostat type mixing value V, an electromagnetic open-close valve V1, a control unit F, a power supply unit E, etc. Further, the thermostat type mixing valve V is connected to a downstream end of a hot water supply pipe 107 (whose upstream end is connected to a hot water supply source) and a downstream end of a water supply pipe 108 (whose upstream end is connected to a water supply source), respectively.

In the construction as described above, whenever the user stretches out his hands H into the washbowl 130, the hand sensor S is activated to output an output signal, so that the control unit F opens the electromagnetic open-close valve V1. Accordingly, mixed hot and cold water whose temperature is adjusted to an appropriate temperature by the thermostat type mixing valve V can be discharged from the water discharge pipe 103 into the washbowl 130, through the mixed hot and cold water supply pipe 105 and the faucet body 101, so that the user can wash his hands H automatically by the discharged water.

The discharge direction of the mixed hot and cold water discharged from the water discharge pipe 103 is determined slightly downward in the horizontal direction.

That is, as shown in FIG. 19, in this embodiment, the discharge direction of the water discharge pipe 103 is so determined that a downward angle θ between a discharge line $L_1$ and a virtual horizontal line $L_2$ lies between 0 and 35 degrees.

Therefore, the mixed hot and cold water discharged from the water discharge pipe 103 can be discharged along a parabolic locus, so that it is possible to broaden the washing space of the hand or the face within the washbowl 130.

As a result, it is possible to prevent such the state that the face washing space from being narrowed, being different from when the water discharge pipe 103 extends frontward of the washbowl 130 as is conventional, thus improving the usability of the automatic faucet A. In addition, since the hand H can be moved freely, the discharged mixed hot and cold water can hit against not only the fingers' ends but also the whole palms of the hands, with the result that it is possible to utilize almost all the amount of the mixed hot and clod discharged water. Since the hands can be washed by a small amount of water, the water can be thus economized.

Further, since the frontward projection distance of the water discharge pipe 103 can be reduced, it is possible to eliminate the user's feeling of the oppression caused when the water discharge pipe 103 extends frontward of the washbowl 130.

Figure 22:
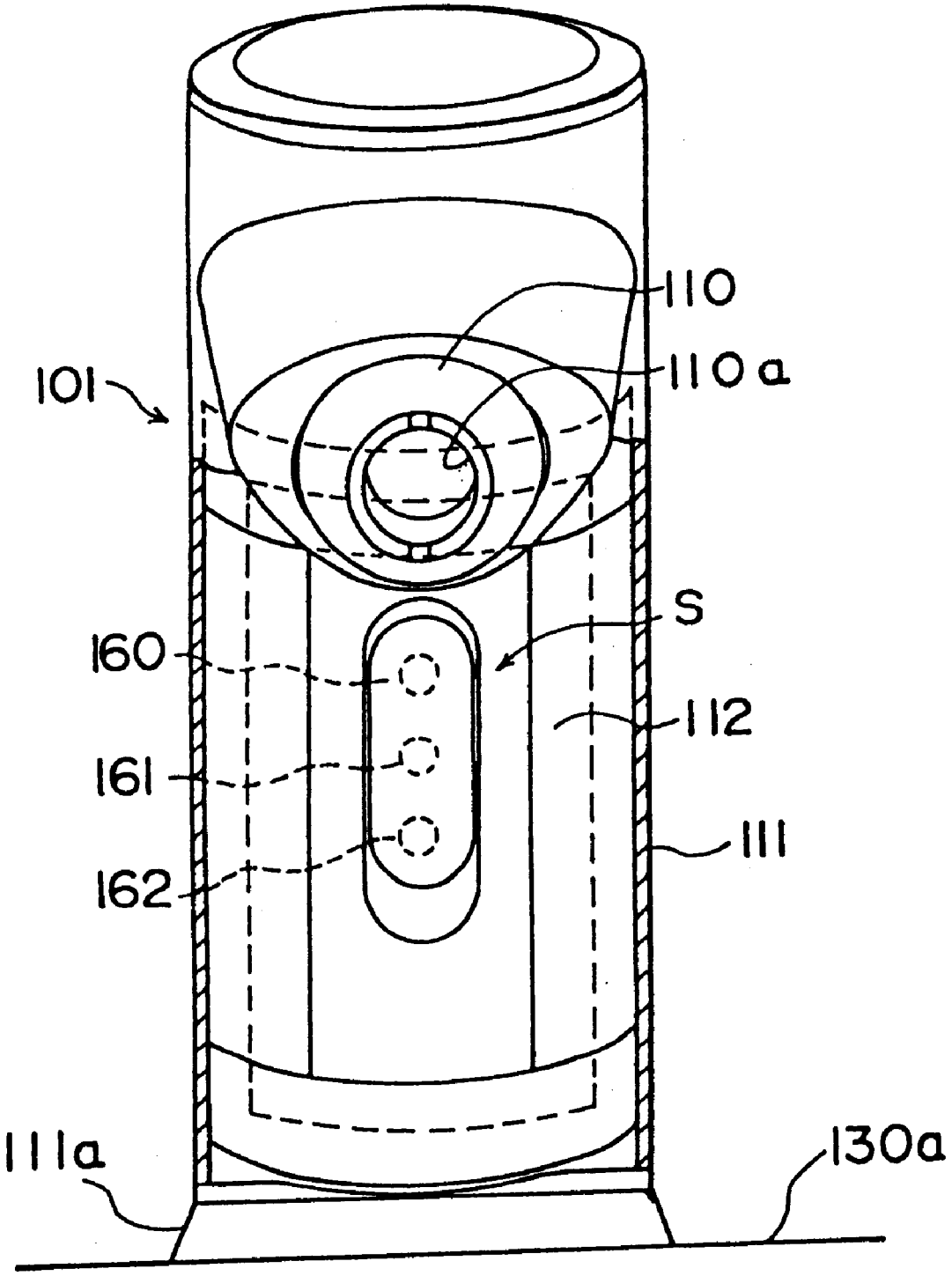
FIG. 22 is a front view showing the same faucet section.

Further, as shown in FIGS. 19 and 22, the water discharge opening 110*a* of the water discharge pipe 103 can be seen by the user, the user can stretch his hands accurately and easily toward the water discharge opening 110*a*, so that it is possible to improve the usability of the automatic faucet A.

Here, the reason why the maximum value of the angle θ between the discharge line ($L_1$) and the virtual horizontal line ($L_2$) is determined 35 degrees is that if determined more than this, the length of the water discharge pipe 103 must be increased and thereby the feeling of oppression is given to the user.

On the other hand, the reason why the minimum value of the angle θ is determined 0 degrees is that if determined less than this, the position at which the discharged water drops onto the hands H along the parabolic locus is shifted rearward of the washbowl and thereby the usability deteriorates.

Further, the experiment results indicate that the optimum angle θ is between 15 and 30 degrees.

Further, in this embodiment, as shown in FIGS. 19 and 20, since a constant flow rate valve 106 is interposed between the thermostat type mixing valve V and the mixed hot and cold water supply pipe 105, even if the water pressure fluctuates, it is possible to prevent mixed hot and cold water from being discharged from the water discharge opening 110*a* beyond a predetermined flow rate.

In other words, even when the mixed hot and cold water is discharged along a parabolic locus, since the flow rate or the force of water flow can be controlled by the constant flow rate valve 106, it is possible to effectively prevent mixed hot and cold water from being scattered by parts (arms, etch) other than the palms of the hands H.

Further, various types now on the market can be used as the constant flow rate valve 106, for instance as disclosed in Japanese Published Examined Utility Model Application No. 2-42231.

Further, as the experiment data, when a constant flow rate valve 106 of 5 liter/min is used, the horizontal discharge distance was about 9 cm on the horizontal line determined 15 cm downward away from the water discharge opening 110*a*. Accordingly, it is possible to shorten the length of the water discharge pipe 103 by about 4 cm, as compared with the conventional case.

The structure, the function, and the effect of the respective composing elements of the automatic faucet A of the present embodiment will be described in more detail with reference to the attached drawings.

(Faucet body 101)

Figure 21:
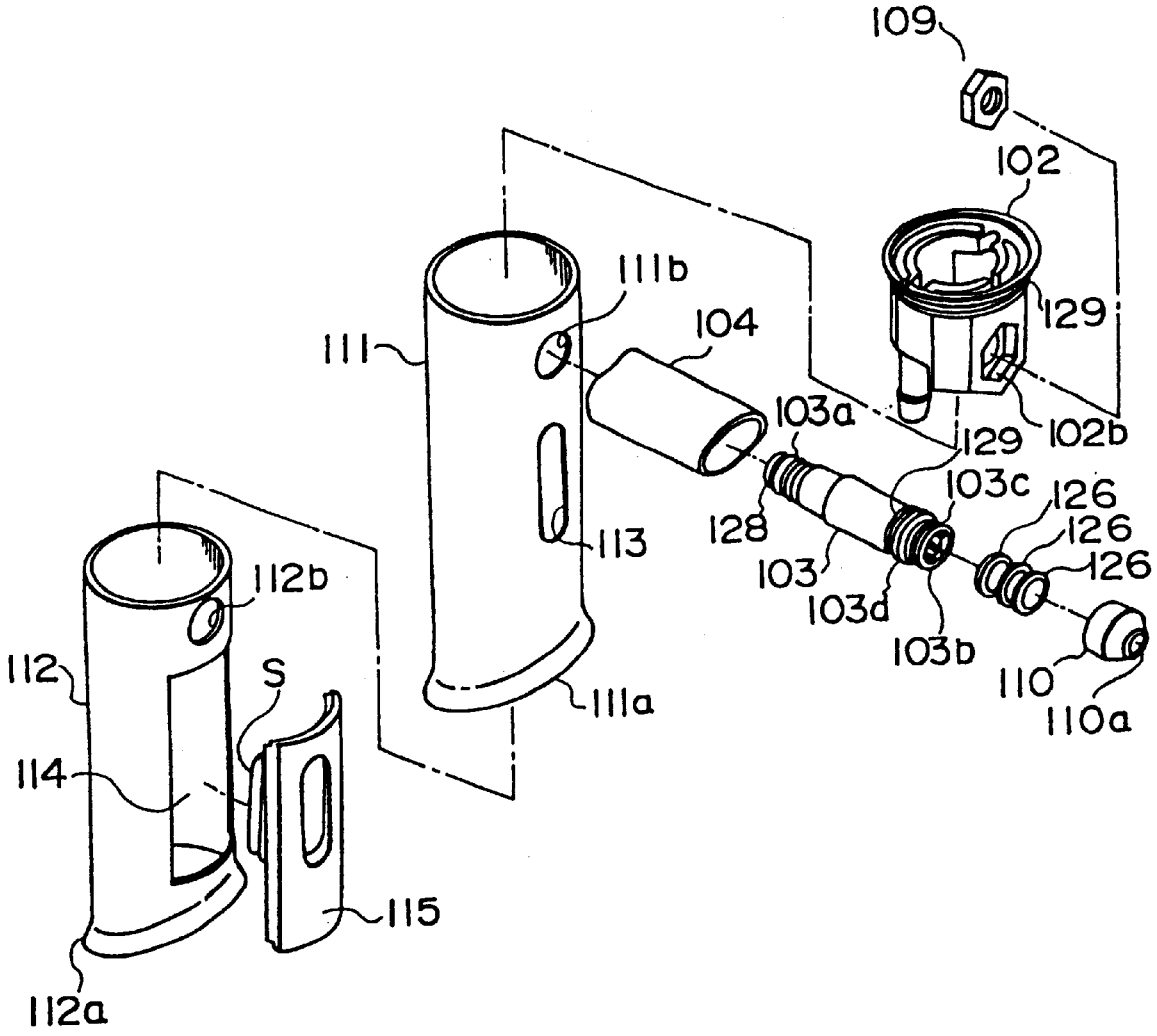
FIG. 21 is an exploded view showing the faucet section.

As shown in FIGS. 20 and 21, the faucet body 101 is of double tube type composed of a cylindrical outer pipe 111, and a cylindrical inner pipe 112 inserted into the outer pipe 111.

When the outer pipe 111 is preferably made of metal and the inner pipe 112 is preferably made of synthetic resin, it is possible to reduce the manufacturing cost thereof, without degrading the external appearance (e.g., luster) of the automatic faucet A.

Further, as shown in FIG. 20, the faucet body 101 can be set vertically by fixing the base end of the inner pipe 112 to a faucet mounting surface 130*a* of the washbowl 130.

Further, as shown in FIG. 20, the faucet body 101 is fixed to the faucet mounting surface 130*a* vertically in such a way as to be inclined frontward at a gentle angle $\alpha$ (e.g., 15 degrees). Therefore, as shown in FIGS. 19 and 20, when the water discharge pipe 103 is connected to the faucet body 101 at a right angle, it is possible to incline the water. discharge pipe 103 downward relative to the horizontal surface by a gentle angle $\theta$ (equal to the inclination angle $\alpha$ ), so that water can be discharged from the water discharge opening 110*a* along a parabolic locus. As a result, it is possible to decide an optimum position for hand washing and further to broaden the hand washing space at the optimum position.

Further, as shown in FIGS. 20 and 21, in the faucet body 101, the inner pipe 112 and the outer pipe 111 are both formed with a skirt portion 112*a* or 111*a* which expands at the end portion thereof, respectively. Owing to the presence of these skirt portions 112*a* and 111*a*, it is possible to improve the tightness between the inner and outer pipes 112 and 111. Therefore, for instance when the water discharge pipe 103 is attached to or removed from the faucet body 101, it is possible to prevent the inner and outer pipes 112 and 111 from being distorted.

Next, with reference to FIGS. 20 and 23, the fixing structure of the faucet body 101 to the faucet mounting surface 130*a* will be described hereinbelow.

Figure 23:
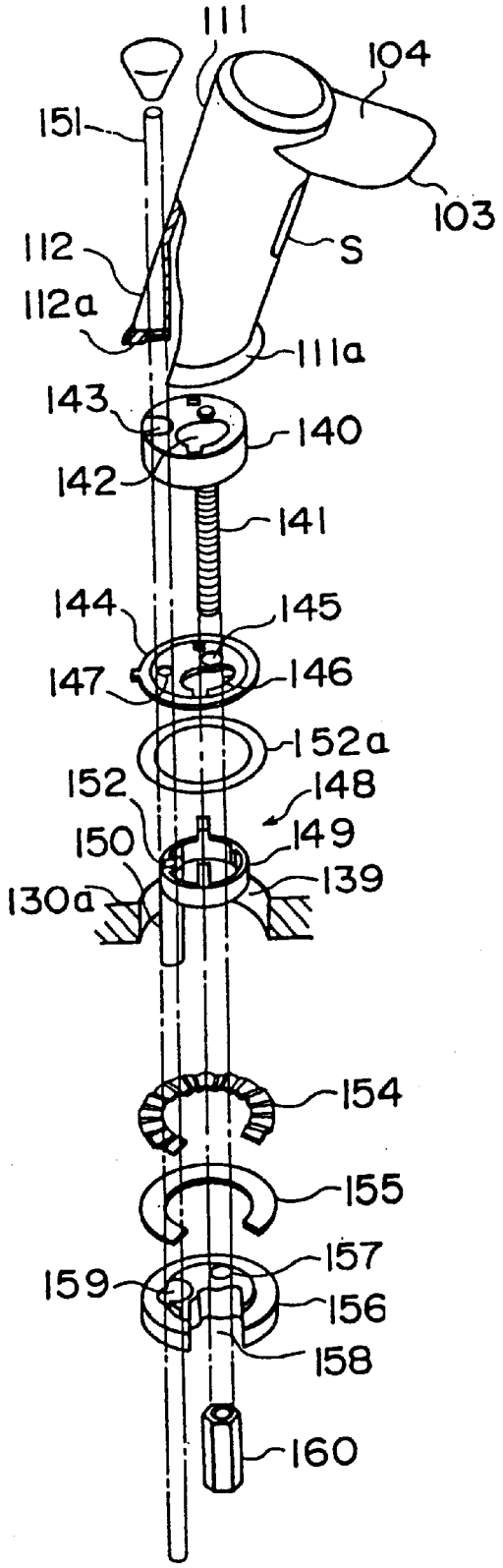
FIG. 23 is an exploded view showing the faucet fixing structure.

As shown in FIG. 23, the skirt portion 112*a* of the base end of the inner pipe 112 is disposed on the upper portion of a mounting opening 139 of the faucet mounting surface 130*a*. Further, a bolt fixing metal fixture 140 is fixedly attached to the inner circumferential surface of the same skirt portion 112*a*. This bolt fixing metal 140 is fixedly connected to an upper end of an elongated fastening bolt 141 extending vertically downward at a position eccentrically away from the center of the bolt fixing metal 140.

The bolt fixing metal 140 is formed with a through hole 142 for passing a mixed hot and cold water supply pipe 105, an electric code 117, etc. and a cutout groove 143 for passing an operation rod 151 of a pop-up drain cock, an operation rod guide piece 150, etc.

An annular faucet mounting washer 144 is fitted to the lower surface of the skirt portion 112*a* of the inner pipe 1120 The annular faucet mounting washer 144 is formed with a through hole 145 for passing the fastening bolt 141, a through hole 146 for passing the mixed hot and cold water supply pipe 105, the electric cable 117, etc. and a cutout groove 147 for passing the operation rod 151 of the pop-up drain cock, the operation rod guide piece 150, etc.

An operation rod guide 148 is disposed on the lower surface of the faucet mounting washer 1440 The operation rod guide 148 is composed of an upper annular portion 149 and the semicircular cross-sectional operation rod guide piece 150 formed integral with the upper annular portion 149 so as to project from the circumferential edge thereof.

The upper annular portion 149 of the operation rod guide 148 is formed with a through hole for passing the mixed hot and cold water supply pipe 105, the control cable 117, etc. On the other hand, the operation rod guide piece 150 is formed with a guide groove 152 for guiding the operation rod 151.

Further, the an annular upper packing 152*a* is interposed between the faucet mounting washer 144 and the operation rod guide 148.

As shown in FIGS. 20 and 23, on the reverse side surface of the mounting opening 139, there are provided an annular inner-clip washer 154 and a packing 155 (a part of both the circumferential portions thereof are cutoff partially).

Under the packing 155, a hose-show shaped thick-wall fastening washer plate 156 is disposed. The fastening washer plate 156 is formed with a through hole 157 for passing the fastening bolt 141, a cutoff groove 158 for passing the mixed hot and cold water supply pipe 105, the control cable 117, etc. and a through hole 159 for passing the operation rod 151 and the operation rod guide piece 150.

Further, in general, the inner clip washer 154, the packing 155 and the fastening washer plate 156 are fixed to each other as an integral member by a bonding agent to facilitate the faucet fixing work.

Further, under the fastening washer plate 156, an elongated cylindrical fastening nut 160 is disposed.

The procedure of fixing the faucet body 101 constructed as described above to the faucet mounting surface 130*a* will be described hereinbelow.

As shown in FIGS. 20 and 23, the faucet body 101 is mounted on the faucet mounting surface 130*a* by interposing the upper packing 152*a*, the operation rod guide 148 and the faucet mounting washer 144.

Figure 24:
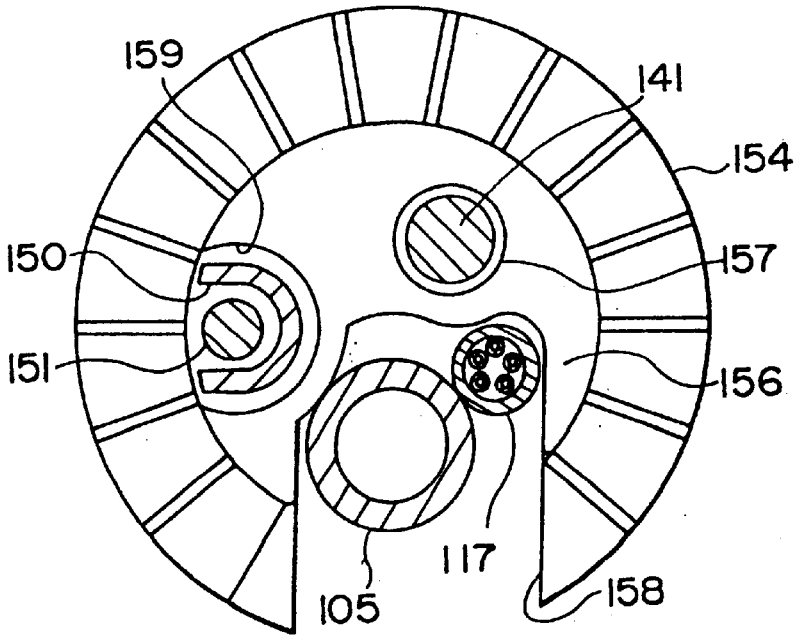
FIG. 24 is a cross-sectional view taken along the line I—I in FIG. 20.

As shown in FIGS. 23 and 24, the inner clip washer 154, the packing 155 and the fastening washer plate 156 are attached to the reverse side surface of the mounting opening 139, in this order, under the conditions that the mixed hot and cold water supply pipe 105, the electric cable 117, the operation rod guide 148, the fastening bolt 141, etc. have been all passed therethrough.

After that, the fastening nut 160 is screwed to the fastening bolt 141 to bring the fastening washer plate 156 into pressure contact with the reverse side surface of the mounting opening 139, with the result that the faucet body 101 can be fixed strongly to the faucet mounting surface 130*a*.

Figure 25:
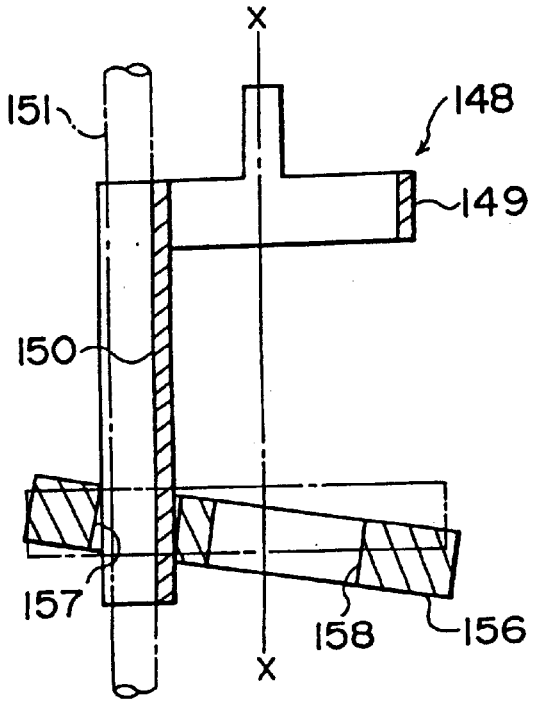
FIG. 25 is an illustration for assistance in explaining the automatic stop (catch) of the fastening washer plate by the fastening bolt.

In the above-mentioned fixing work, it is necessary to hold the fastening washer plate 156 in order to engage the fastening nut 160 with the fastening bolt 141. In this embodiment, however, as shown in FIG. 25, since the operation rod guide piece 150 is dislocated eccentrically away from the center X—X of the fastening washer plate 156, the center of gravity of the fastening washer plate 156 is dislocated at a position opposite to the operation rod guide piece 150, so that the fastening washer plate 156 is inclined from the engage portion with the operation rod guide piece 150 and thereby the inner surface of the through hole 157 of the fastening washer plate 156 is brought into contact with the surface of the operation rod guide piece 150.

Accordingly, since the fastening washer plate 156 can be stopped automatically from being moved, even if kept away from the worker's hand, the fastening washer plate 156 can be held by the operation rod guide piece 150, so that it is possible to engage the fastening nut 160 with the fastening bolt 141 easily and securely.

Further, in the above-mentioned fixing work, it is also possible to automatically stop the fastening washer plate 156 by use of the fastening bolt 141, instead of the operation rod guide piece 150.

That is, in the case, as shown in FIG. 23, since the fastening bolt 141 is dislocated eccentrically away from the center of the fastening washer plate 156, the center of gravity of the fastening washer plate 156 is dislocated at a position opposite to the fastening bolt 141, so that the fastening washer plate 156 is inclined from the engage portion with the fastening bolt 141 and thereby the inner surface of the through hole 157 of the fastening washer plate 156 is brought into contact with the surface of the fastening bolt 141.

Accordingly, in this case, since the fastening washer plate 156 is stopped automatically from being moved, even if kept away from the worker's hand, the fastening washer plate 156 can be held by the fastening bolt 141, so that it is possible to engage the fastening nut 160 with the fastening bolt 141 easily and securely.

(Water discharge pipe 103)

The construction of the water discharge pipe 103 will be described hereinbelow with reference to FIGS. 20 and 21.

First, the mounting structure of the water discharge pipe 103 onto the faucet body 1 will be described. As shown, in the state where the faucet body 101 is assembled by fitting the outer pipe 111 to the inner pipe 112, a cylindrical boxshaped water discharge pipe mounting head 102 is fitted and fixed to the top portion of the inner pipe 112.

As shown in FIG. 20, the water discharge pipe mounting head 102 is formed with an L-shaped bent flow passage K therein. A water discharge pipe screw portion 102*a* is formed at one end of the passage K; on the other hand, a supply pipe connection portion 105*a* connected to the downstream end of the mixed hot and cold water supply pipe 105 is formed at the other end of the passage K.

Further, a water discharge pipe fixing nut 109 is fitted to a hexagonal insertion hole 102*b* formed at the front surface of the water discharge pipe mounting head 1020 The water discharge pipe fixing nut 109 is formed with a female threaded portion. With this female threaded portion of the water discharge pipe fixing nut 109, the base end portion 103*a* of the water discharge pipe 103 is engaged through the water discharge pipe insertion holes 111*b* and 112*b* formed on the front upper portions of the outer and inner pipes 111 and 112, respectively.

In addition, as shown in FIGS. 19 to 21, an cylindrical water discharge pipe cover 104 is fitted to the outer circumferential surface of the water discharge pipe 103. This water discharge pipe cover 104 is supported being pinched between a cover engage flange portion 103*d* formed in the outer end circumferential surface of the water discharge pipe 103 and the outer pipe 111 (the outer circumferential surface of the faucet body 101).

Further, a discharge cap 110 having a plurality of flow straightening plates 126 is removably screwed to the end of the water discharge pipe 103.

As already explained, since the water discharge pipe 103 is arranged in roughly a horizontal direction as already explained, the water discharge opening 110*a* of the discharge cap 110 can been seen easily by the user, so that it is possible to improve the usability of the automatic faucet A.

Further, the composing elements other than those as described above will be explained with reference to FIGS. 20 and 21. The reference numeral 103*b* denotes a discharge hole formed at the end of the water discharge pipe 103; 103*c* denotes a male threaded portion formed at the rear side of the discharge hole 103*b* and engaged with the discharge cap 110; 127 denotes an O-ring interposed between the discharge mounting head 102 and the inner pipe 112; 128 denotes an O-ring interposed between the water discharge pipe 103 and the water discharge pipe mounting head 102; and 129 denotes an O-ring interposed between the water discharge pipe 103 and the water discharge pipe cover 104.

(Hand sensor S)

The mounting structure of the hand sensor S will be described hereinbelow with reference to FIGS. 20 and 21.

As shown, in the present embodiment, the hand sensor S is disposed on the front surface side of the faucet body 101 and under the water discharge pipe 103. The hand sensor S is substantially composed of a sensor window 113 formed at the front surface of the outer pipe 103, a sensor mounting hole 114 formed in the front surface of the inner pipe 112 at such a position as to correspond to the sensor window 123, and a sensor mounting lid 115 fitted to the mounting hole 114.

The hand sensor S is mounted on the inside of the sensor mounting lid 115. As described above, since the hand sensor S is disposed under the water discharge pipe 103 and further the light emitting direction is determined downward at an angle of about 115 degrees, the position at which the hand H is detected by the hand sensor S is located under the upper edge of the washbowl B. Therefore, even if part of water hitting the hand is scattered, it is possible to securely prevent the water from being scattered outside the washbowl 130. Further, as clearly shown in FIG. 22, the hand sensor S has a light emitting element 160, a dry battery used-up display LED 161, and a light receiving element 162 all arranged in a straight line in this order in the vertical direction from above.

In the construction as described above, when the water discharge pipe 103 is set roughly in the horizontal direction as already explained, since the faucet body 101 roughly perpendicular to the axial line of the water discharge pipe 103 can be disposed roughly vertically relative to the faucet mounting surface 130*a*, the user can see the dry battery used-up display LED 161 clearly, so that a dry battery 186 (described later) can be replaced with a new one easily and securely.

Further, since the dry battery used-up display LED 161 is interposed between the light emitting element 160 and the light receiving element 162, a sufficient distance can be maintained between the light emitting element 160 and the light receiving element 162, so that the light receiving element 162 can receive the light reflected by the hand H securely.

In this embodiment, the distance between the light emitting element 160 and the light receiving element 162 is about 16 mm, and these two elements 160 and 162 are arranged in such a way that the respective direction axes are arranged in parallel to each other. Further, the effective light emission region of the light emitting element and the effective light reception region of the light receiving element are determined in such a way as to become about 15 degrees on both right and left sides of the respective direction axes immediately before the sensor and about 7.5 degrees on both right and left sides of the respective direction axes about 20 cm away from the sensor. In other words, the direction angles of both effective light emission region and the effective light reception region can be narrowed on both sides of the direction axes with increasing distance from the sensor, respectively.

On the other hand, it is empirically known that the hands are stretched into a range about 5 to 20 cm away from the water discharge opening. Therefore, the hand sensor must be located so as to sense this range. Further, the faucet is generally formed into roughly a circular arc shape around an object such as hands. Therefore, when the photoelectric sensor is housed within the faucet, in order to sense the farthest object (200 mm), a distance between the light emitting element and the light receiving element is determined less that 200 (mm)×2 ×tan 7.5(°)=52.7 (mm). The experiment indicated that there exists no practical problem when the distance between both is determined less than 60 (mm).

Further, in this embodiment, when the light receiving element 162 senses the reflection light within 10 minutes after the power supply has been first turned on subsequent to the faucet installation, since the dry battery used-up display LED 161 is turned on to indicate the faucet mal-installation, it is possible to indicate that the installation position is not appropriate (e.g., the light is reflected by the chinaware at the installation). In addition, it is possible to confirm the operation of the sensor S at the installation, without opening the main water supply cock (because the faucet is usually installed under the condition that the main water supply cock is kept closed). As described above, it is possible to previously prevent erroneous execution of the installation work.

(Automatic faucet control box C)

The automatic faucet control box C disposed under the lavatory B to supply mixed hot and cold water to the faucet section A1 (shown in FIG. 19) via the mixed hot and cold water supply pipe 105 will be described hereinbelow with reference to FIGS. 20, 8 to 26.

As shown in FIG. 20, the thermostat type mixing valve V is fixed to the wall surface W by both a hot water pipe 107 and a cold water pipe 1080 To a mixed hot and cold water outlet portion 170 of this thermostat type mixing valve V, a mixed hot and cold water inflow portion 172*a* of an integral formation pipe 172 formed with a mixed hot and cold water flow passage 171 therein is fixed and connected.

Further, an electromagnetic open-close valve V1 is attached midway to the integral formation pipe 172. Further, to the mixed hot and cold water outflow portion 172*b* of the integral formation pipe 172, an upstream end of the mixed hot and cold water supply pipe 105 is connected via a supply pipe connection structure 160.

These electromagnetic open-close valve V1, the integral formation pipe 172, the control unit F, the power supply unit E, etc. are all housed in a rectangular box-shaped protective casing 173.

Figure 28:
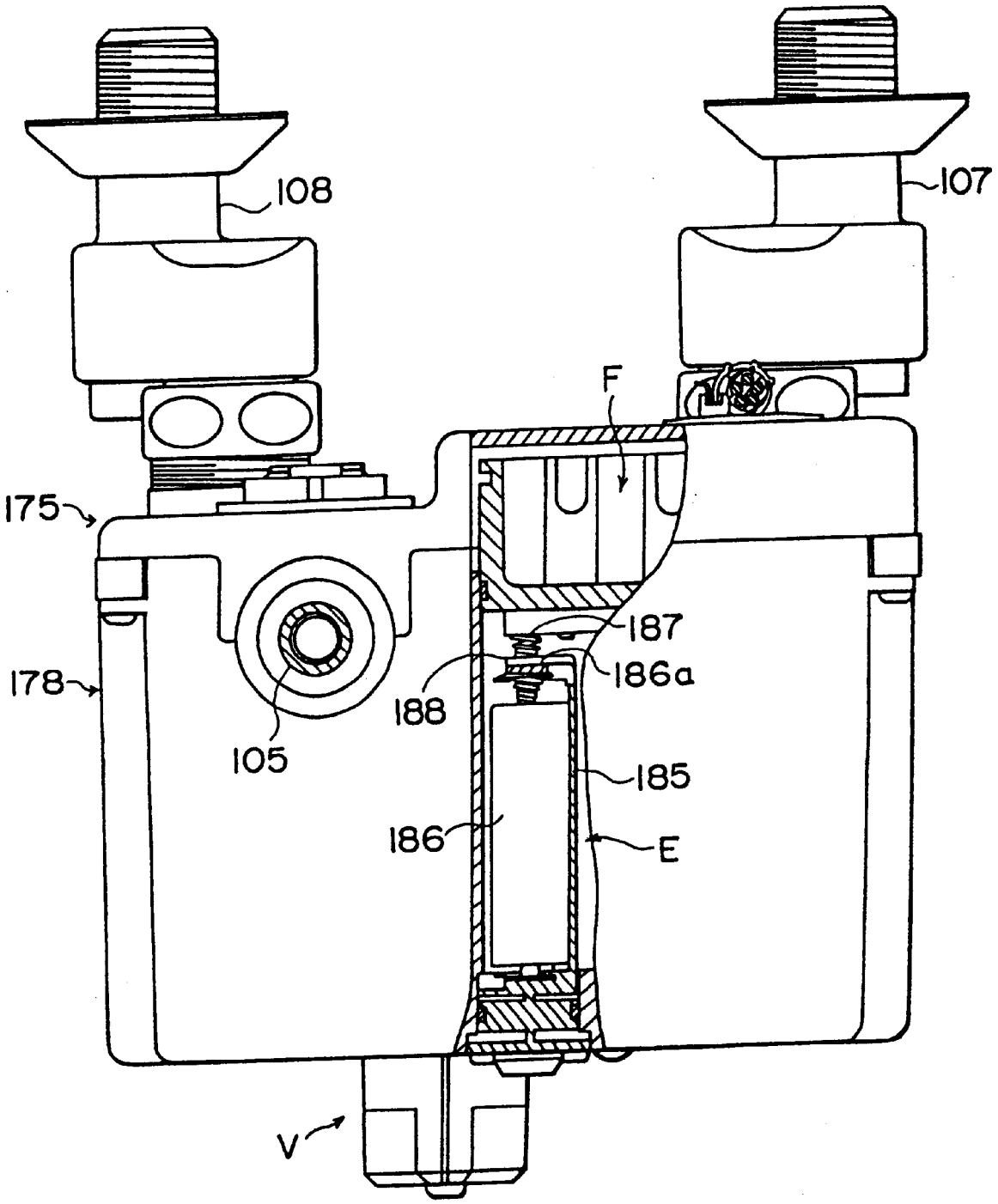
FIG. 28 is a view obtained when seen from the line IV—IV in FIG. 20.

As shown in FIGS. 20 and 28, the protective casing 173 is composed of a first rectangular protective casing 175 having a shallow annular rib portion 174 at the circumferential edge thereof so as to be strongly connected to the integral formation pipe 172, and a second protective casing 178 having a deep annular rib portion 176 removably engaged with the annular rib portion 174 of the first protective casing 175 in such a way that an electromagnetic open-close value accommodating space 177 can be formed in cooperation with he first protective casing 175.

In the construction as described above, as shown in FIG. 20, the first protective casing 175 is formed with an opening 179 in one upper side wall thereof Further, a screw cylinder 180 whose base end is formed integral with the integral formation pipe 172 on the side surface thereof projects outward through this opening 179, and a fastening nut 181 is engaged with the projection end of the screw cylinder 180. Therefore, when the fastening nut 181 is rotated, since the inner surface of the first protective casing 175 can be brought into high pressure contact with the flange 182 formed at the outer circumference of the screw cylinder 180 of the integral formation pipe 172, it is possible to fix the first protective casing 175 to the integral formation pipe 172 securely without use of any other fastening bolts and nuts.

Figure 26:
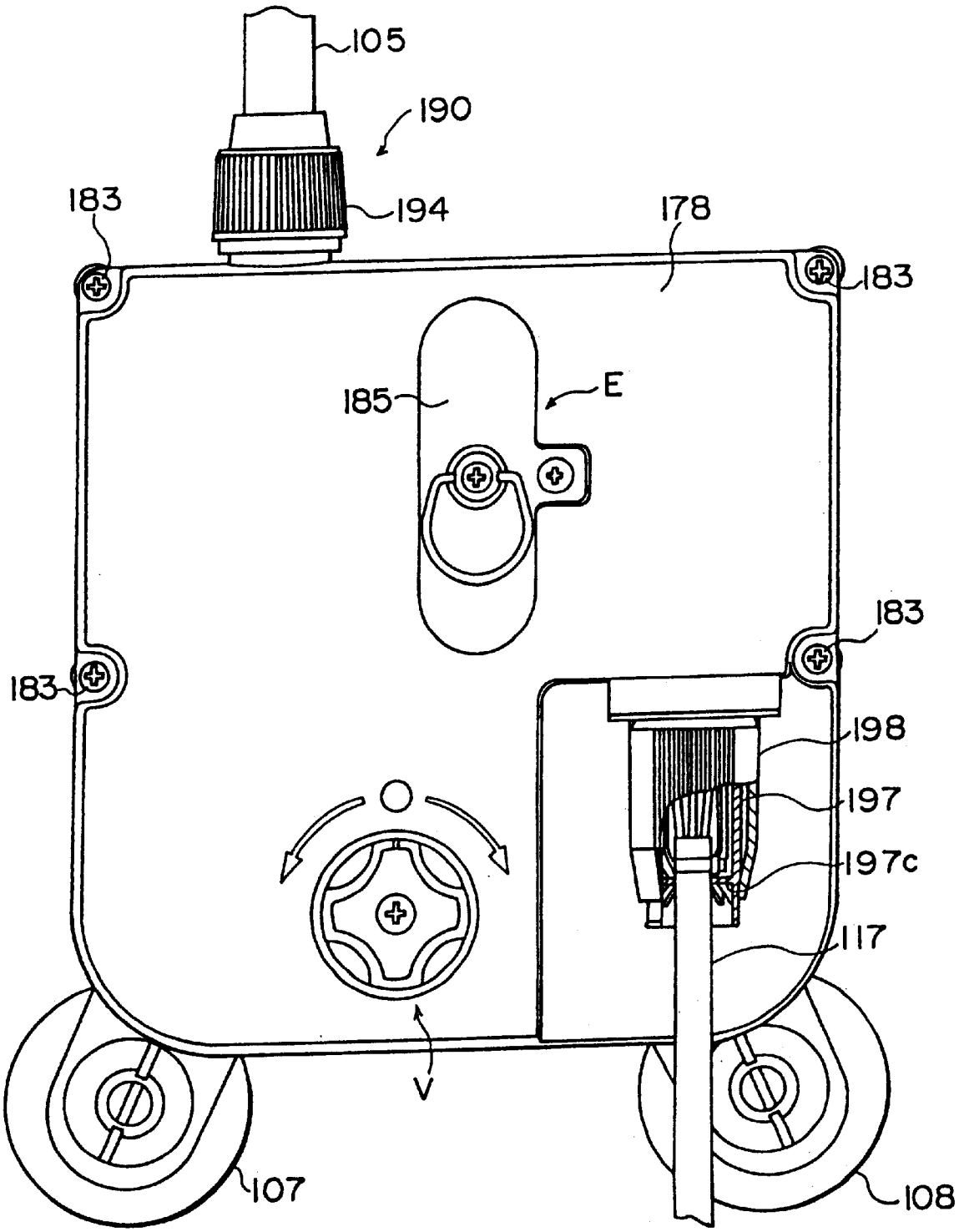
FIG. 26 is a view obtained when seen from the line II—II in FIG. 20.

On the other hand, as shown in FIG. 26, the second protective casing 178 can be fixed to the first protective casing 175 by use of set screws 183 easily.

Figure 27:
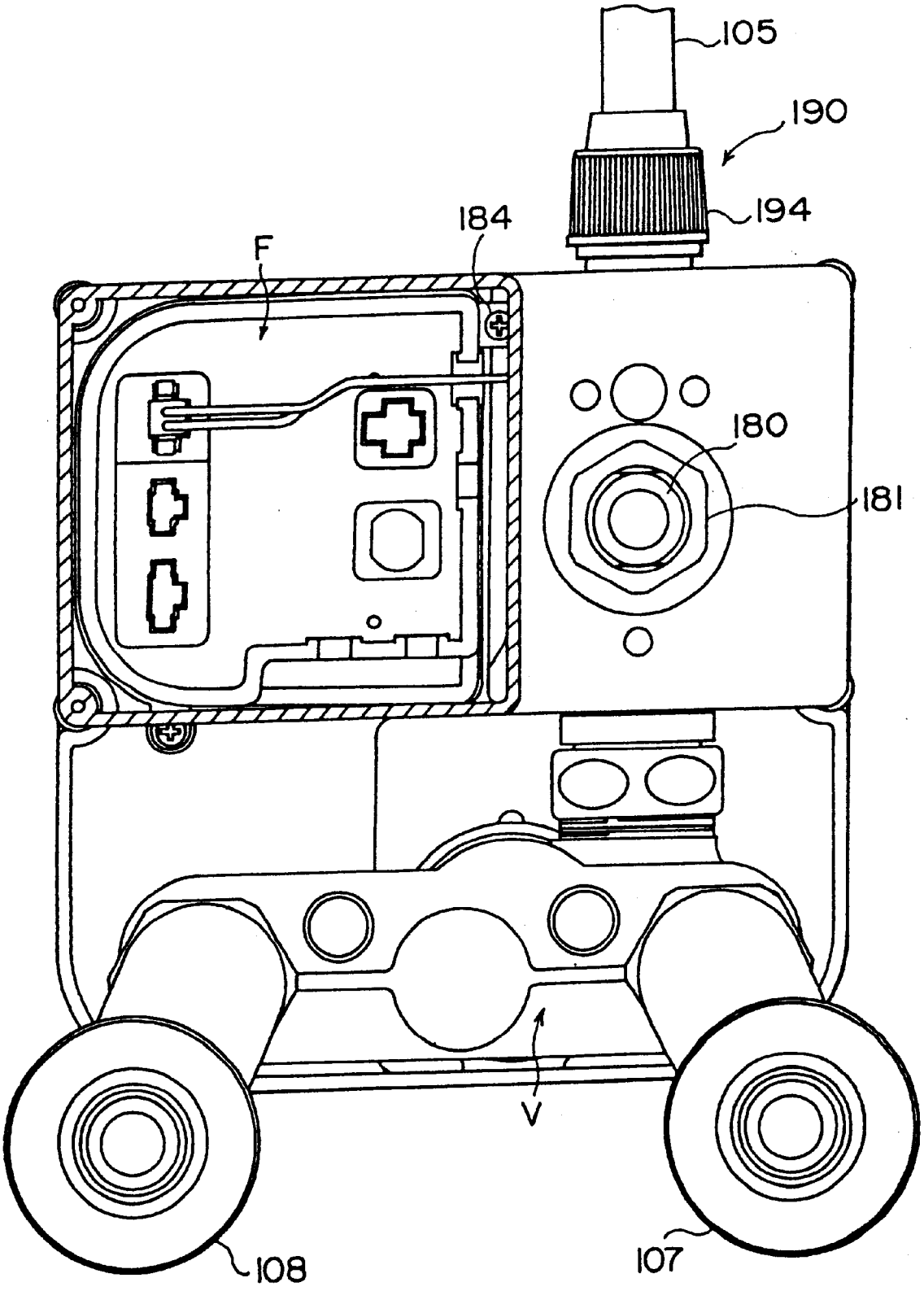
FIG. 27 is a view obtained when seen from the line III—III in FIG. 20.

Further, on the upper space of the protective casing 173, as shown in FIGS. 27 and 28, the control unit F and the power supply unit E are both arranged The control unit F is fixed to the upper wall of the first protective casing 175 by use of set screws 184.

Figure 29:
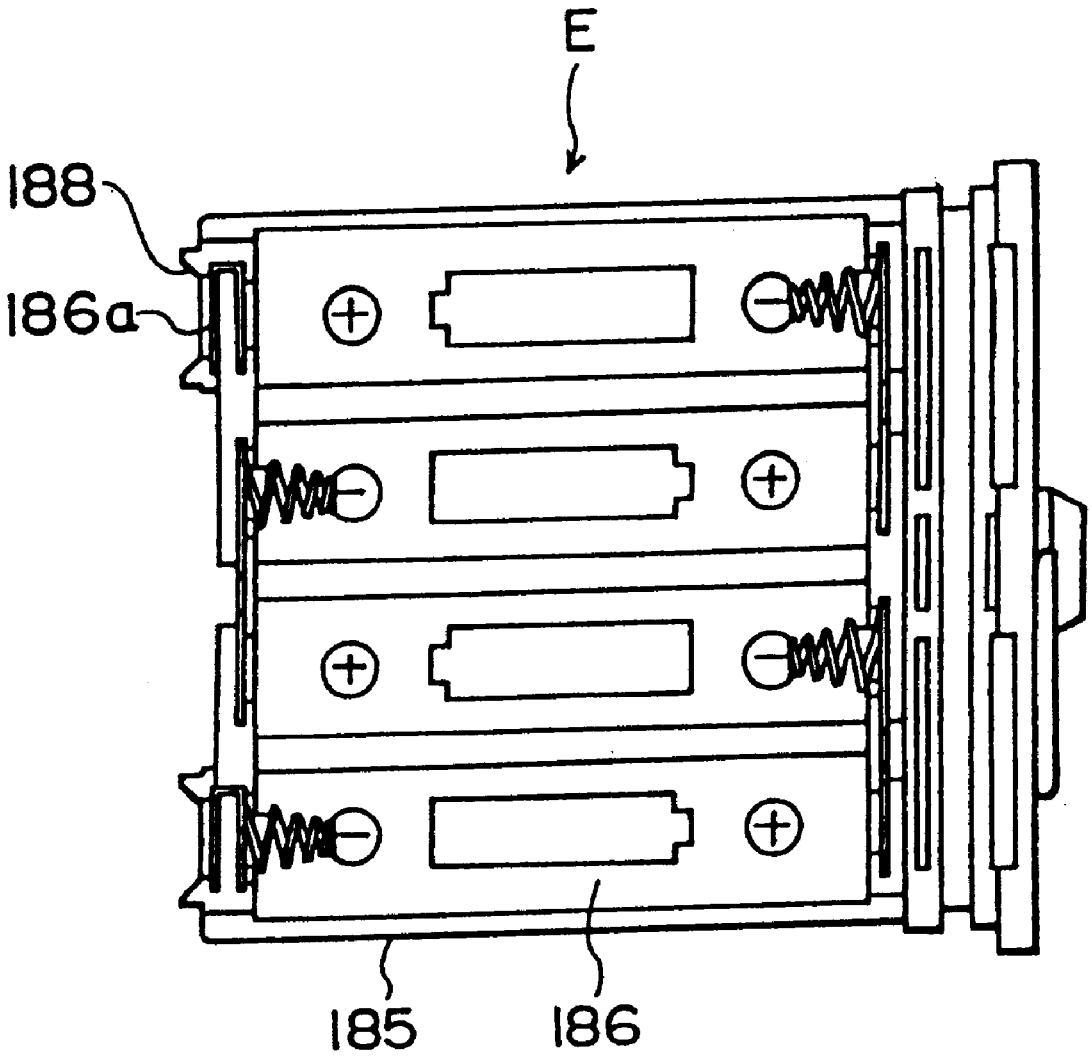
FIG. 29 is a front view showing the power supply casing.

On the other hand, as shown in FIG. 29, the power supply unit E is composed of a dry battery case 185 removably attached to the second protective casing 178 through an opening formed in the side wall of the second protective casing 178, and a plurality of dry batteries are fitted to the dry battery case 185.

In the construction as described above, as shown in FIGS. 28 and 19, a conductive plate 186*a* is provided at an extension end of the dry battery case 185. When the dry battery case 185 is attached into the second protective casing 178, the conductive plate 186*a* can be brought into contact with a conductive spring 187 projecting from the control unit F to the dry battery case 185, so that power can be supplied from the dry batteries 186 to the control unit F and the electromagnetic open-close valve V1.

Further, in this embodiment, the upper opening of the integral formation pipe 172 is connected to the mixed hot and cold water supply pipe 105 by use of a supply pipe connecting structure 180 as explained below.

Figure 30:
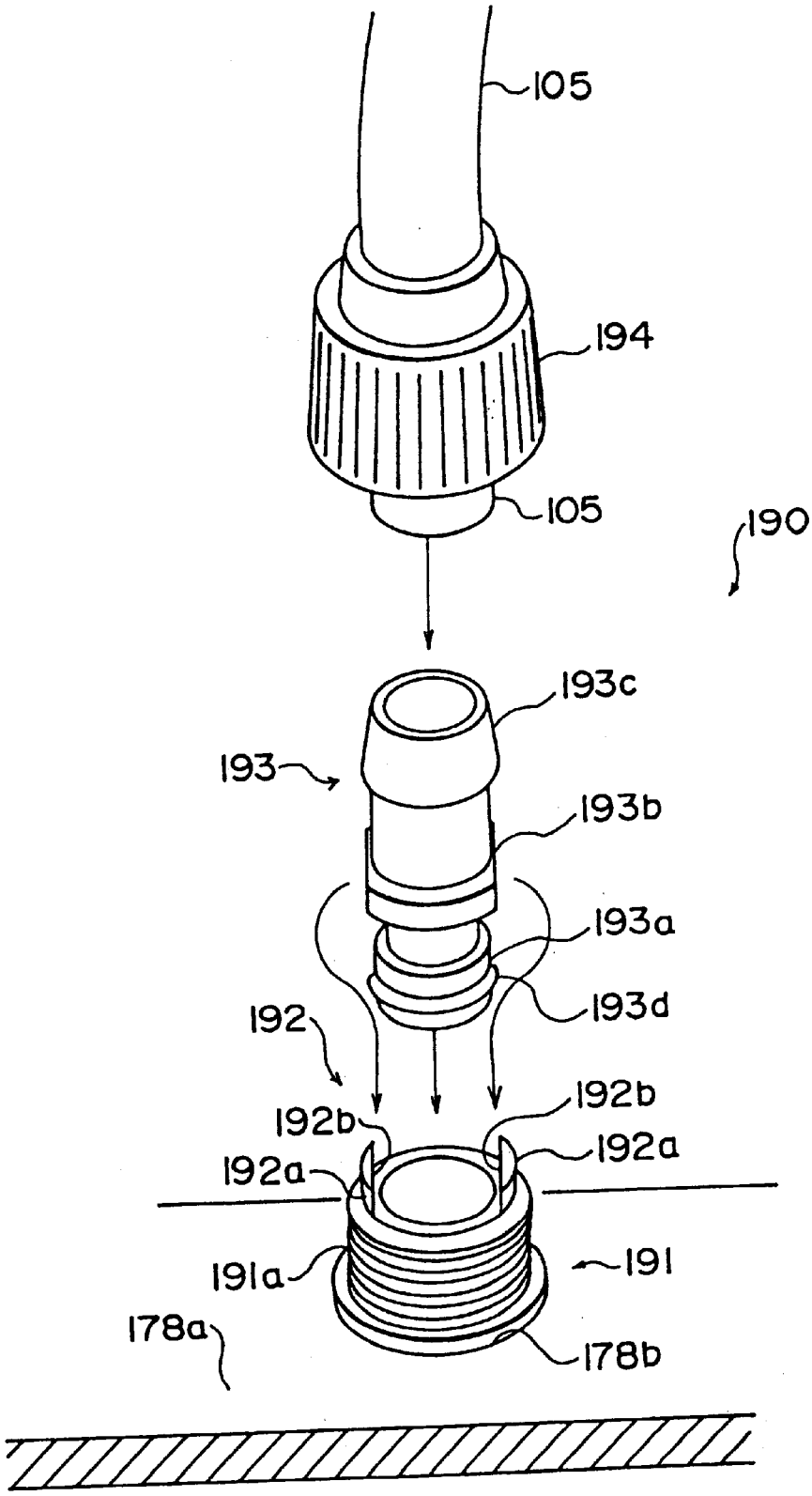
FIG. 30 is an exploded view showing the supply pipe connecting structure.

In more detail, as shown in FIGS. 20 and 30, the upper end portion of the integral formation pipe 172 projects upward via an opening 178*b* formed in an upper wall 178*a* of the second protective casing 178, and forms a cylindrical threaded portion 191 formed with a male thread surface 191*a* on the outer circumferential surface thereof In addition, a pair of opposing (spaced at 180 degrees) rotation prevention claws 192 are formed integral with and upper end of the cylindrical screw portion 191.

Each of these rotation prevention claws 192 is formed with an outer circular-arc portion 192*a* having a diameter the same as that of the cylindrical threaded portion 191 and an inside flat portion 192*b* both in cross section.

On the other hand, as shown in FIG. 30, a cylindrical socket 193 is mounted on the cylindrical threaded portion 191. The cylindrical socket 193 is formed with a lower fit portion 193*a* having an O-ring 193*d* attached to the circumferential surface thereof and fitted into the cylindrical threaded portion 191, a non-circular flange portion 193*b* whose two opposing circumferential surfaces are chamfered so as to provide two middle large-diameter portions, and an upper supply pipe connection portion 193*c* of bamboo sprout shape.

In the construction as described above, when the lower fit portion 193*a* of the cylindrical socket 193 is inserted into the cylindrical threaded portion 191, both the chamfered portions of the middle large-diameter flange portion 193*b* are brought into surface contact with the inside flat portions 192*b* of the rotation prevention claws 192. Therefore, it is possible to prevent the cylindrical socket 193 from being rotated relative to the cylindrical threaded portion 191.

On the other hand, an upstream end opening of the mixed hot and cold water supply pipe 105 is connected to the upper supply pipe connection portion, 193*c* formed at the upper end of the cylindrical socket 193.

Further, a taper shaped cap nut 194 formed with an inner large-diameter female threaded surface 194*a* and an inner small-diameter sliding surface 194*b* (both shown in FIG. 20) is slidably attached to the outer circumferential surface of the upstream end side of the mixed hot and cold water supply pipe 105.

Therefore, after the cylindrical socket 193 has been fitted into the cylindrical threaded portion 191 and after the cap nut 194 has -been slid downward along the inner small-diameter sliding surface 194*b*, when the large-diameter female threaded surface 194*a* is screwed with the male threaded surface 191*a* of the cylindrical threaded portion 191, since the rotation of the cylindrical socket 193 can be perfectly stopped by the rotation prevention claws 192, it is possible to strongly connect the cylindrical socket 193 to the cylindrical threaded portion 191, so that water tightness between the cylindrical threaded portion 191 and the cylindrical socket 193 can be sufficiently maintained.

Further, in this case, since the inner surface of the cap nut 194 brings the mixed hot and cold water supply pipe 105 into pressure contact with the bamboo-sprout shaped upper supply pipe connection portion of the cylindrical socket 193, the water tightness between the mixed hot and cold water supply pipe 105 and the cylindrical socket 193 can be sufficiently maintained.

Further, in this embodiment, as shown in FIG. 26, since the outer circumferential surface of the cap nut 194 is knurled, it is possible to connect or disconnect the mixed hot and clod water supply pipe 105 to and from the cylindrical socket 190 manually without use of any tools (which would otherwise damage the cap nut 194 and the mixed hot and cold water supply pipe 105 both made of resin).

Further, in the present embodiment, the following connection reinforcement structure is adopted such that a socket 294 connected to one end of the electric cable 117 can be strongly connected to an input plug 195 of the control unit F.

In more detail, as shown in FIGS. 26 and 31 to 33, a cylindrical screw portion 196 for enclosing a flat rectangular block-shaped input plug 195 is formed integral with a middle bottom wall 178*b* of the second protective casing 178. The cylindrical screw portion 196 is formed with a female threaded portion 196*a* in an inner surface thereof.

On the other hand, the one end of the electric cable 117 is connected to a flat rectangular block-shaped socket 194 similar to the input plug 195. An inside split cylinder 197 is movably attached to the outer circumferential surface of one end of the electric cable 117.

The inside split cylinder 197 is formed with a body cylindrical portion 197*b* and a small-diameter cylindrical end portion 197*a* formed on the side opposite to the input plug 195. Further, a plurality of code push claws 197*c* are projectingly arranged in an inner circumferential surface of the connection portion between the cylindrical end portion 197*a* and the body cylindrical portion 197*b* at regular angular intervals in the circumferential direction thereof The respective code push claws 197*c* extend toward the center of the electric cable 117 so as to be slidable in contact with the outer circumferential surface of the electric cable 117.

Further, the inside split cylinder 197 is formed with a pair of cutout portions 197*d* along the split surface thereof on the side of the input plug 195.

Further, an outside fastening cylinder 198 is slidably and coaxially fitted to the outer circumferential surface of the inside split cylinder 197. The outside fastening cylinder 198 is formed with a male thread portion 198*a* engaged with female thread portion 196*a* of the cylindrical threaded portion 196 on the side of the input plug 195, and with a tapered small-diameter cylindrical end portion 198*b* on the side opposite to the input plug 195.

Accordingly, after the socket 294 of the electric cable 117 has been mated with the input plug 195 of the control unit F with an appropriate looseness, when the male threaded portion 198*a* of the outside fastening cylinder 198 are engaged with the female threaded portion 196*a* of the cylindrical screw portion 196, the outside fastening cylinder 198 is strongly fixed to the second protective casing 178 through the thread engagement Further, since the cylindrical end portion 198*b* of the outside fastening cylinder 198 is brought into contact with the cylindrical end portion 197*a* of the inside split cylinder 197 to reduce the diameter thereof, the code push claws 197*c* can firmly catch the outer circumferential surface of the electric cable 117, so that the electric cable 117 can be clamped strongly.

Further, in this case, since the socket 294 connected to one end of the electric cable 117 is pinched between the two cutout portions 197*d* formed at one end of the inside split cylinder 197, it is possible to prevent the inside split cylinder 197 from being rotated together with the outside fastening cylinder 198 securely, and further to reduce the diameter of the inside split cylinder 197 securely.

Accordingly, since the electric cable 117 can be connected to the second protective casing 178 strongly via the inside split cylinder 197 and the outside fastening cylinder 198, even if a strong tension is applied to the electric cable 117 by an inadvertent operation, it is possible to securely prevent the socket 294 from being removed from the input plug 195.

Figure 31:
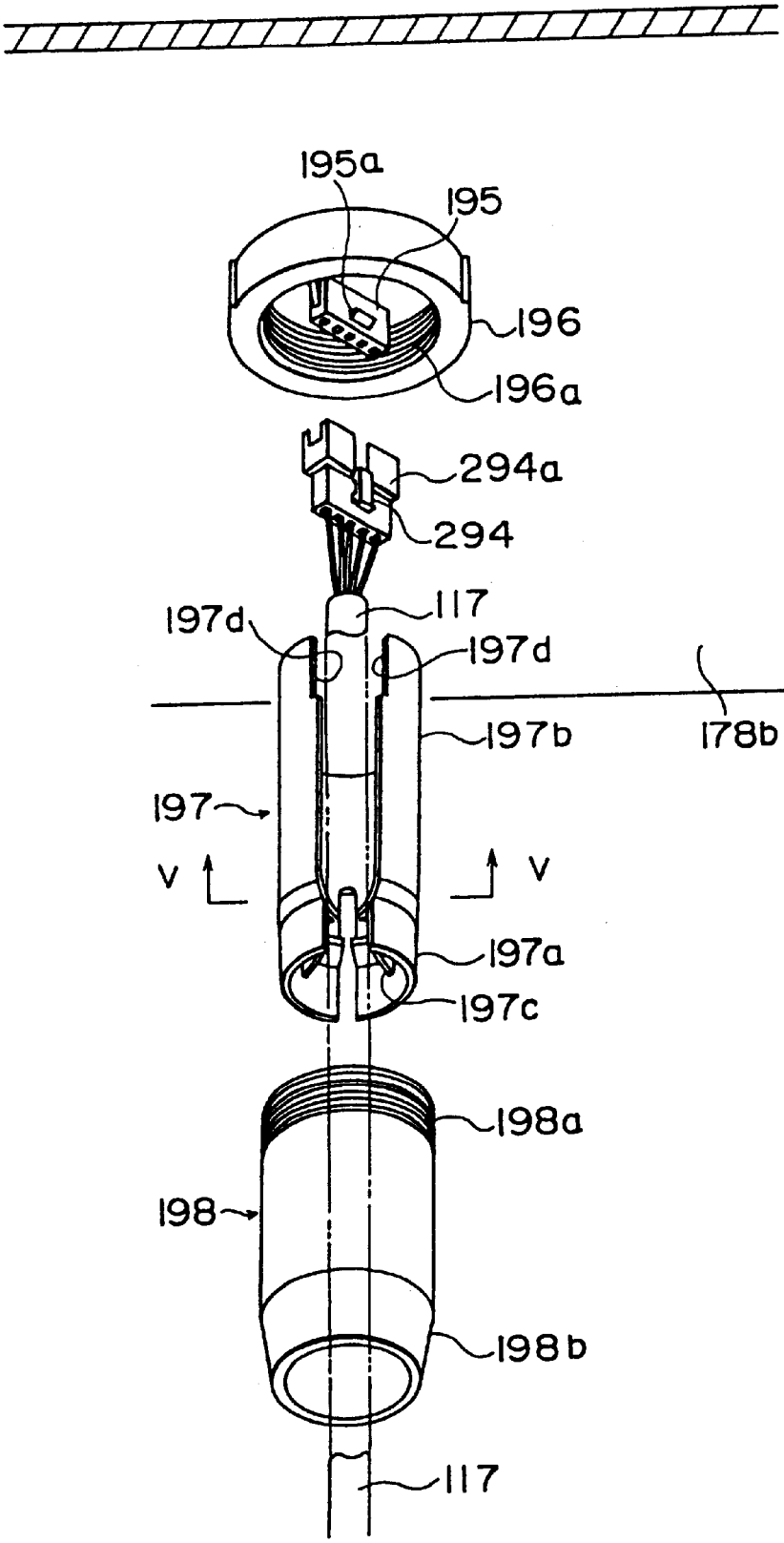
FIG. 31 is an exploded view showing the electric cable connection reinforcing structure.
Figure 32:
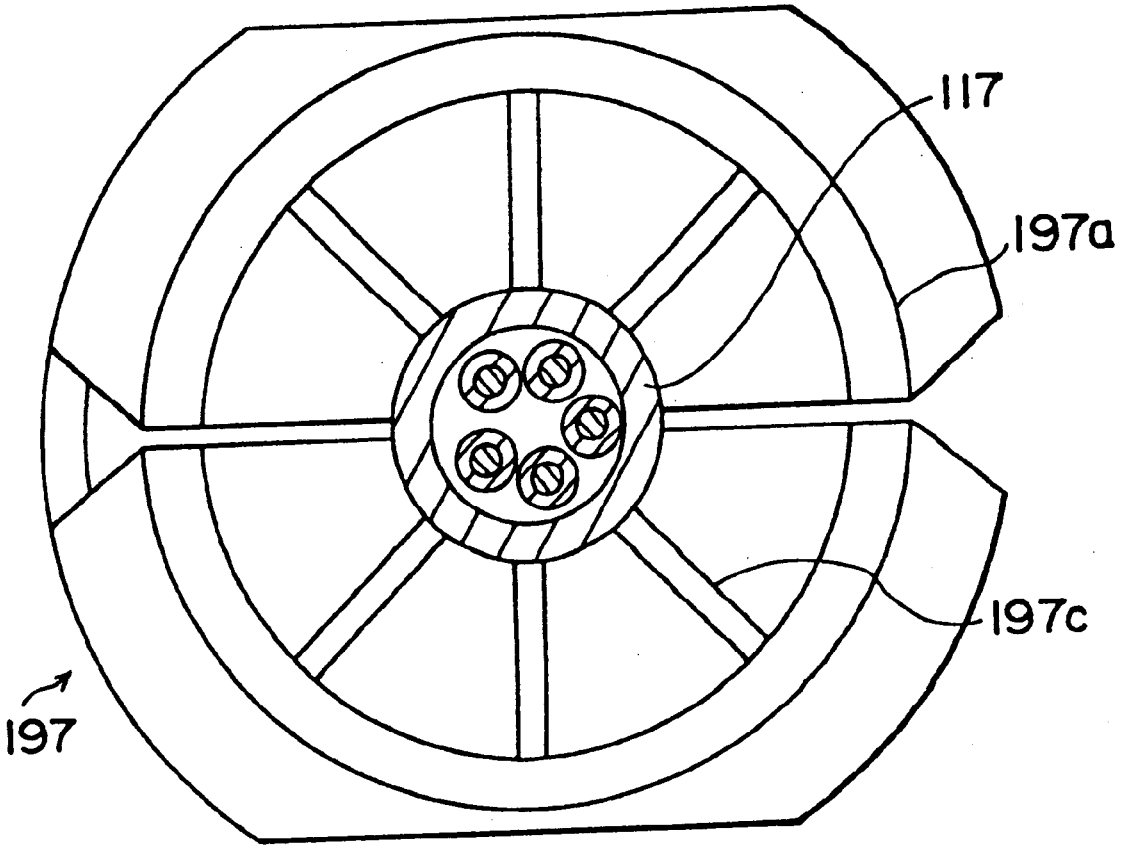
FIG. 32 is a cross-sectional view taken along the line V—V in FIG. 31.

Further as shown in FIG. 31 the input plug 195 is formed with an engage projection 195*a* on the side surface thereof, and the socket 294 is formed with an elastic engage hook 294*a* elastically engageable with the engage projection 195*a*. Therefore, it is possible to prevent the socket 294 from being removed from the input plug 195 by the hook engagement.

Further, as the empirical data, the tensile strength of only the engagement between the engage hook 294*a* of the socket 294 and the engage projection 195*a* of the input plug 294*a* is about 40 N. In the case of the connection reinforcement structure of this embodiment, it is possible to obtain a tensile strength of about 5 times larger than that the abovementioned value (40 N).

Figure 33:
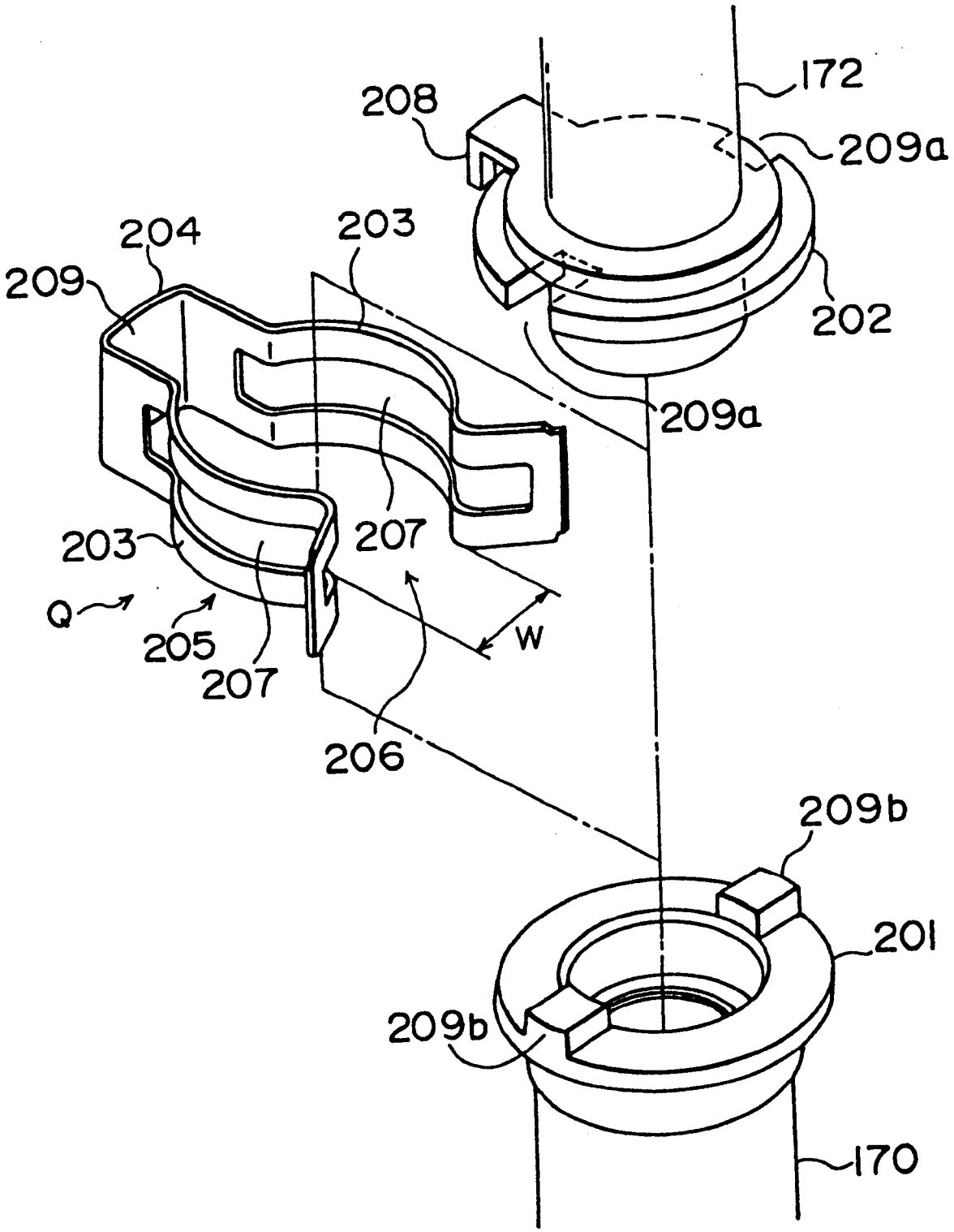
FIG. 33 is an exploded view showing the pipe connecting structure.
Figure 34:
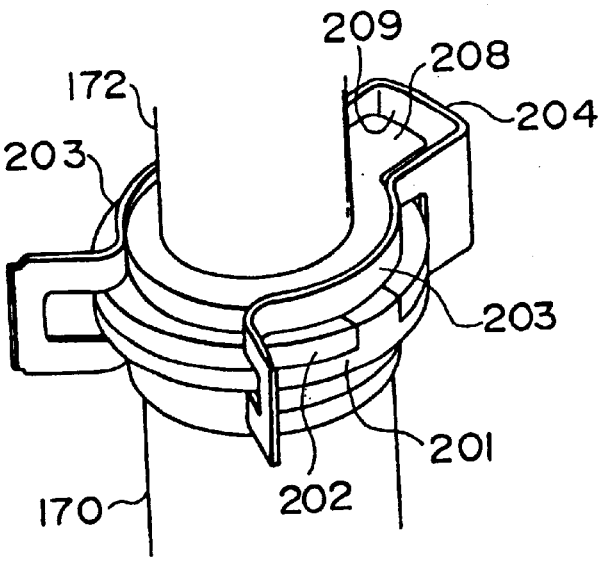
FIG. 34 is a perspective view showing the assembled pipe connecting structure.

Further, as shown in FIGS. 20, 33 and 34, in this embodiment, the mixed hot and cold water outlet portion 170 of the thermostat type mixing valve V is strongly and removably connected to the mixed hot and cold water inflow portion 72*a* of the integral formation pipe 172 by a pipe connecting structure having a pipe connecting metal fixture Q as described below.

As shown in FIG. 33, a connection flange 201 is fixed to an connection end of the mixed hot and cold water outlet portion 170, and a connection flange 202 is fixed to the connection end of the integral formation pipe 172.

On the other hand, as shown in FIG. 33, the pipe connecting metal fixture Q is formed into a U-shaped (opened on one side thereof) metal fixture body 205 composed of a pair of opposing outward bent members 203 and an elastic U-shaped connection member 204 all formed integral with each other. The opening width w of the opening portion 206 of the metal fixture body 205 is determined smaller than the outer diameters of the connection flanges 201 and 202, respectively Further, both the outward bent portions 203 are both formed with a rectangular cutout portion 207 at the middle portion thereof, respectively in such a way that the outer circumferential edges of the connection flanges 201 and 202 of the mixed hot and cold water discharge opening 170 and the integral formation pipe 172 can be both engaged therewith, respectively.

Therefore, after the end surfaces of the connection flanges 201 and 202 have been brought into contact with each other, the outward bent portions 203 of the pipe connecting metal fixture Q are opened against the elastic force of the U-shaped connection member 204 and fitted to the both side circumferential edge portions of the connection flanges 201 and 202 beyond the dead points, respectively. Then, since the both side circumferential edge portions of the connection flanges 201 and 202 are engaged with the rectangular cutouts 207 formed in the outward bent members 203 respectively, it is possible to connect the connection flanges 201 and 202 together firmly by the pipe connecting metal fixture Q. As a result, as shown in FIG. 34, it is possible to connect the integral formation pipe 172 to the mixed hot and cold water outlet portion 170 of the thermostat type mixing valve V.

Here, as shown in FIG. 33, a hook shaped rotation preventing projection 208 is formed integral with the outer circumferential surface of the connection flange 202. Further, as shown in FIG. 34, this projection 208 is fitted to a recessed portion 209 formed inside the U-shaped connection member 204 when the pipe connecting metal fixture Q is fitted to the connection flanges 201 and 202, respectively Therefore, in spite of a narrow space, it is possible to prevent such an accident that the pipe connecting metal fixture Q is rotated by a high water pressure, with the result that the metal fixture W collides against the protective casing 173 into damage.

Further, when the thickness of the protective casing 173 is increased, although the trouble with such a damage as described above can be prevented, since the manufacturing cost of the protective casing 173 increases, there arises another problem from the economical point of view.

Further, the work for mounting the protective casing 173 onto the integral formation pipe 172 is usually effected within a narrow space. Therefore, when the wire connecting metal fixture Q rotates, the metal fixture Q is obstructive to the mounting work. In this embodiment, however, since the pipe connecting metal fixture Q is prevented from being rotated securely, it is possible to mount the protective casing 173 to the integral formation pipe 172 easily and securely.

Further, as shown in FIG. 33, in this embodiment, one of the connection flange 202 is further formed with a pair of opposing engage recessed portions 209*a*, and the other of the connection flange 201 is further formed with a pair of engage projections 209*b* on an annular end surface thereof so as to be engaged with the engage recessed portions 209*a*.

Therefore, when the engage projections 209*b* are engaged with the engage recessed portions 209*a*, it is possible to determine the direction of the electromagnetic open-close valve V1 mounted on the integral formation pipe 172. In other words, in this embodiment, since the rotation prevention projection 208 can be located at the front side (on the right side in FIG. 20), it is possible to facilitate the mounting and dismounting work of the electromagnetic open-close valve V1.

Further, as shown in FIG. 20, the present embodiment is characterized in the mounting structure for mounting the electromagnetic open-close valve V1 on a mounting base 210 formed integral with the integral formation pipe 172.

Figure 35:
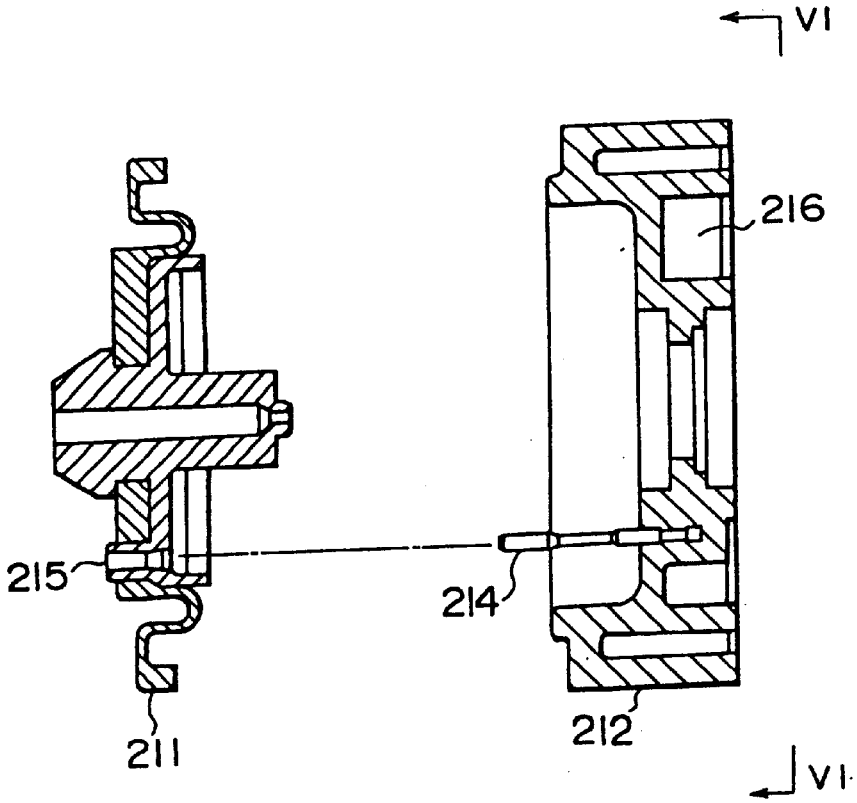
FIG. 35 is a side cross-section view showing the diaphragm valve and the diaphragm push plate of the electromagnetic open-close valve.

As shown in FIGS. 20 and 35, the electromagnetic open-close valve V1 is composed of a diaphragm valve 211, a diaphragm valve push plate 212, and an electromagnetic open-close valve driving section 213.

On the other hand, as shown in FIG. 35, when a bleed hole 215 (into which a clearing pin 214 is inserted) is clogged with refuse, in order to take off the refuse it is necessary to loosen the mounting bolts for removal of the electromagnetic open-close valve V1. In this removal work, since the diaphragm valve push plate 212 is strongly adhered onto the diaphragm valve 211, there exists such a case that only the electromagnetic open-close valve driving section 213 is removed, while leaving the diaphragm valve 211 and the diaphragm valve push plate 212 on the mounting base 210.

In this case, however, as shown in FIG. 20 since the rear end surface (the right side in FIG. 20) of the diaphragm valve push plate 212 is flush with the upper edge of the mounting base 210, it is impossible to engage a removing tool with the diaphragm push plate 212 under these conditions.

Figure 36:
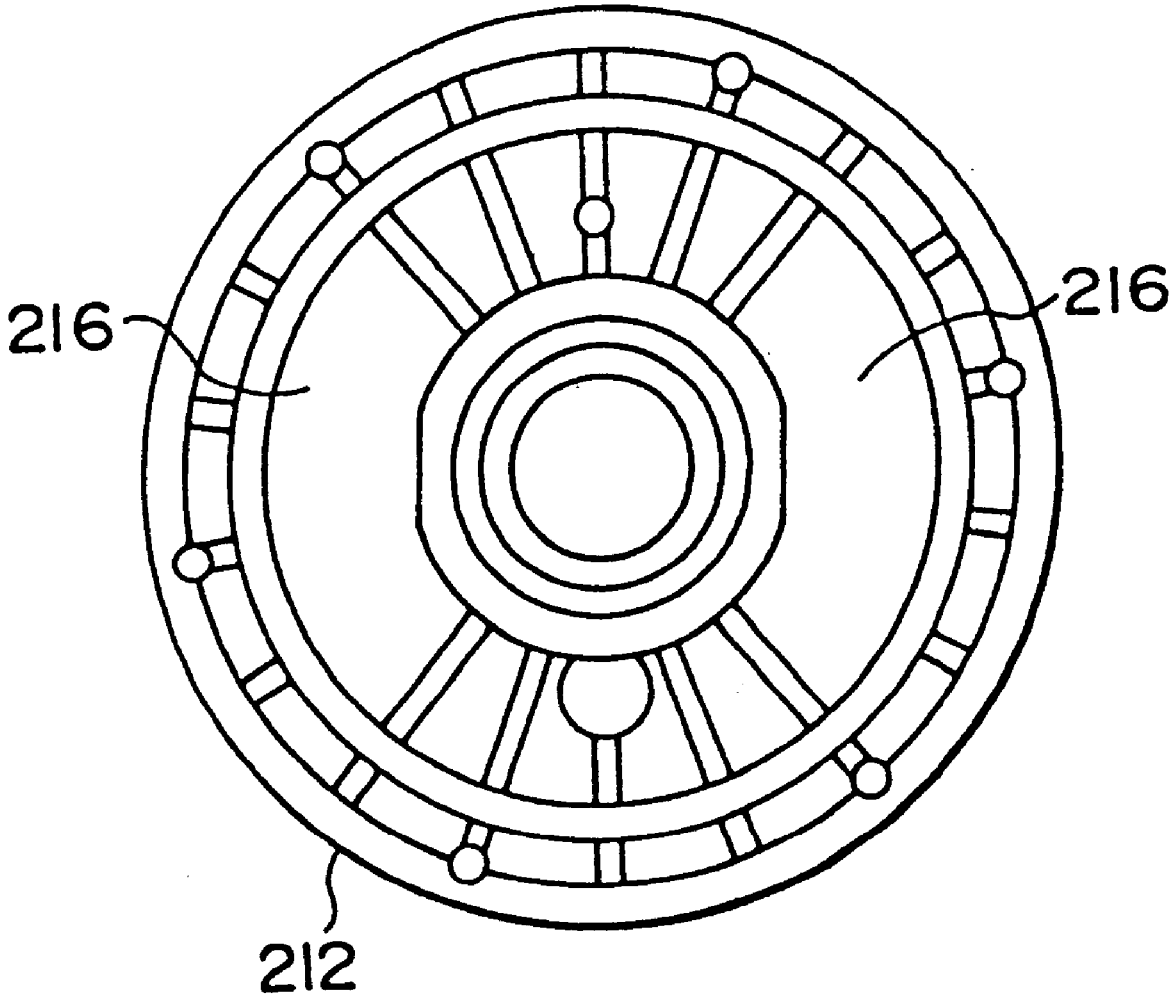
FIG. 36 is a cross-sectional view taken along the line VI—VI in FIG. 35.

To overcome this problem, in this embodiment, two opposing tool insertion spaces 216 are additionally formed at the rear end surface of the diaphragm valve push plate 212, as shown in FIGS. 35 and 36.

Therefore, in this embodiment, it is possible to easily insert the end of the removing tool into the tool insertion spaces 216, so that the diaphragm valve push plate 212 and the diaphragm valve 211 can be both removed easily. Therefore, refuse can be took away easily from the bleed hole 215.

In the present embodiment, it is possible to adopt the same control as that shown in FIGS. 13 to 180 FIGS. 37 to 39 show a third embodiment of the present invention.

Figure 37:
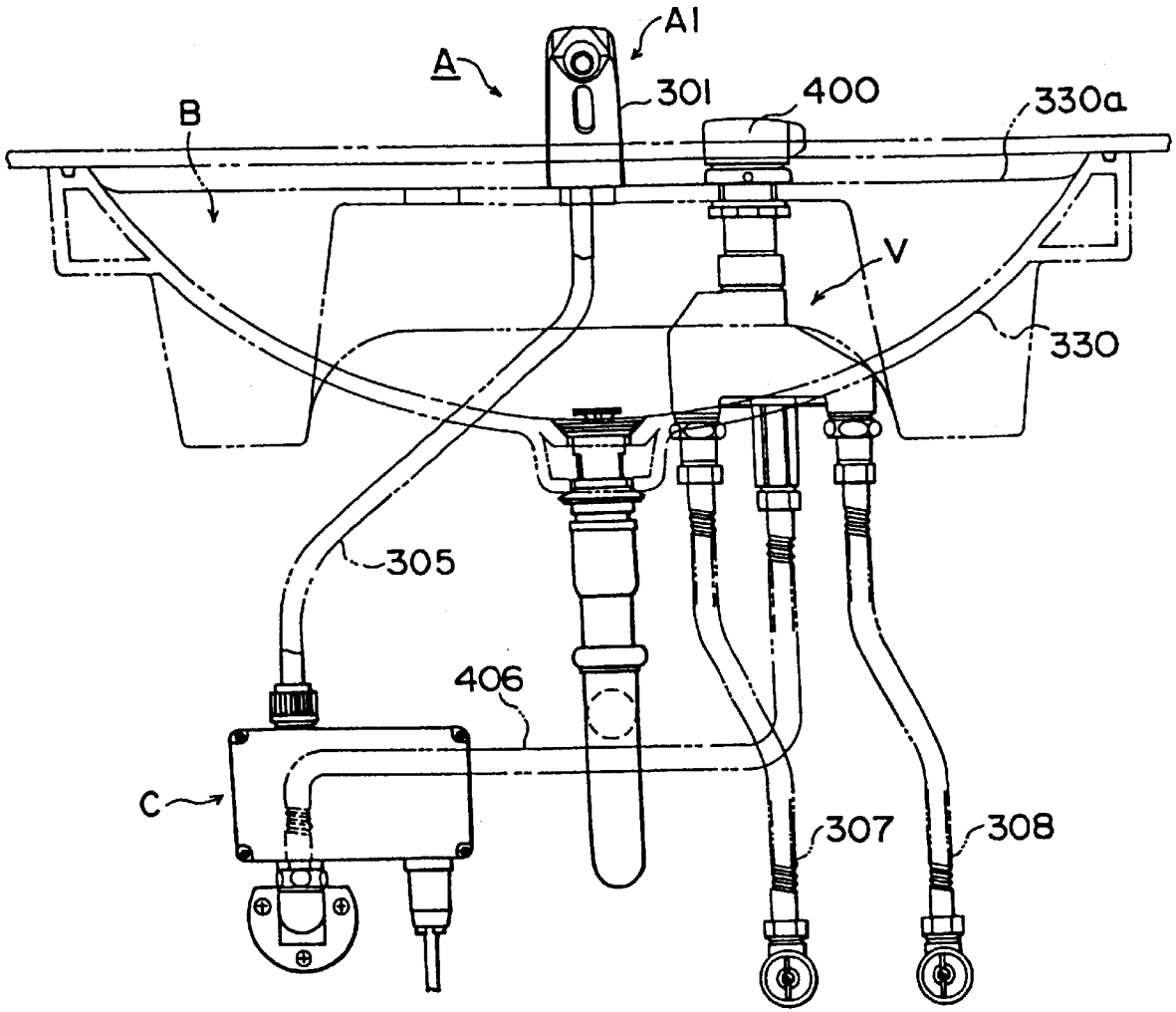
FIG. 37 is a front view showing the whole construction of the automatic faucet related to the third embodiment.
Figure 38:
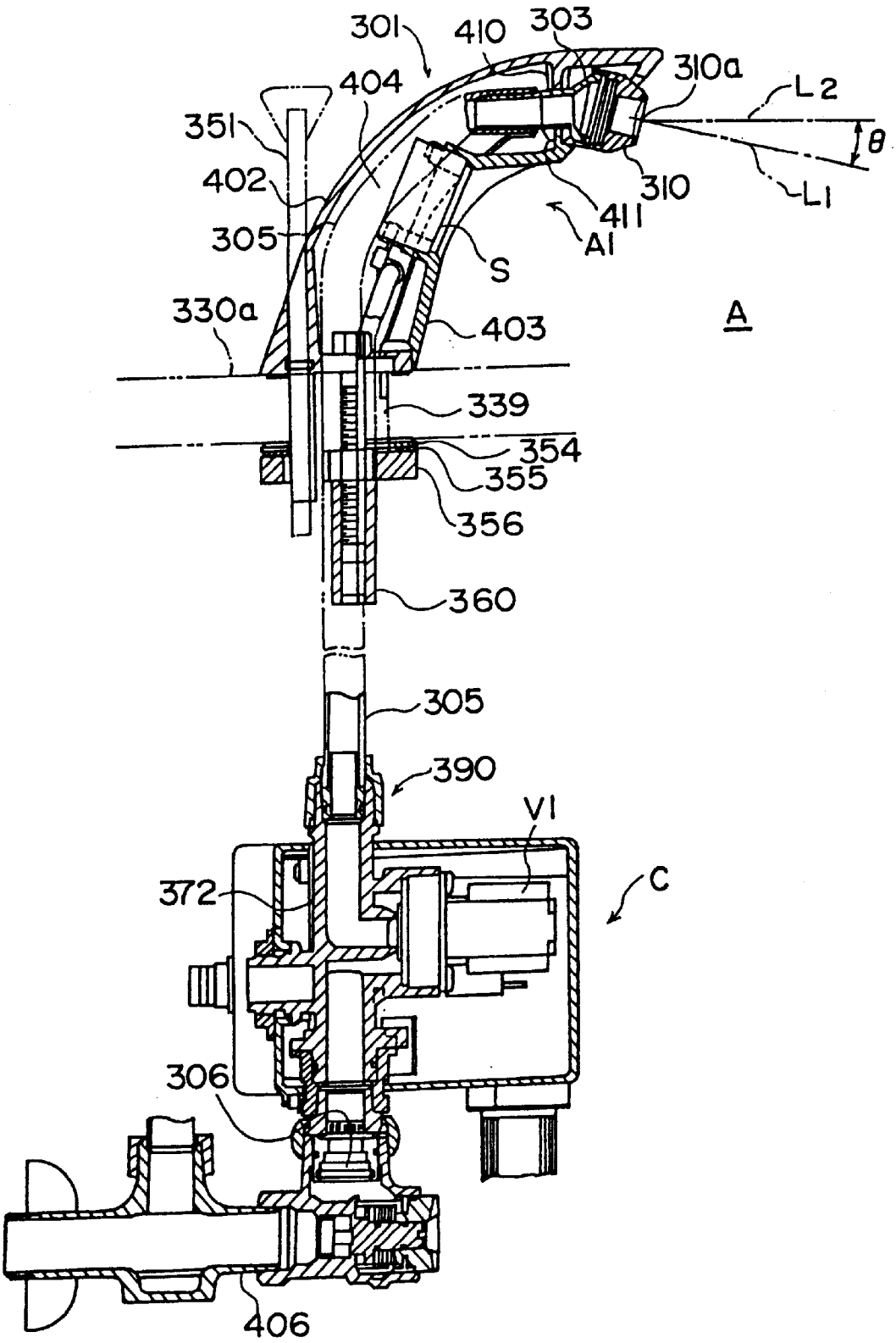
FIG. 38 is a side cross-sectional view showing the whole construction of the same automatic faucet.
Figure 39:
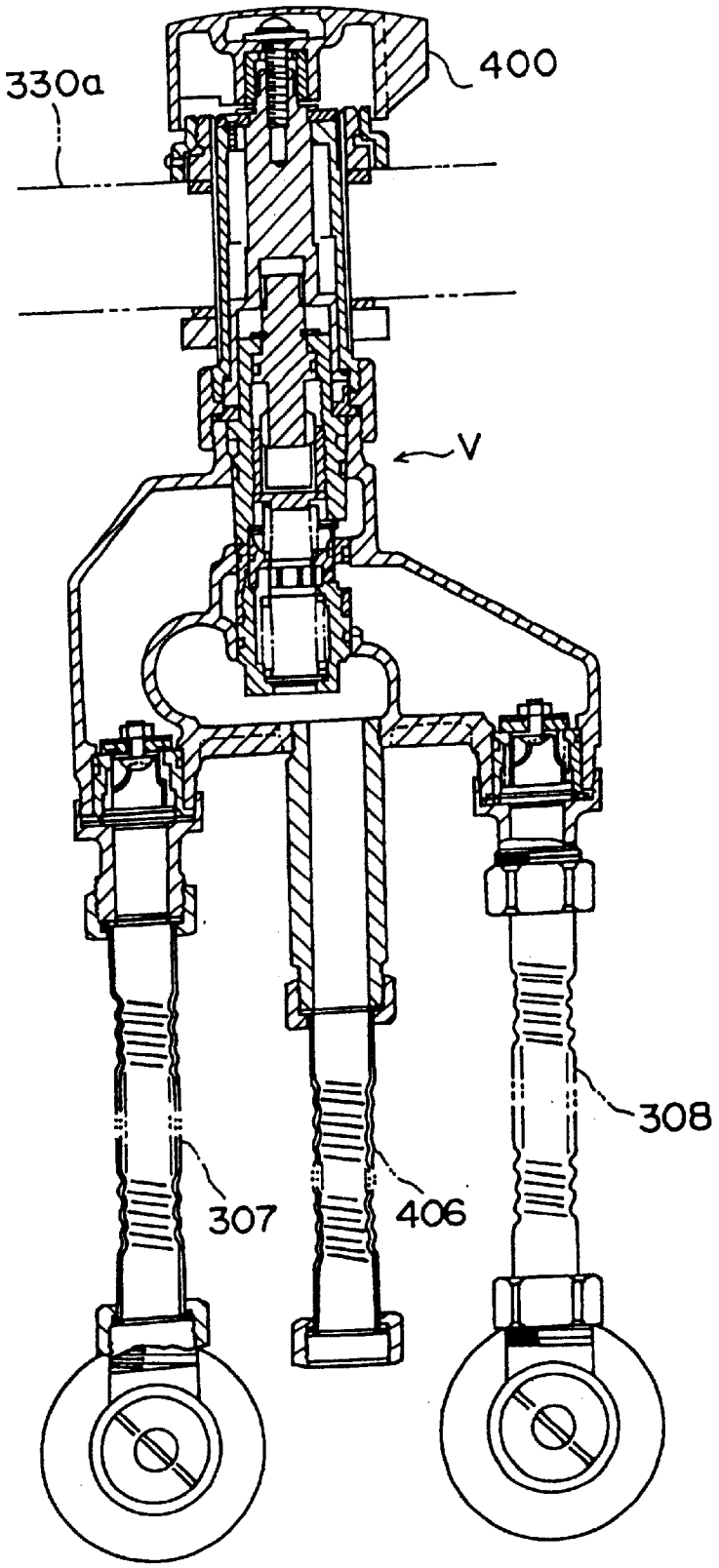
FIG. 39 is an illustration for assistance in explaining the thermostat type mixing valve of the same automatic faucet.

As shown in FIGS. 37 to 39, this third embodiment according to the present invention is characterized in that the thermostat type mixing valve V is disposed under the faucet mounting surface 330*a*, without housing the mixing valve V in the automatic control box C.

In more detail, as shown in FIGS. 37 and 38, the automatic faucet A related to the present embodiment is composed of a faucet section A1, an automatic faucet control box C, and a thermostat type mixing valve V disposed separately from the automatic faucet control box C. The faucet section A1 is mounted on a faucet mounting surface 330*a* formed at the rear portion of a washbowl 330 of a lavatory B. The automatic faucet control box C is disposed under the lavatory B and supplies mixed hot and cold water to the faucet section A1 through a mixed hot and cold water supply pipe 305 formed of a flexible resin tube (e.g., vinyl chloride tube).

The faucet section A1 is composed of a faucet body 301 mounted on the faucet mounting surface 330*a* under frontward inclined condition, a water discharge pipe 303 having a base end projecting from the faucet body 301 at the upper front portion of the faucet body 301, and a hand sensor S disposed in the lower front surface of the water discharge pipe 303.

On the other hand, the automatic control box C accommodates an electromagnetic open-close valve V1, a control unit F, and a power supply unit E, etc.

The thermostat type mixing valve V is mounted substantially on the reverse surface of the faucet mounting surface 330*a*, and a temperature adjusting handle 400 is disposed on the faucet mounting surface 330*a*.

The piping structure will be explained hereinbelow The hot water inlet portion of the thermostat mixing valve V is connected to a hot water supply pipe 307 connected to a hot water supply source, and the cold water inlet portion of the thermostat mixing valve V is connected to a cold water supply pipe 308 connected to a cold water supply source.

On the other hand, a mixed hot and cold water outlet portion is connected to an inflow opening of an integral formation pipe 372 disposed in the automatic control box C via a mixed hot and cold water supply pipe 406.

In the construction as described above, whenever the user stretches his hands into the washbowl 330, the hand sensor S is activated to output an output signal. On the basis of this output signal, the control unit F opens the electromagnetic open-close valve V1, so that mixed hot and cold water whose temperature is adjusted appropriately by the thermostat type mixing valve V is discharged from the water discharge pipe 303 into the washbowl 330 through the mixed hot and cold water supply pipe 305 and the faucet body 301, so that the user can wash his hands by the automatically discharged water.

The water discharge direction of the water discharge pipe 303 is determined roughly downward from the horizontal direction.

That is, as shown in FIG. 38, the direction of a water discharge opening 310*a* of the water discharge pipe 303 is so set that a downward angle θ between the water discharge line L1 and the virtual horizontal line $L_2$ lies between 0 and 35 degrees.

Therefore, the mixed hot and cold water discharged from the water discharge pipe 303 can be discharged along a parabolic locus, so that it is possible to broaden the hand or face washing space within the washbowl 330 as broad as possible.

As a result, it is possible to prevent the washing space from being narrowed when the water discharge pipe 303 extends toward the front portion of the washbowl 330, with the result that the usability of the automatic faucet A can be improved. In addition, since the hands H can be moved freely, it is possible to hit the discharged hot and cold water against not only the finger ends but also the whole palms of the stretched hands H, so that almost all the amount of the mixed hot and cold water can be used for washing. As a result, the hands can be washed by a small amount of water, so that it is possible to economize the amount of water used for hand washing.

Further, since the frontward projection distance of the water discharge pipe 303 can be reduced, it is possible to eliminate or reduced a feeling of oppression caused when the water discharge pipe 303 extends toward the front portion of the washbowl 330.

Further as shown in FIGS. 37 and 38, since the water discharge opening 310*a* of the water discharge pipe 303 can be seen by the user, the user can stretch his hands H toward the water discharge pipe 303 easily and accurately, so that it is possible to improve the usability of the automatic faucet A from this point of view.

Further, as shown in FIG. 28, since a constant flow rate valve 306 is interposed between the thermostat type mixing valve V and the mixed hot and cold water supply pipe 305, even if water pressure fluctuates, it is possible to prevent the mixed hot and cold water beyond a predetermined amount from being discharged from the water discharge opening 310*a*.

Further, the other construction of the second embodiment will be described hereinbelow In this embodiment as shown, a sensor mounting cover 403 made of synthetic resin material (e.g., plastic) is removably attached to the substantially reverse surface of the cast metal fixture body 402, and further a supply pipe accommodating space 404 is formed between the metal fixture body 402 and the sensor mounting cover 403.

Further, the water discharge pipe 403 is attached to the end of the faucet body 301. A discharge pipe mounting metal fixture 405 is connected to the mixed hot and cold water supply pipe 305 extending along the supply pipe accommodating space 404 at the base end thereof Further, an end of the discharge cap 310 is attached to the water discharge pipe 303. As already explained, the water discharge opening 310*a* of the water discharge cap 310 is so set that the downward angle θ between the water discharge line $L_1$ and the virtual horizontal line $L_2$ lies between 0 and 35 degrees.

Further, the hand sensor S is mounted on the sensor mounting cover 403, and an end of the electric cable 317 extending along the supply pipe accommodating space 404 is connected to the hand sensor S.

Further, as shown in FIG. 38, two water stoppers 410 and 411 are provided at the upper portions of the metal fixture body 402 and the sensor mounting cover 403 in such a way as to pinch the water discharge pipe 303. Therefore, it is possible to securely prevent scattered water from entering into the faucet body 301 and further from flowing downward along the electric cable 317, etc. As a result, it is possible to prevent such a trouble that the floor is wet and thereby corroded.

Further, with respect to the composing elements of the automatic faucet A related to the second embodiment which are the same as with the case of the second embodiment, 200 is added to each of the reference numerals attached in the second embodiment. Further, the same control method as disclosed with reference to FIGS. 13 to 18 can be adopted to this embodiment.

According to the structure of the second and third embodiments of the present invention, the following effects can be obtained:

(1) Since the discharge direction of water discharged from the discharge opening is directed slightly downward from the horizontal direction and further since the water is discharged over the washbowl along a parabolic locus, it is possible to broaden the hand or face washing space within the washbowl as broad as possible. As a result, since it is possible to prevent the washing space from being narrowed by the water discharge pipe, the usability of the faucet can be improved. Further, since the hands can be moved freely toward the discharged hot and cold water, the hands can be washed by a small amount of water, thus economizing washing water.

Further, since the frontward projection distance of the water discharge pipe can be reduced, it is possible to reduce a feeling of oppression of the user due to the water discharge pipe.

Further, since the water discharge opening of the water discharge pipe can be seen by the user, the user can stretch his hands toward the water discharge pipe easily and accurately, so that it is possible to improve the usability of the faucet from this point of view.

(2) Since water pressure or flow rate adjusting means such as a constant flow rate valve is disposed midway in the water discharge passage, even if water pressure fluctuates, it is possible to prevent mixed hot and cold water beyond a predetermined flow rate from being discharged from the water discharge opening.

Figure 40:
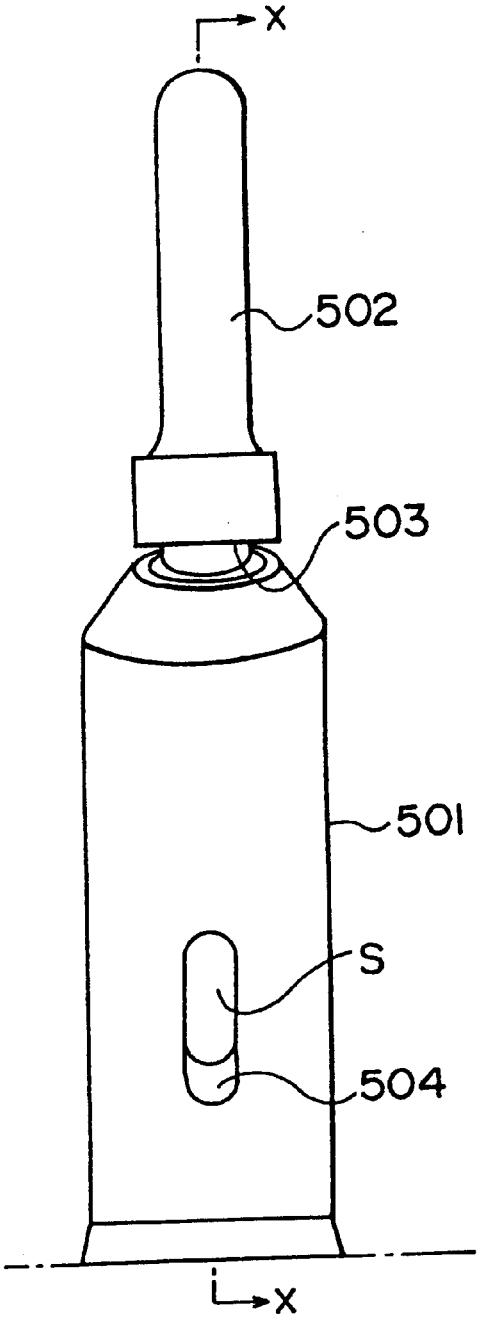
FIG. 40 is a front view showing a faucet related to the fourth embodiment of the present invention.
Figure 41:
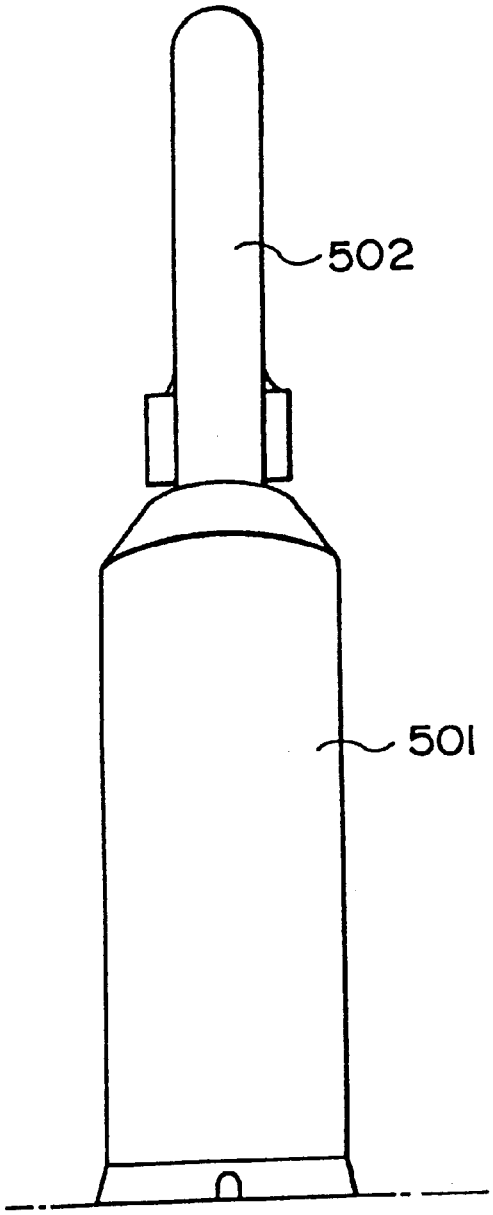
FIG. 41 is a rear view showing the same faucet shown in FIG. 40.
Figure 42:
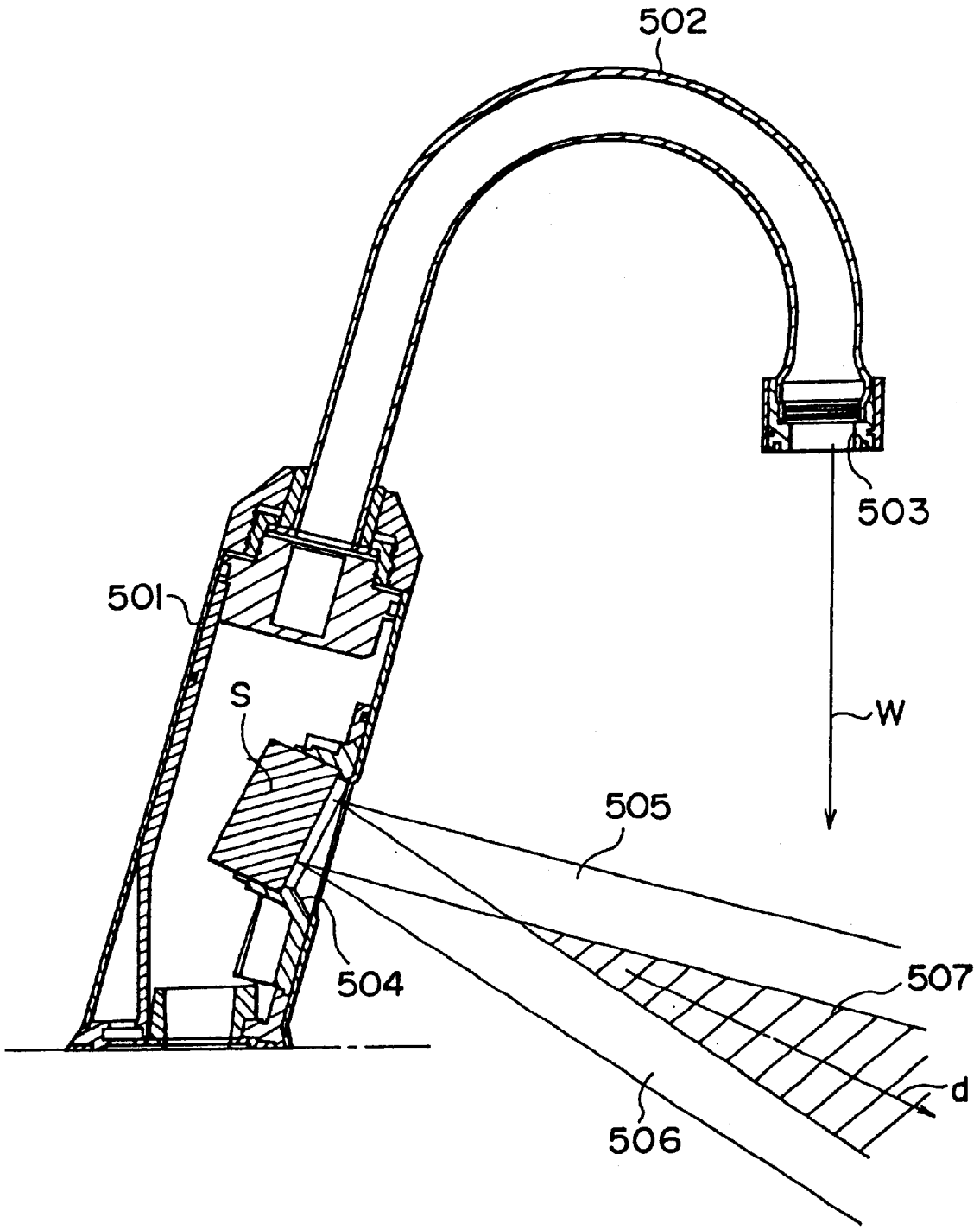
FIG. 42 is a cross-sectional view taken along the line X—X in FIG. 40.

FIGS. 40 to 42 show a fourth embodiment of the faucet according to the present invention, in which FIG. 40 is a front view showing the faucet; FIG. 41 is a rear view showing the same; and FIG. 42 is a cross-sectional view taken along the line X—X shown in FIG. 40.

The faucet related to this embodiment comprises a cylindrical faucet body 501, and a slender water discharge pipe 502 mounted on the upper end portion of the faucet body 501 extending being bent like a neck of a water bird. The faucet body 501 is installed at an appropriate edge position of a washbowl (not shown) in such a shape as to be stood vertically being inclined a little frontward. In this inclination status, the water discharge opening 503 formed at the end of the water discharge pipe 502 is directed just downward, so that the axis W of the discharged water stream is always kept directed vertically downward, irrespective of the flow rate of the discharged water. The position of the water discharge opening 503 is determined sufficiently high from the bottom of the washbowl and sufficiently away from the faucet body 501, so that it is possible to provide a sufficiently broad hand washing space under the water discharge opening 503.

The detailed structure of this faucet is omitted herein, because being substantially the same as that of the other embodiments already explained, except some modifications for realizing the unique shape and some rearrangements in design. Therefore, only the hand sensor S will be described in further detail hereinbelow.

The hand sensor S is housed in the faucet body 501. A window 504 is formed in a front surface wall of the faucet body 501, and a light emitting, region 505 and a light receiving region 506 expand toward a frontward hand washing space through the window 504 roughly in parallel to each other. The region at which the light emitting region 505 and the light receiving region 506 of the hand sensor S are overlapped with reach other is detection region within which an object can be detected. The directional axis d of this detection region is adjusted so as to intersect the axis W of the discharged water stream.

Figure 43:
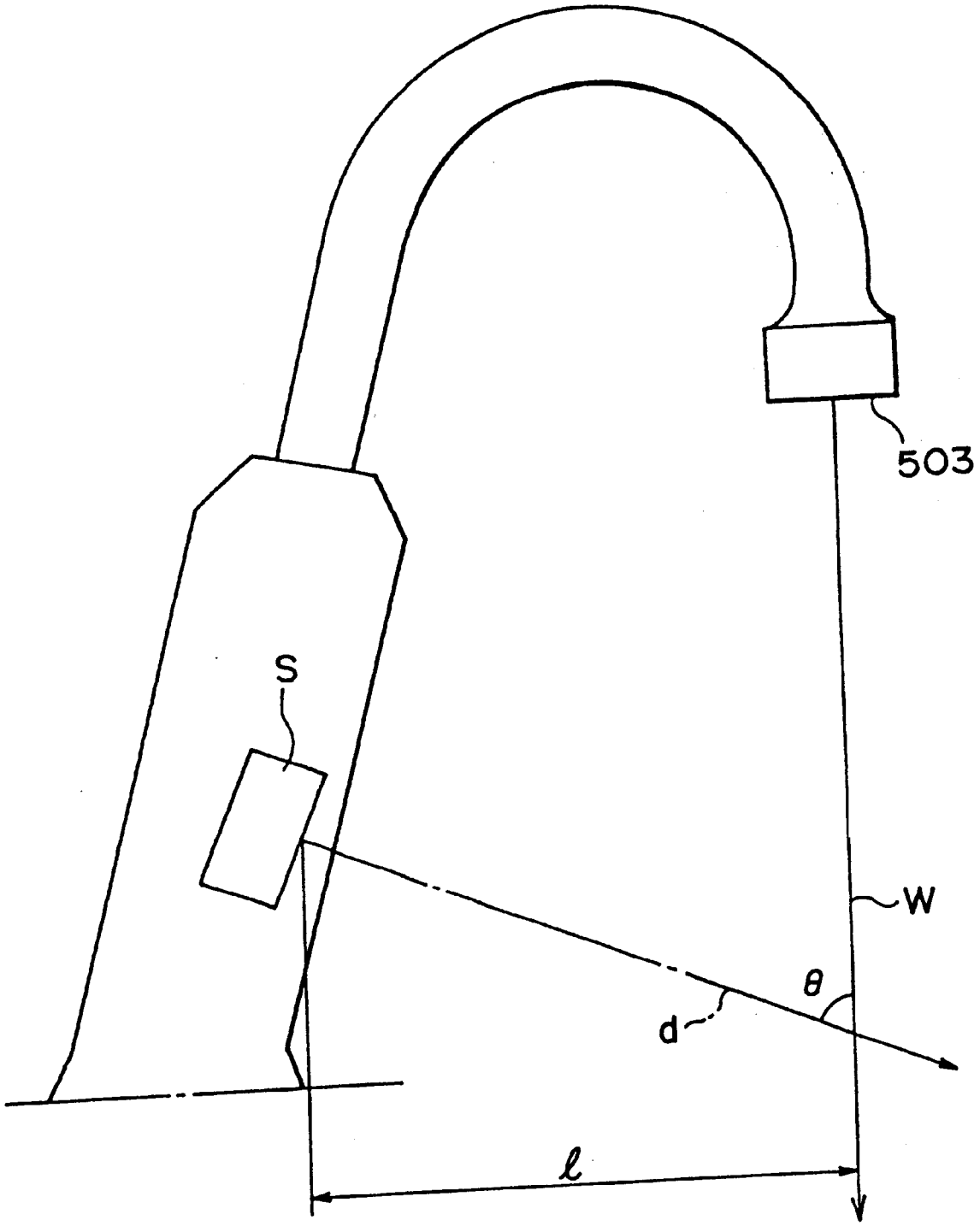
FIG. 43 is a side view showing one positional relationship between the hand sensor of the same faucet and the discharged water stream.

FIG. 43 shows a positional relationship between the hand sensor S and the discharged water stream axis W extending from the water discharge opening 503.

Here, water stop experiments have been made, after water has been started to discharge by approaching the hands to the faucet, on condition that three parameters are changed within the following ranges:

$55 \leqq l \leqq 80$, $20 \leqq L \leqq 50$, $65° \leqq \theta \leqq 90°$ where l denotes the distance between the hand sensor S and the discharged water stream axis W; L denotes the vertical distance between a start point of the direction axis of the detection region 507 of the hand sensor S and the water discharge opening 503; and θ denotes the angle between the directional axis d of the detection region 507 of the hand sensor S and the discharged water stream axis W.

Further, the amount of flow of discharged water is kept constant at 5 litter/min; a water straightening element (a ratio of the diameter D to the water path length is r=1.2) is used Further, l and L have been changed for each 5 mm, and θ has been changed for each 5 degrees.

The test results indicated that erroneous operation will not occur as far as the following ranges can be satisfied:

(1) $l \geqq 70$ mm in all ranges of θ and L (2) $l \geqq 60$ mm and 35 mm $\leqq L \leqq 45$ mm in all range of θ

(3) $\theta \leqq 70°$ in all ranges of l and L

In the faucet of the present invention, since the discharged water stream is determined at a constant position irrespective of the flow amount of the discharged water, the distance between the hand sensor and the discharged water stream axis W is kept constant Therefore, it is preferable to design the sizes of the faucet and the washbowl under due consideration of the above-mentioned experiment results.

Further in this embodiment, it is possible to adopt the afore-mentioned control method.

FIGS. 44 to 48 show various modifications of the hand sensor used for the automatic faucet according to the present invention.

Figure 44:
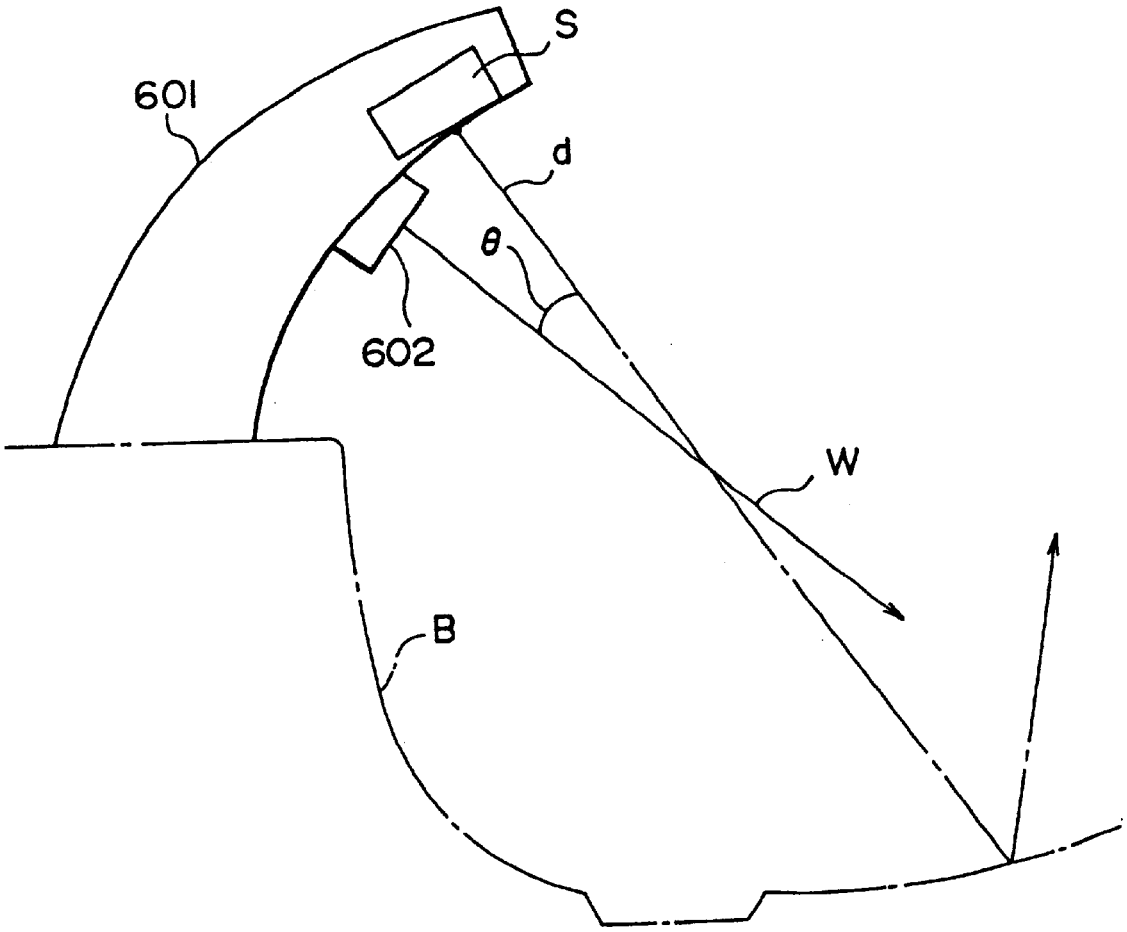
FIG. 44 is a side view showing another arrangement of the hand sensor.

FIG. 44 shows an example in which the hand sensor S is mounted at a position upward from the water discharge opening 602 on the faucet body 601. The directional axis d of the detection region of the hand sensor S intersects the discharged water stream axis W, and the intersection angle θ between the axes d and W is adjusted less than 70 degrees for prevention of the erroneous detection of discharged water.

FIG. 44 shows an example in which the directional axis d of the detection region is so adjusted as to be reflected from the bottom surface of the washbowl B in a direction away from the faucet 6010 In this modification, it is possible to further reduce a possibility that the washbowl is detected as hands erroneously.

Figure 45:
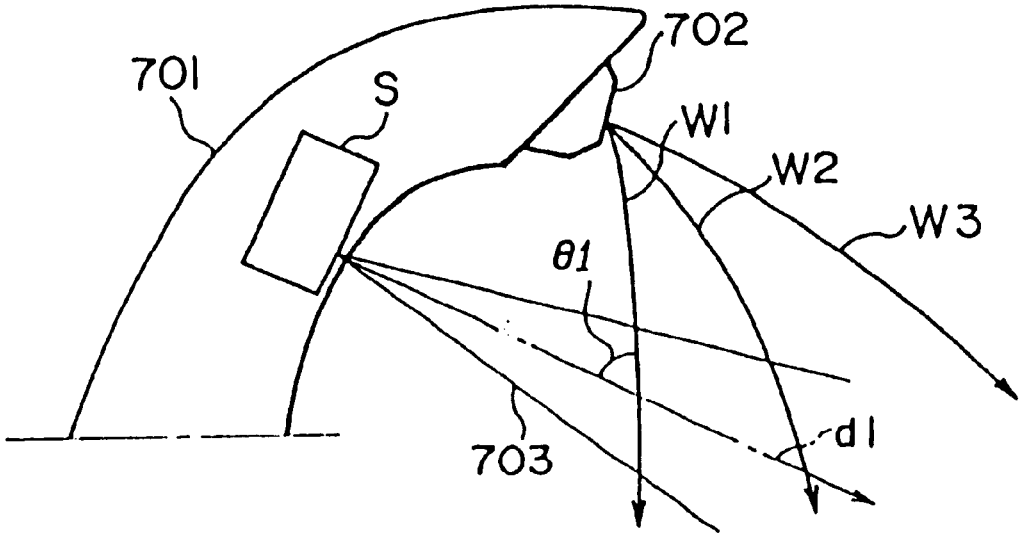
FIG. 45 is a side view showing still other positional relationship between the hand sensor of the same faucet and the discharged water stream.
Figure 46:
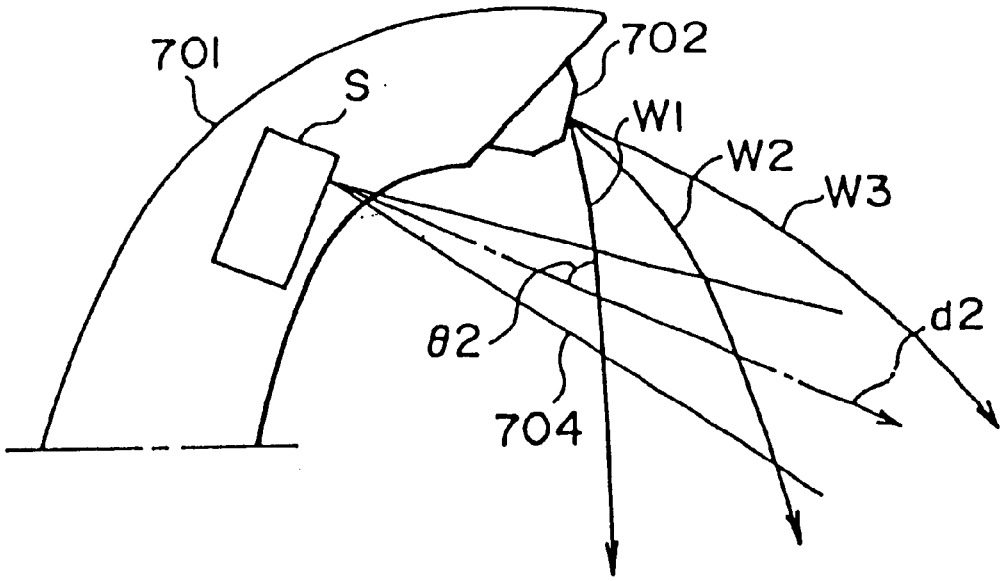
FIG. 46 is a side view showing still other positional relationship between the hand sensor of the same faucet and the discharged water stream.

FIG. 45 shows an example in which the directional axis d1 of the light receiving region 703 of the hand sensor S intersects three discharged water stream axes W1, W2 and W3. FIG. 46 shows an example in which the directional axis d2 of the light emitting region 704 of the hand sensor S intersects three discharged water stream axes W1, W2 and W3. In any case, it is preferable that the intersection angle θ1 or θ2 is determined less than 70 degrees for prevention of erroneous detection of the discharged water.

As far as the ordinary hand sensor S is used (in which the positional offset between the light emitting region 703 and the light receiving region 704 is sufficiently small as compared with the size of the hand sensor S), even when any one of the light emitting region 703 and the light receiving region 704 is so determined as to intersect the discharged water stream as shown in FIGS. 45 or 46 or even when the detection region does not intersect the discharged water stream, since the hands stretched for hand washing can be located within the detection region, it is possible to securely detect the hands.

Figure 47:
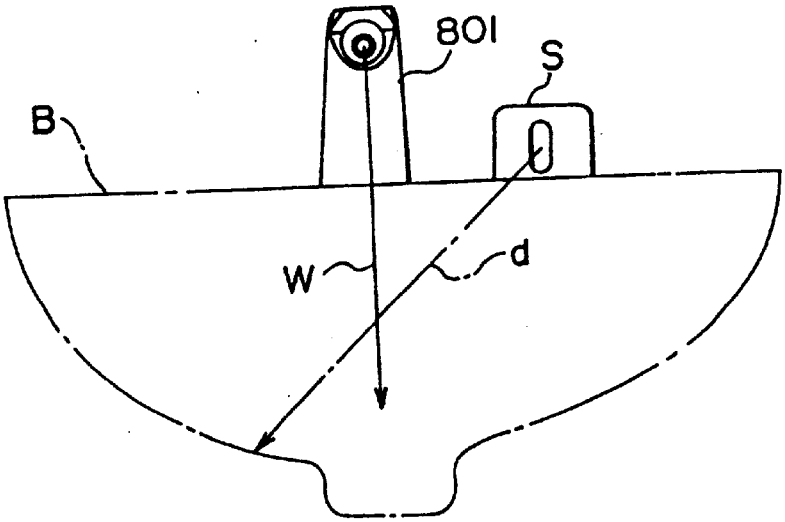
FIG. 47 is a front view showing a faucet in which the hand sensor is mounted at a position away from the faucet body.
Figure 48:
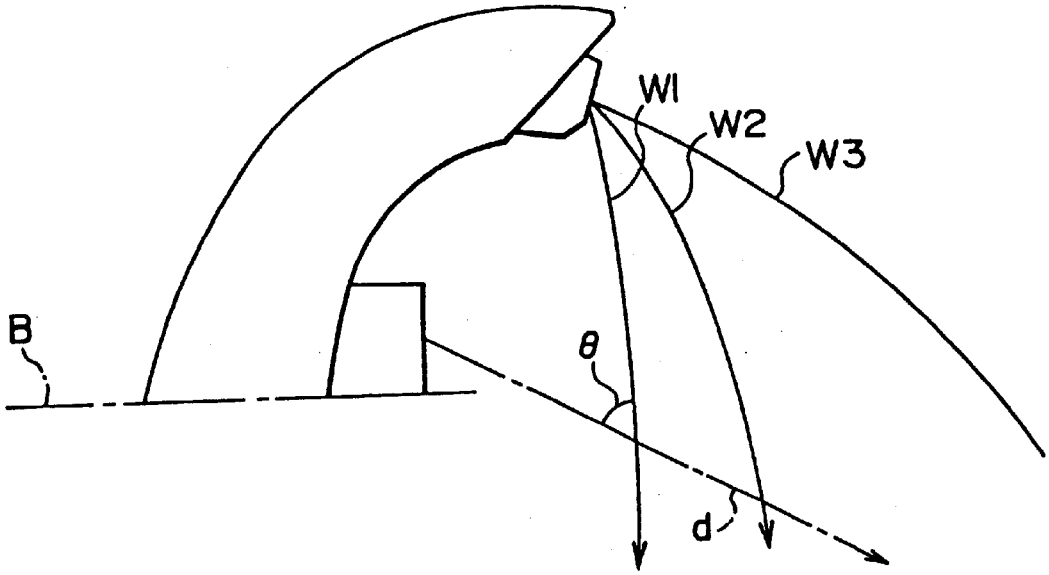
FIG. 48 is a side view showing the same faucet.

FIGS. 47 and 48 show other examples in which the hand sensor S is mounted at a position away from the faucet body 801. In these examples, the detection region of the hand sensor S is so adjusted so as to intersect the discharged water streams W1, W2 and W3. Further, it is preferable that the angle θ between the directional axis d of the detection region and the discharged water streams W1, W2 and W3 is determined less than 70 degrees.

Figure 49:
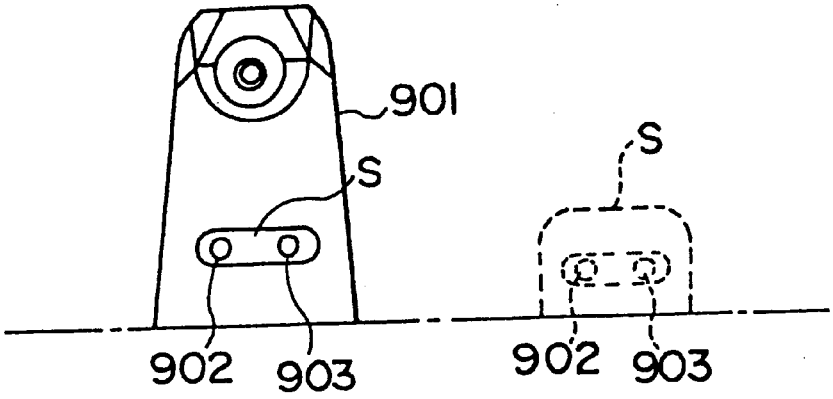
FIG. 49 is a front view showing a faucet in which the light emitting element and the light receiving element of the hand sensor are arranged in the horizontal direction.

FIG. 49 shows an example in which the light emitting element 902 and the light receiving element 903 of the hand sensor S are arranged side by side away from each other in the horizontal direction. Further, the hand sensor S can be housed in the faucet body 901 as shown by solid lines or disposed outside the faucet body 901 as shown by dashed lines.

Where the light emitting element 902 and the light receiving element 903 are arranged horizontally as described above, since the shape of the sensor holder can be simplified, the molding die thereof can be manufactured at a low cost. In addition, the two elements 902 and 903 can be arranged on a printed circuit board more easily. On the other hand, when the light emitting element and the light receiving element are arranged vertically as with the case of the afore-mentioned embodiments, there-exists such an advantage that the shape of the faucet can be make narrow from the design standpoint.

Figure 50:
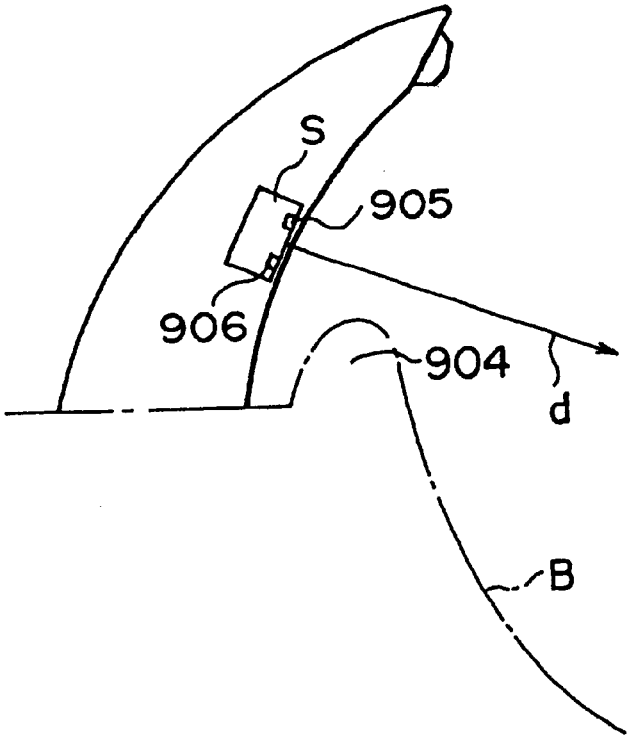
FIG. 50 is a side view showing the positional relationship between the hand sensor and a rim rising from the washbowl

Further, when the light emitting element and the light receiving element are arranged vertically on a washbowl B having an upward extending rim 904 as shown in FIG. 50, it is preferable that the light emitting element 905 is arranged over the light receiving element 906 so that the light emitted from the light emitting element 905 is not shaded by the rim 904.

As described above, various embodiments of the faucet according to the present invention have been described.

However, it is further understood by those skilled in the art that the foregoing description is preferred embodiments of the disclosed faucet and that various changes and modifications may be made in the invention without departing from the gist of the present invention.

What is claimed is:

1. An automatic faucet having a hand sensor for detecting presence or absence of hands within a hand washing space to start and stop discharging water from a water discharge opening automatically, the hand sensor comprises:

a transmitter for transmitting a signal wave to a transmission region directed toward the hand washing space;

a receiver for receiving a signal wave reflected from a reception region directed also toward the hand washing space;

a detection region being formed by a partial overlapping portion of both the transmission region and a reception region, and at least one of said wave of said transmission region and of said receiving region being adjusted to intersect a stream of water discharged from the water discharge opening, and said transmission region and said receiving region being adjusted to be roughly in parallel with each other.

2. The automatic faucet of claim 1, wherein an angle θ between a directional axis of the detection region and an axis of the water stream is less than 70 degrees.

3. The automatic faucet of claim 1, wherein an angle θ1 between a directional axis of the transmission region and axis of the water stream in less than 70 degrees.

4. The automatic faucet of claim 1, wherein;

an angle θ2 between a directional axis of the reception region and an axis of the water stream is less than 70 degrees.

5. The automatic faucet of claim 1, wherein;

a water flow straightening element in a pipe passage for introducing water to the water discharge opening, to form a smooth rod-shaped water flow irrespective of flow rate of water discharged from the water discharge opening.

6. The automatic faucet of claim 5, wherein the water flow straightening element is a cylindrical cap for forming the water discharge opening, a diameter of the water discharge opening being determined 1.2 times longer than a water path length of the cylindrical cap.

7. The automatic faucet of claim 1, which further comprises a water sprinkling element for sprinkling water discharged from the water discharge opening in a pipe path for introducing water to the water discharge opening.

8. The automatic faucet of claim 1, wherein a distance between one of said transmitter and said receiver and said stream of water discharged from said water discharge opening is sufficiently long so that the signal wave reflected from the discharged water can be directed away from the receiver.

9. The automatic faucet of claim 1, wherein;

said transmitter is a light emitting element and said receiver is a photoelectric sensor, the light emitting element and the photoelectric sensor being housed within a faucet body of the automatic faucet in such a way that both the element and the sensor are arranged on a same plane at a distance of 0 to 5 cm apart from each other and that direction axes of both elements and the sensor are determined substantially parallel to each other.

10. The automatic faucet of claim 1, wherein;

said transmitter is a light emitting element and said receiver is a photoelectric sensor, the light emitting element and the photoelectric sensor being housed within a faucet body of the automatic sensor in such a way that the sensor is arranged a distance 70 mm apart from a water stream from the water discharge opening in a horizontal direction.

11. The automatic faucet of claim 1, wherein;

said transmitter is a light emitting element and said receiver is a photoelectric sensor, the light emitting element and the photoelectric sensor being housed within a faucet body of the automatic faucet in such a way that the sensor is arranged a distance 35 to 45 mm apart from a water stream from the water discharge opening in a vertical direction and a distance 60 mm or more apart from the same stream in a horizontal direction.

12. An automatic faucet for starting and stopping discharge of water automatically by detecting presence or absence of hands, as recited in claim 1, wherein a water discharge opening is directed so that water can be discharged slightly downward from a horizontal direction.

13. The automatic faucet of claim 12, which further comprises a flow rate control device for holding a water discharge rate at a constant level, irrespective of water pressure of a water supply source.

14. The automatic faucet of claim 12, further comprising a flow rate control device for holding the flow rate of the stream of water at a constant level irrespective of the water pressure of a water supply source.

15. An automatic faucet for starting and stopping discharging water automatically by detecting presence or absence of hands, comprising:

a water discharge opening directed slightly downward from a horizontal direction; and a hand sensor for detecting presence or absence of hands within a hand washing space, having a transmitter for transmitting a signal wave to a transmission region directed toward the hand washing space;

a receiver for receiving a signal wave reflected from a receiving region directed also toward the hand washing space; and a detection region being formed by a partial overlapping portion of both said transmission region and said receiving region, and at least one of directional axes of said transmission region and of said receiving region being adjusted to intersect a stream of water discharged from said water discharge opening, at an angle less than 70 degrees irrespective of flow rate of the stream of water.

* * * * *

UNITED STATES PATENT AND TRADEMARK OFFICE

CERTIFICATE OF CORRECTION

PATENT NO.: 5,918,855
DATED : July 6, 1999
INVENTOR(S): Hamanaka et al.

It is certified that error appears in the above-identified patent and that said Letters Patent is hereby corrected as shown below:

Claim 15 should read --14--.

Claim 14 should read --15-- and depend from claim 14, not 12.

Signed and Sealed this

Eighth Day of February, 2000

*Attest:*

*Attesting Officer*

Q. TODD DICKINSON

*Commissioner of Patents and Trademarks*